US011986873B2

(12) United States Patent
Ruegenberg

(10) Patent No.: US 11,986,873 B2
(45) Date of Patent: May 21, 2024

(54) CONNECTING SHEET METAL END SECTIONS BY MEANS OF FORMING

(71) Applicant: Roland Ruegenberg, Bad Sobernheim (DE)

(72) Inventor: Roland Ruegenberg, Bad Sobernheim (DE)

( * ) Notice: Subject to any disclaimer, the term of this patent is extended or adjusted under 35 U.S.C. 154(b) by 665 days.

(21) Appl. No.: 16/972,789

(22) PCT Filed: Jun. 26, 2019

(86) PCT No.: PCT/EP2019/067070
§ 371 (c)(1),
(2) Date: Dec. 7, 2020

(87) PCT Pub. No.: WO2020/002466
PCT Pub. Date: Jan. 2, 2020

(65) Prior Publication Data

US 2021/0245223 A1 Aug. 12, 2021

(30) Foreign Application Priority Data

Jun. 26, 2018 (DE) ..... 10 2018 115 382.1

(51) Int. Cl.
*B21D 39/02* (2006.01)
*B21D 13/02* (2006.01)
*B21D 5/12* (2006.01)

(52) U.S. Cl.
CPC ..... *B21D 13/02* (2013.01); *B21D 39/023* (2013.01); *B21D 5/12* (2013.01)

(58) Field of Classification Search
CPC .... B21D 39/02; B21D 39/021; B21D 39/023; B21D 39/026; B21D 5/12
See application file for complete search history.

(56) References Cited

U.S. PATENT DOCUMENTS 2,076,228 A 4/1937 Dressing
3,636,903 A 1/1972 Anderson et al.
3,862,479 A * 1/1975 Laderoute ..... E04B 5/40 249/91

FOREIGN PATENT DOCUMENTS

CN 104259329 A 1/2015
CN 106555792 A 4/2017
CN 107952894 A 4/2018
(Continued)

OTHER PUBLICATIONS

Office Action for Chinese Application No. 201980039361.8 dated Mar. 8, 2023 and English translation.
(Continued)

*Primary Examiner* — Debra M Sullivan
(74) *Attorney, Agent, or Firm* — Harness, Dickey & Pierce, P.L.C.

(57) ABSTRACT

In one embodiment, the method includes providing a double sheet metal element including the two sheet metal end sections; and creating a connecting section along the connecting line. The creation of the connecting section includes introducing a first depression into the double sheet metal element, and creating a first folded section of the double sheet metal element. The method further includes orienting the connecting section relative to an extension plane of the double sheet metal element so that the connecting section extends perpendicularly to the extension plane.

30 Claims, 45 Drawing Sheets

(56) References Cited

FOREIGN PATENT DOCUMENTS

| | | | | |
|---|---|---|---|---|
| DE | 610711 | C | 3/1935 | |
| WO | WO-9014180 | A1 | 11/1990 | |
| WO | WO-0227218 | A2 * | 4/2002 | ..... B21D 39/02 |
| WO | WO-2011083731 | A1 | 7/2011 | |

OTHER PUBLICATIONS

International Search Report PCT/ISA/210 for International Application No. PCT/EP2019/067070 dated Oct. 29, 2019.
Written Opinion PCT/ISA/237 for International Application No. PCT/EP2019/067070 dated Oct. 29, 2019.
Office Action dated Jul. 29, 2022, issued in corresponding Chinese Patent Application No. 201980039361.8.
Chinese Office Action, dated Sep. 14, 2023, issued in Chinese Patent Application No. 201980039361.8.

* cited by examiner

CONNECTING SHEET METAL END SECTIONS BY MEANS OF FORMING

CROSS-REFERENCE TO RELATED APPLICATIONS

This application is a national phase under 35 U.S.C. § 371 of PCT International Application No. PCT/EP2019/067070 which has an International filing date of Jun. 26, 2019, which claims priority to German Application No. 10 2018 115 382.1, filed Jun. 26, 2018, the entire contents of each of which are hereby incorporated by reference.

BACKGROUND

The invention relates to a method and to a device for connecting two sheet metal end sections arranged on top of one another.

Welding methods, for example, are known for connecting sheet metal. Using such a welding method, however, can result in shrinkage, high internal stress, and structural changes in the seam region of the sheet metal to be connected. In the process, there is a risk that brittle fracture tendency as well as cracking may occur in the seam region.

In the case of thin sheet metal, it is furthermore customary to connect the sheet metal by way of spot welding. In the case of uneven sheet metal or in the presence of additional foreign material, for example from coatings, particles of which can find their way into the weld spot, there is an increased risk that faulty welds can occur. In the case of a welding process, additionally in general the need arises to provide any sharp-edged sheet metal edges that remain after the welding process with additional edge protection, or to additionally fold these over in a further processing step, to avoid a risk of injury.

It is the object of the invention to create an improved method for connecting two sheet metal end sections.

The object underlying the invention is achieved by the features of the independent claims. Embodiments of the invention are described in the dependent claims.

BRIEF SUMMARY

Embodiments include a method for connecting two sheet metal end sections arranged on top of one another by means of forming. The method comprises providing a double sheet metal element, which includes the two sheet metal end sections arranged on top of one another and extends in an extension plane. This extension plane denotes a plane in which the two sheet metal end sections jointly extend prior to a connecting section being created. The two sheet metal end sections are to be connected to one another along a connecting line located in the extension plane. According to embodiments, the connecting line extends parallel to an edge of the double sheet metal element. A connecting section is created along the connecting line. The creation of the connecting section includes introducing a first depression extending along the connecting line, for example a V-shaped depression, into the double sheet metal element. A first folded section of the double sheet metal element is created along the connecting line, wherein two mutually opposing inside walls of the first depression are pressed against one another. The first depression is closed by pressing the inside walls against one another. According to embodiments, only a narrow gap remains between the two inside walls that are pressed against one another. The first folded section is thus a section that is folded once.

The connecting section, which includes the first folded section, is oriented perpendicularly relative to the extension plane of the double sheet metal element by bending a portion of the double sheet metal element which includes the connecting section along a first bending axis extending parallel to the connecting line, so that the first folded section or connecting section extends perpendicularly to the extension plane. For example, the connecting section can be implemented by the first folded section, that is, a section folded once. It is possible, for example, for more than one fold to take place, and for the connecting section to be implemented by a section that is folded multiple times, for example folded twice.

Embodiments can have the advantage that a method for quickly and reliably connecting two sheet metal end sections is provided, which, for example, is able to replace conventional welding processes. The method is characterized by high stability, reliability, speed, and a low need for maintenance. For example, the method for connecting provided here prevents sharp edges from being created or remaining. Embodiments can have the advantage that the resulting connecting section is characterized by small dimensions and, in particular, has a small extension parallel to the original extension plane compared to the two sheet metal end sections prior to the use of the method. The method makes it possible to use fully automated systems for connecting the sheet metal end sections, which allow processing times in the range of a few seconds. For example, processing times of less than three seconds per double sheet metal element can be achieved in this way. According to embodiments, the portion of the double sheet metal element including the connecting section, as a result of the perpendicular orientation, only has a small extension, proceeding from the first bending axis, parallel to the original extension plane of the double sheet metal element of a few millimeters. For example, the extension is less than 4 mm or less than 3 mm. According to embodiments, the connecting section has a width of the same size.

According to embodiments, the creation of the connecting section furthermore includes introducing a second depression extending along the connecting line, for example a V-shaped depression, into the double sheet metal element. A second folded section of the double sheet metal element along the connecting line is created, wherein two mutually opposing inside walls of the second depression are pressed against one another, and the second folded section encompasses the first folded section. The second folded section is thus a section that is folded twice. The second depression is closed by pressing the inside walls against one another. According to embodiments, only a narrow gap remains between the two inside walls that are pressed against one another. In this embodiment, the connecting section is implemented by the second folded section, that is, a section that is folded twice.

Embodiments can have the advantage that, as a result of the multiple, for example double, folding and the resulting specific shape, the second folded section of the double sheet metal element, and thus the connection between the two sheet metal end sections provided by the resulting connecting section, is highly stable.

According to embodiments, the connecting section is the second folded section. A connecting section comprising the first and second folded sections, that is, which is folded twice, is created, for example, along a straight edge of the double sheet metal element. As a result of the double fold, very high stability of the connection may be implemented. According to embodiments, the connecting section is the first folded section. A connecting section that only comprises the first folded section, that is, which is folded once, is created, for example, along a curved edge of the double sheet metal element. Along a curved edge, that is, on a bent curve track, a single fold can have the advantage of easier processing, for example due to a lesser degree of internal material stresses, while offering sufficient stability of the connection.

According to embodiments, the two sheet metal end sections of the double sheet metal element which are arranged on top of one another have the same length, that is, proceeding from the connecting line, the two sheet metal end sections extend equally far along the shared extension plane, or the edges of the two sheet metal end sections are arranged on top of one another. Together, the two edges form the edge of the double sheet metal element. In this case, the two sheet metal end sections contribute equally to the creation of the first depression. According to embodiments, the two sheet metal end sections of the double sheet metal element which are arranged on top of one another have differing lengths, that is, proceeding from the connecting line, the two sheet metal end sections extend differently far along the shared extension plane. In this case, the edges of the two sheet metal end sections are arranged offset with respect to one another, and the edge of the double sheet metal element is formed by the edge of the sheet metal end section extending further along the extension plane. In this case, the two sheet metal end sections contribute to the creation of the first depression to different degrees. For example, one of the two sheet metal end sections does not extend to a base of the first depression and/or does not extend beyond the base. In this case, the edge of this sheet metal section is either enveloped by the second sheet metal section when the first folded section is created and/or is folded over when the second folded section is created.

A connecting line here shall be understood to mean a line, for example, a straight line or a bent curve track, along which a connection is established between the two sheet metal end sections. A connecting section shall be understood to mean a section of a double sheet metal element extending along a connecting line, in which the two sheet metal end sections of the double sheet metal element are connected to one another by means of forming, that is, a section of a double sheet metal element in which the forming step was carried out.

According to embodiments, the method comprises aligning the connecting section, prior to the perpendicular orientation of the connecting section. The alignment of the connecting section comprises bending the connecting section about a second bending axis extending parallel to the connecting line, so that the connecting section extends parallel to the extension plane of the double sheet metal element. Embodiments can have the advantage that the alignment of the connecting section makes it easier to perpendicularly orient the connecting section.

According to embodiments, the connecting section is the second folded section, and the method comprises aligning the second folded section, prior to perpendicularly orienting the second folded section. The alignment of the second folded section comprises bending the second folded section about a second bending axis provided by an edge of the second depression, so that the second folded section extends parallel to the extension plane of the double sheet metal element.

According to embodiments, the double sheet metal element comprises an edge, which provides a free end of the double sheet metal element. The connecting line, along which the two sheet metal end sections are to be connected to one another, extends, for example, parallel to this edge. By carrying out the above-described method for connecting two sheet metal end sections that are arranged on top of one another, the free end of the double sheet metal element is folded over twice and perpendicularly oriented.

According to embodiments, each of the two sheet metal end sections is an edge section of two parts to be connected to one another. For example, the two parts to be connected to one another are two half shell elements or two hollow body halves. According to embodiments, the two parts can be two halves of a vehicle catalytic converter casing, for example.

Sheet metal here shall be understood to mean a flat finished rolling mill product made of metal, for example stainless steel. The sheet metal can furthermore comprise additional material layers, such as coatings. The additional material layers can comprise metal layers and/or non-metal layers. The sheet metal can have a planar surface or a profiled surface, for example a corrugated surface, a nubby surface having a groove pattern and/or a surface provided with a honeycomb pattern.

According to embodiments, each of the two sheet metal end sections has an edge, wherein the two edges of the sheet metal end sections arranged on top of one another extend parallel to one another. For example, proceeding from the two edges, the two sheet metal end sections of the double sheet metal element which are arranged on top of one another extend parallel to one another in the same direction. According to embodiments, the two edges of the two sheet metal end sections arranged on top of one another extend parallel to an edge of the double sheet metal element. According to embodiments, the edge of the double sheet metal element is provided by one or both edges of the two sheet metal end sections arranged on top of one another.

A folded section of the double sheet metal element here shall be understood to mean a section of the double sheet metal element that comprises at least two sub-sections of the double sheet metal element which are arranged on top of one another as a result of a fold, that is, a bend by 180° along a bending axis.

According to embodiments, the double sheet metal element comprises a free end, which is a freely movable end within the scope of the bendability of the two sheet metal end sections. According to embodiments, the double sheet metal element furthermore comprises a fixed end, which extends, for example, parallel to the free end. According to embodiments, the fixed end is at least intermittently fixed so as to be immovable. According to further embodiments, the fixed end is fixed in such a way that only movements parallel to the connecting line are made possible. According to embodiments, the fixed end, for fixation, is clamped into a clamping device, which comprises two clamping elements, for example, each having a clamping surface.

According to embodiments, an edge of the first depression is formed by an edge of the double sheet metal element. Embodiments can have the advantage that they enable a compact connection between the two sheet metal end sections of the double sheet metal element which are arranged on top of one another. In this way, the distance between the first depression and the edge of the double sheet metal element can be minimized. In the process, the first depression extends parallel along the edge of the double sheet metal element.

According to embodiments, a first of the two mutually opposing inside walls of the second depression is at least partially provided by the first folded section. According to embodiments, the first of the two mutually opposing inside walls of the second depression comprises the edge of the double sheet metal element. The edge of the double sheet metal element was folded, for example, as a result of the free end of the double sheet metal element being folded over on the surface thereof. As a result of this folding, it can be prevented that a sharp edge encompassed by the edge of the double sheet metal element remains, after the two sheet metal end sections have been connected.

According to embodiments, the first and second depressions are both introduced into a first surface of the double sheet metal element.

According to embodiments, the creation of the connecting section furthermore comprises introducing a third depression extending along the connecting line, for example a V-shaped depression, into a second surface of the double sheet metal element which faces away from the first surface, wherein the first bending axis extends along a base of the third depression. Embodiments can have the advantage that the third depression makes it easier to perpendicularly orient the second folded section or connecting section.

According to embodiments, the creation of the connecting section furthermore comprises introducing a fourth depression extending along the connecting line, for example a V-shaped depression, into the first surface of the double sheet metal element, wherein an edge of the fourth depression provides the first bending axis. Embodiments can have the advantage that the fourth depression makes it easier to perpendicularly orient the second folded section or connecting section.

According to embodiments, the creation of the connecting section furthermore comprises aligning the first folded section, prior to introducing the second depression. The alignment of the first folded section comprises bending the first folded section about a third bending axis provided by an edge of the first depression, so that the first folded section extends parallel to the extension plane of the double sheet metal element. Embodiments can have the advantage that the alignment of the first folded section makes it easier to introduce the second depression.

A depression here shall be understood to mean a forming of a section of the double sheet metal element, wherein at least a portion of the formed section relative to the extension plane of the double sheet metal element is located lower prior to being formed and comprises a flat end section, which extends on the same plane as a base, or a lowest region of the depression (stepped configuration), or which, proceeding from the base, extends in the direction of the (original) extension plane of the double sheet metal element. In the latter case, the flat end section ends in a plane between the plane of the base and the extension plane, in the extension plane, or in a plane above the extension plane. The depression extending along the connecting line has an elongated stretched configuration, that is, the base of the depression extending along the connecting line has an elongated stretched configuration.

According to embodiments, the first, second, third and/or fourth depressions are V-shaped depressions. A V-shaped depression here shall be understood to mean a depression that has a V-shaped cross-section perpendicular to a longitudinal extension direction of the depression. The V-shaped cross-section comprises at least two legs, which intersect at an angle of greater than 0° and smaller than 180°. The two legs are provided by two mutually opposing inside walls of the V-shaped depression. The two mutually opposing inside walls of the V-shaped depression can be planar or arched. According to embodiments, the V-shaped depression includes a base, which can be provided in the form of an intersecting line of the two inside walls or of a connecting surface between the two mutually opposing inside walls. The connecting surface can be planar or arched.

According to alternative embodiments, the first, second, third and/or fourth depressions are U-shaped depressions. A U-shaped depression here shall be understood to mean a depression that has a U-shaped cross-section perpendicular to a longitudinal extension direction of the depression. The U-shaped cross-section includes at least two legs extending parallel to one another. The two legs are provided by two mutually opposing inside walls of the U-shaped depression. The two mutually opposing inside walls of the U-shaped depression can be planar or arched. According to embodiments, the U-shaped depression includes a base, which can be provided in the form of a connecting surface between the two mutually opposing inside walls. The connecting surface can be planar or arched.

According to alternative embodiments, the first, second, third and/or fourth depressions are steps. A step includes a first step surface, which has a longitudinal extension direction along the longitudinal extension direction of the depression. According to embodiments, the first step surface extends parallel to the extension plane of the double sheet metal element. According to embodiments, the first step surface includes an angle of greater than or equal to 0° and smaller than 900 with the extension plane of the double sheet metal element. A step furthermore includes a second step surface, which connects the first step surface to the extension plane of the double sheet metal element and has a longitudinal extension direction along the longitudinal extension direction of the depression. According to further embodiments, the second step surface includes an angle of greater than 0° and smaller than or equal to 1800 with the extension plane of the double sheet metal element. According to embodiments, the first step surface extends parallel to the extension plane of the double sheet metal element, while the second step surface extends perpendicularly to the first step surface and the extension plane of the double sheet metal element.

According to embodiments, the method furthermore comprises positioning and fixing the double sheet metal element in a processing position. The positioning of the double sheet metal element in the processing position takes place by introducing the first depression by means of a device that engages with the double sheet metal element. The fixation of the double sheet metal element in the processing position takes place using a clamping device, wherein the double sheet metal element, when the double sheet metal element is clamped by means of the clamping device, is held in the processing position by the device having engaged with the double sheet metal element.

Embodiments can have the advantage that the length of the double sheet metal element parallel to the extension plane is shortened by the introduction of the first depression. In this way, the double sheet metal element as well as sheet metal sections that adjoin the sheet metal end sections are pulled to the device engaging with the double sheet metal element, which introduces the first depression. The double sheet metal element is thus positioned for further processing in a processing position. To be able to pull the double sheet metal element and/or the adjoining sheet metal sections to the engaging device, such as a punch and/or a die, the freedom of movement thereof, in particular in the direction of the corresponding device, is initially not restricted. The clamping device, which fixes the position of the double sheet metal element during further processing, only clamps the double sheet metal element after the device for introducing the first depression has engaged with the double sheet metal element. The clamping device comprises, for example, two clamping elements, which each include a clamping surface. The two clamping surfaces face one another, for example, and are arranged on top of one another. Furthermore, the two clamping surfaces extend parallel to the extension plane of the double sheet metal element. One of the clamping surfaces forms part of a bearing surface, for example, on which the double sheet metal element rests for processing. A position of the double sheet metal element can be fixed in that at least one of the clamping elements moves toward the other, and the distance between the two clamping surfaces decreases. According to alternative embodiments, the clamping device only comprises one independent clamping element, while the second clamping element is provided by a die, which is additionally used to introduce one or more depressions into the double sheet metal element.

A respective curved sheet metal section, for example a half shell section, adjoins the two sheet metal end sections, for example. The two curved sheet metal end sections include an angle, for example, which increases with increasing distance from the two sheet metal end sections until it has reached a maximum value. The corresponding angle can be formed, for example, by the tangents to the curved sheet metal sections.

According to embodiments, the clamping device is arranged between the device for introducing the first depression and the curved sheet metal sections when the double sheet metal element and/or the curved sheet metal sections are located in a starting position. If the first depression is introduced without the double sheet metal element being fixed by the clamping device, the curved sheet metal sections, for example half shell sections, are pulled to the device for introducing the first depression, and a fixation by the clamping device only occurs in this processing position. According to embodiments, this results in the curved sections being automatically positioned flush on the clamping device or at least partially between the two clamping surfaces. Clamping by means of the clamping device causes sheet metal sections arranged between the clamping surfaces to be pressed flat against one another. If curved sheet metal sections, such as curved sheet metal sections having a small curvature, that is, a small included angle, are arranged between the clamping surfaces, this angle is closed, and the remaining curved sheet metal sections adjoining the closed region have a larger remaining angle than the closed angle.

Embodiments can have the advantage that, during clamping, the curved sheet metal sections cannot be pushed out of the region between the two clamping surfaces due to the curvatures and the resulting horizontal force components. Rather, this is suppressed by the device having engaged with the double sheet metal element. By suppressing the curved sheet metal sections from being pushed laterally out of the region between the clamping surfaces, damage to structures that enclose the sheet metal sections can be prevented. Corresponding structures may, for example, be insulating material and/or elements of a vehicle catalytic converter.

Embodiments can have the advantage that the resulting distance between the perpendicularly oriented connecting section and the remaining curved sheet metal sections can be reduced to a width of the clamping surfaces.

Curved sheet metal sections that adjoin the sheet metal end sections are created, for example, by deep drawing a planar metal sheet, using a positive mold. So as to prevent damage as a result of the deep drawing process, the curved sheet metal sections at the beginning, that is, directly adjoining the sheet metal end sections, initially have a small curvature, for example. The small curvature results in a small distance between curved sheet metal sections when these are arranged on top of one another in such a way that the curvatures are oriented in opposite directions and enclose a hollow space. For example, two half shell elements are positioned on top of one another so as to enclose a hollow space for receiving additional structures. The sheet metal sections having a small curvature represent lost space, since no additional structures can be arranged between these due to the small distance, such as insulating material and/or catalytic converter elements. Rather, the sheet metal sections having a small curvature can have the disadvantage of unnecessarily increasing the overall size or the diameter of the double sheet metal element parallel to the extension plane. By pulling the sheet metal sections having a small curvature between the clamping surfaces of the clamping device and clamping the corresponding sheet metal sections together, it can be achieved that these establish the distance between the perpendicularly oriented connecting section and the remaining curved sheet metal sections, which corresponds to the width of the clamping surfaces. Otherwise, the distance would include the corresponding sheet metal sections having a small curvature, in addition to the width of the clamping surfaces, and could end up being considerably larger, for example twice as large.

According to embodiments, the method furthermore comprises introducing a corrugated structure having a plurality of additional depressions into the connecting section, wherein the additional depressions, when the connecting section is oriented perpendicularly, extend perpendicularly to the extension plane.

Embodiments can have the advantage that the corrugated structure increases the holding force of the connection between the two sheet metal end sections. By introducing the corrugated structure, it is thus possible to reduce the likelihood for the connection between the two sheet metal end sections which is implemented by the connecting section to detach under load. Rather, as a result of the corrugated structure, the stability of the connecting section can be increased. According to embodiments, a corresponding corrugated structure can be introduced both into a connecting section that extends along a straight connecting line, and thus a straight first bending axis, and into a connecting section that extends along a curved connecting line, and thus a curved first bending axis.

According to embodiments, the additional depressions each have a depth that increases with increasing distance from the extension plane. Embodiments can have the advantage that an arc length of the connecting section, which increases with the distance from the bending axis, can be effectively compensated for by a corresponding variation of the depth of the additional depressions in the case of a curved connecting line or a curved first bending axis. This applies in particular in the case of a convex curvature. Using a corrugated structure having an accordingly varying depth, it is possible to accommodate oversized lengths of the connecting section in a compact manner during the perpendicular orientation.

According to embodiments, the method furthermore comprises introducing a plurality of recesses into the double sheet metal element along the first bending axis, wherein each of the recesses extends from the first bending axis to the edge of the double sheet metal element. Embodiments can have the advantage that an arc length of the double sheet metal element, which varies with the distance from the bending axis, can be compensated for by the recesses in the case of a curved connecting line or a curved first bending axis. In the case of a convex curvature, the recesses are used to remove material that would be excess material as a result of the perpendicular orientation of the portion of the double sheet metal element which is folded to yield the connecting section, and of the accompanying decrease in the arc length. In the case of a concave curvature, the recesses, by diverging, are used to compensate for an arc length increasing as a result of the perpendicular orientation of the portion of the double sheet metal element which is folded to yield the connecting section.

According to embodiments, each of the recesses has a width that increases with increasing distance from the first bending axis. In the case of a convex curvature, the perpendicular orientation of the connecting section results in a decrease in the arc length of the connecting section to yield a uniform size. Embodiments can have the advantage that, as a result of the width varying with the distance, it is possible to effectively take into account the arc length of the double sheet metal element or of the connecting section varying with the distance prior to the perpendicular orientation. For example, each of the recesses has a V shape.

In the case of a concave curvature, each of the recesses, for example, has a width that does not change with increasing distance from the first bending axis, but rather remains constant. According to embodiments, the recesses are linear notches.

According to embodiments, the two sheet metal end sections are different end sections of one sheet, that is, one sheet is bent in such a way that two end sections of the same sheet are arranged on top of one another. Embodiments can have the advantage that two sheet metal end sections can be efficiently connected to one another. For example, the shared sheet is rolled in, thereby forming a cylinder and the two end sections of the sheet being arranged on top of one another.

According to embodiments, the two sheet metal end sections are end sections of two different sheets. Embodiments can have the advantage that they allow two different sheets, which, for example, form two half shell elements, to be connected to one another along the two sheet metal end sections.

According to embodiments, movable device elements of a device for connecting by means of forming, which are involved in the course of the method for connecting the two sheet metal end sections arranged on top of one another by means of forming, are exclusively displaced perpendicularly to the extension plane of the double sheet metal element. In this way, no displacement parallel to the extension plane of the double sheet metal element takes place.

Embodiments encompass a device for connecting two sheet metal end sections arranged on top of one another by means of forming according to any one of the preceding claims. According to embodiments, the device is configured to carry out one or more of the above-described embodiments of the method for connecting two sheet metal end sections that are arranged on top of one another.

According to embodiments, the device comprises a plurality of roller pairs, which carry out the individual steps of the method. According to embodiments, the roller pairs are arranged in a row behind one another, wherein the double sheet metal element is displaced along the row of roller pairs and consecutively passes through the individual roller pairs along the connecting line. For example, the roller pairs can be arranged in a stationary manner behind one another, and the double sheet metal element is displaced. Embodiments can, for example, be advantageous when the connection is to be implemented along a straight connecting line. According to embodiments, the device is configured to displace the roller pairs in a path-controlled manner along an edge of the double sheet metal element. For example, the roller pairs are displaced, while the double sheet metal element is arranged in a stationary manner. Embodiments can, for example, be advantageous when the connection is to be implemented along a bent connecting line. According to further embodiments, the roller pairs and the double sheet metal element are both displaced relative to one another.

According to embodiments, multiple of the steps of the method are carried out by the same roller pair. For example, the introduction of the first and second depressions is carried out by the same roller pair. For example, the creation of the first and second folded sections is carried out by the same roller pair. For example, the alignment of the first and second folded sections is carried out by the same roller pair.

According to embodiments, the device comprises a plurality of roller pairs arranged in a row behind one another, which consecutively carry out the individual steps of the method, wherein the double sheet metal element consecutively passes through the roller pairs along the connecting line. According to embodiments, the double sheet metal element is guided along the row of roller pairs and/or the device comprising the row of roller pairs is guided along the double sheet metal element. According to embodiments, roller pairs can comprise a shared roller, so that this shared roller belongs to two different roller pairs, which carry out two different method steps. According to embodiments, the rollers of the roller pairs each have a profile, which is configured to carry out one of the steps of the above-described method.

According to embodiments, the device comprises a punch and a die. The punch comprises one or more punch elements extending in a longitudinal direction for introducing depressions into the double sheet metal element. The die comprises a bearing surface for placing on the double sheet metal element, including a plurality of cavities, which extend parallel to one another along the longitudinal direction of the punch elements and are each configured to introduce at least one of the depressions into the double sheet metal element.

The punch is configured to be displaced in a first direction vertically, that is, from above, by way of one of the punch elements into one of the cavities for introducing the depressions. According to embodiments, the punch is furthermore configured to be displaced in a second direction parallel to the bearing surface, and perpendicularly to the first direction, by way of one of the punch elements against the double sheet metal element, for creating the folded sections and/or for perpendicularly orienting the connecting section. According to embodiments, one or more of the cavities in each case have a V-shaped cross-section for introducing V-shaped depressions into the double sheet metal element. According to embodiments, one or more of the punch elements in each case have a V-shaped cross-section for introducing V-shaped depressions into the double sheet metal element. According to embodiments, one of the legs of the V-shaped cross-section of the punch element is provided by a first stop surface, which is used to create at least one of the folded sections. According to embodiments, the punch comprises a second stop surface, which is used to perpendicularly orient the connecting section.

According to embodiments, at least one of the cavities has a U-shaped cross-section for introducing a U-shaped depression into the double sheet metal element, while at least one of the punch elements likewise has a U-shaped cross-section.

According to embodiments, the punch is furthermore configured to be displaced in a first direction vertically by way of one of the punch elements into one of the cavities for creating the folded sections.

According to embodiments, the die is configured to be displaced in a direction that is opposite the first direction for introducing one of the depressions, for creating one of the folded sections and/or for perpendicularly orienting the connecting section.

According to embodiments, the die comprises a plurality of sub-dies. Together, the sub-dies provide the bearing surface for bearing surface for placing on the double sheet metal element. Each of the sub-dies comprises at least one of the cavities. Furthermore, at least one of the sub-dies is configured to be displaced in the direction that is opposite the first direction for introducing one of the depressions, for creating one of the folded sections and/or for perpendicularly orienting the connecting section.

According to embodiments, the displaceable die and/or sub-die comprises a stop surface, which is used to perpendicularly orient the connecting section.

According to embodiments, the device furthermore comprises a clamping device for fixing the double sheet metal element in a processing position. According to embodiments, an end of the double sheet metal element is immovably fixed by the clamping device.

According to embodiments, the device furthermore comprises an embossing element having a corrugated surface, which is configured to introduce a corrugated structure having a plurality of additional depressions into the connecting section, wherein the additional depressions, in the perpendicularly orientated state of the connecting section, extend perpendicularly to the extension plane.

According to embodiments, the device furthermore comprises a cutting device, which is configured to introduce recesses into the double sheet metal element along the first bending axis, wherein the recesses in each case extend from the first bending axis to the edge of the double sheet metal element.

Here, ordinal numbers such as first, second, third, fourth, and so forth, are solely used to distinguish elements that are different from one another, and shall not be construed to imply a particular sequence, unless a meaning to the contrary follows from the specific context. Embodiments of the method can, for example, introduce a first, second and fourth depression into the double sheet metal element, without necessarily also introducing a third depression.

BRIEF DESCRIPTION OF THE DRAWINGS

Embodiments of the invention will be described in more detail hereafter with reference to the drawings. In the drawings.

DETAILED DESCRIPTION

Figure 1A:
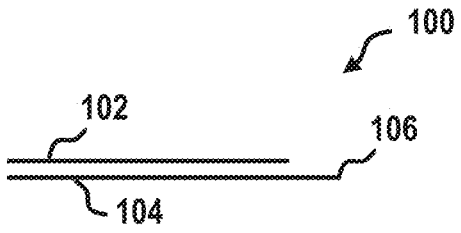
FIG. 1 show schematic diagrams of exemplary embodiments of double sheet metal elements.

Elements of the following embodiments that correspond to each other are denoted by the same reference numerals.

Figure 1B:
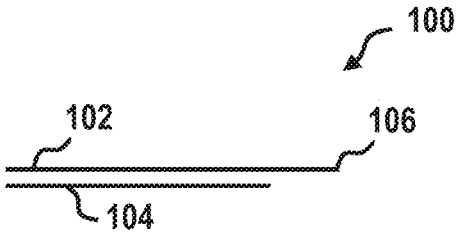
Figure 1C:
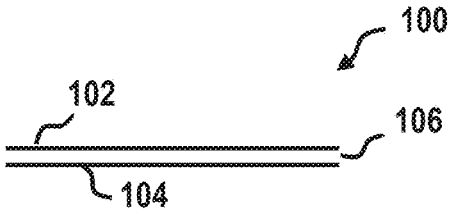

FIGS. 1A to 1C show exemplary double sheet metal elements 100. Each of the double sheet metal elements 100 comprises a first and second sheet metal end section 102, 104 that are arranged on top of one another. In the case of the double sheet metal element 100 shown in FIG. 1A, an edge 106 of the double sheet metal element 100 is provided by the second sheet metal end section 104 or by the edge thereof. In the case of the double sheet metal element 100 shown in FIG. 1B, an edge 106 of the double sheet metal element 100 is provided by the first sheet metal end section 102 or by the edge thereof. FIG. 1C finally shows an embodiment of the double sheet metal element 100 in which the edge 106 of the double sheet metal element 100 is provided by both sheet metal end sections 102, 104 or by the edges thereof.

Figure 2A:
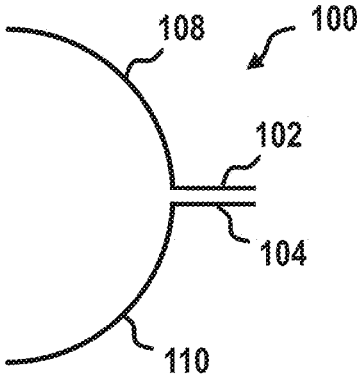
FIG. 2 show schematic diagrams of exemplary embodiments of double sheet metal elements.
Figure 2B:
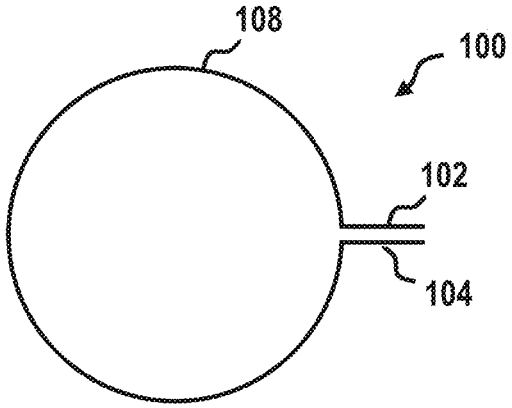

FIGS. 2A and 2B show exemplary double sheet metal elements 100. FIG. 2A shows a double sheet metal element 100 in which the two sheet metal end sections 102, 104 are end sections of two different sheets 108, 110. For example, each of the two sheets 108, 110 is a half shell element, that is, a respective curved sheet metal section adjoins the two sheet metal end sections 102, 104. Arranged on top of one another, the half shell elements create a hollow space for receiving additional structures, such as insulating material and/or catalytic converter elements. FIG. 2B shows a double sheet metal element 100 in which the two sheet metal end sections 102, 104 are different end sections of one sheet 108. The shared sheet 108 is rolled in, for example, so that two opposing sheet metal sections 102, 104 of this sheet 108 end up on top of one another.

Figure 3:
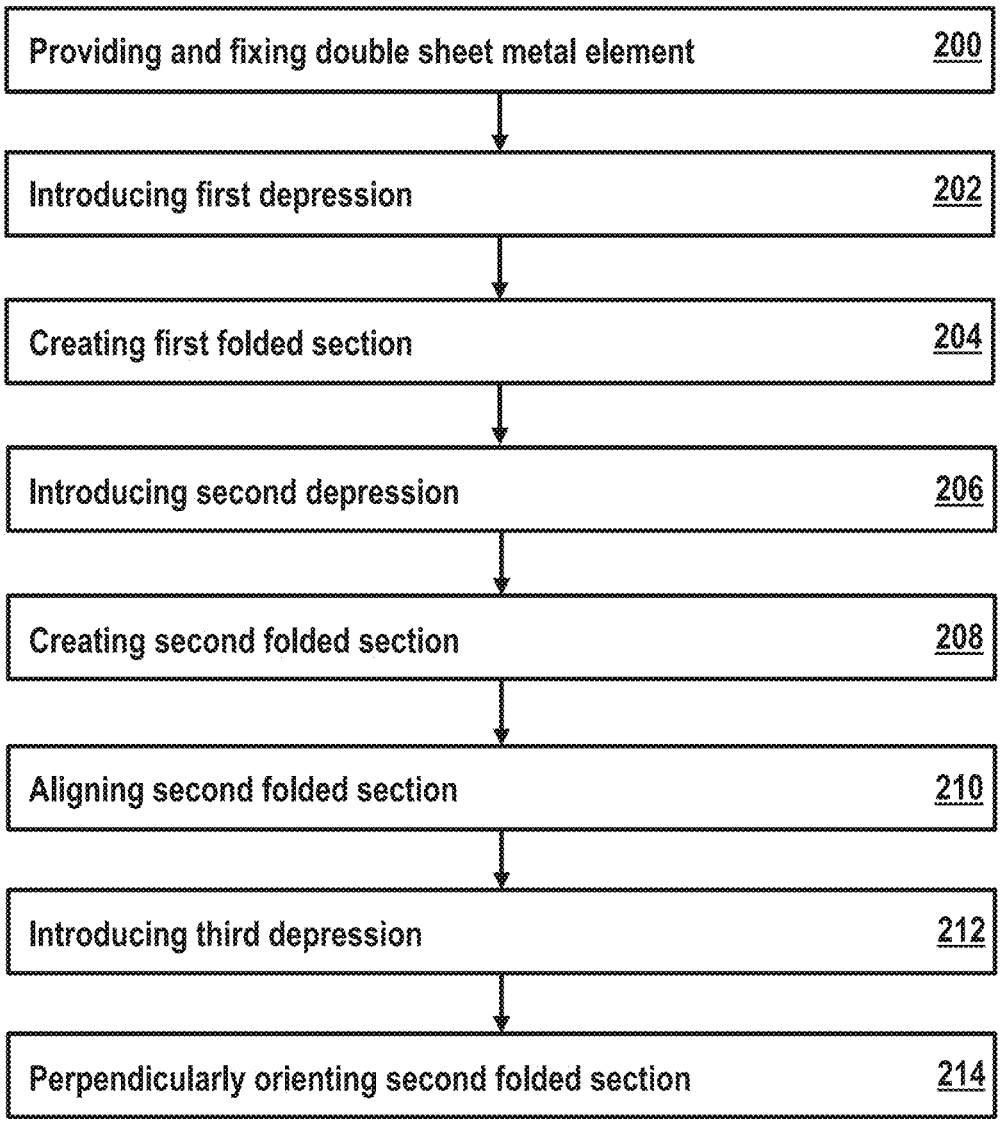
FIG. 3 shows a schematic flow chart of an exemplary embodiment of a first method.

FIG. 3 shows, by way of example, a first method for connecting two sheet metal end sections that are arranged on top of one another by means of forming. In block 200, a double sheet metal element is provided, which is arranged and fixed in a processing position. The double sheet metal element comprises two sheet metal end sections arranged on top of one another and extends in an extension plane. The two sheet metal end sections are to be connected to one another along a connecting line located in the extension plane. In block 202, a first, for example V-shaped, depression is introduced into the double sheet metal element, which extends along the connecting line. In block 204, a first folded section of the double sheet metal element is created along the connecting line. In the process, two mutually opposing inside walls of the first V-shaped depression are pressed against one another. In block 206, a second, for example V-shaped, depression is introduced into the double sheet metal element. In block 208, a second folded section of the double sheet metal element or connecting section is created along the connecting line, which includes the first folded section. In the process, two mutually opposing inside walls of the second V-shaped depression are pressed against one another. In block 210, the second folded section of the double sheet metal element is aligned. In the process, the second folded section is bent about a bending axis provided by an edge of the second V-shaped depression, so that the second folded section extends parallel to the extension plane of the double sheet metal element.

In block 212, a, for example V-shaped, depression extending along the connecting line is introduced into the double sheet metal element. According to embodiments, the third V-shaped depression is introduced into the same surface of the double sheet metal element, similarly to the first and second V-shaped depressions. In block 214, the second folded section is perpendicularly oriented relative to the extension plane of the double sheet metal element. According to embodiments, the perpendicular orientation comprises bending over a portion of the double sheet metal element which includes the second folded section along a bending axis that extends parallel to the connecting line, so that the second folded section extends perpendicularly to the extension plane. According to embodiments, an edge of the third V-shaped depression provides the bending axis, about which the portion of the double sheet metal element including the second folded section is bent.

Figure 4A:
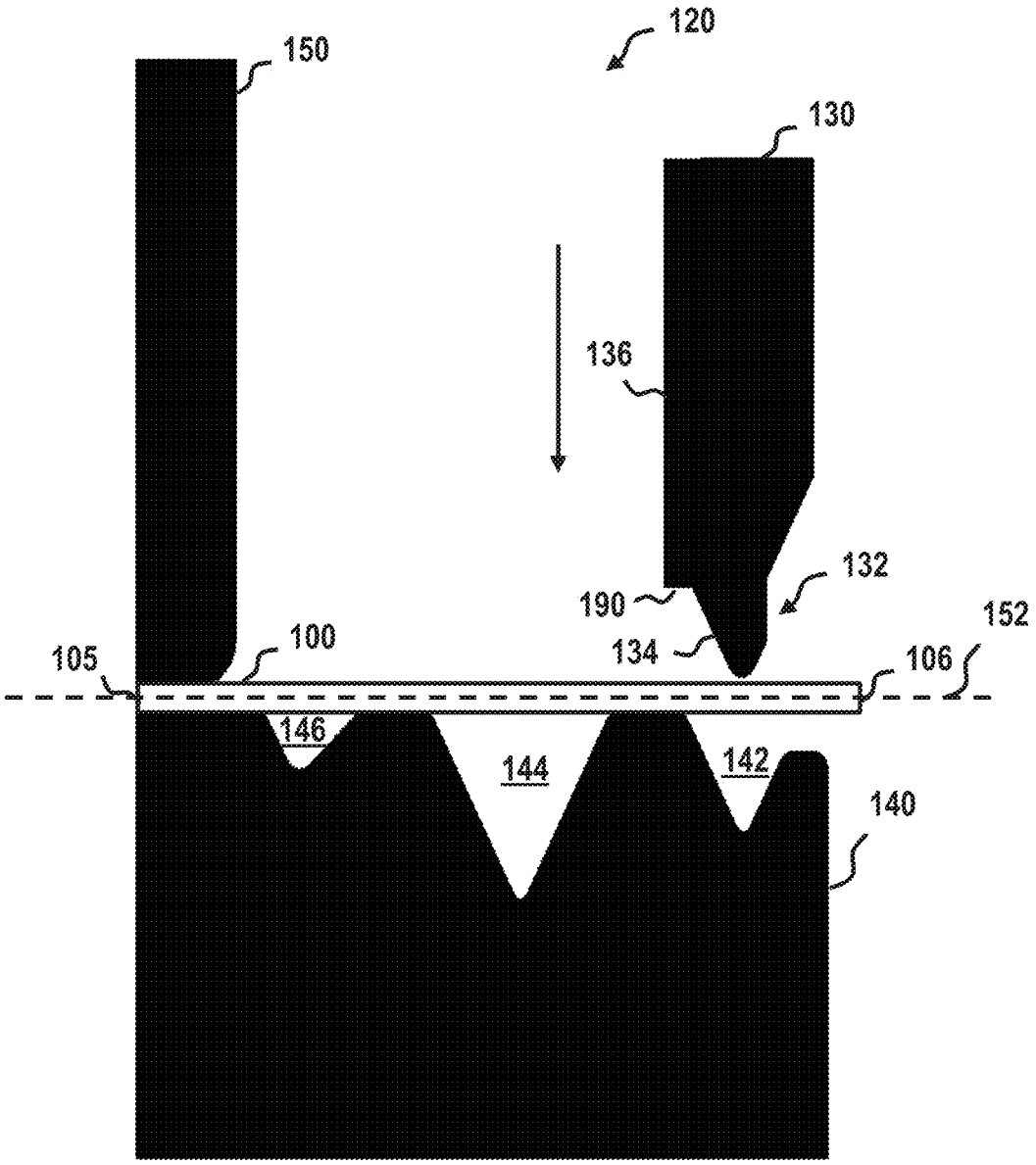
FIG. 4 show schematic diagrams of an exemplary embodiment of a device for carrying out the first method from FIG. 3.

FIGS. 4A to 4K show an exemplary device 120 for carrying out the first method from FIG. 3. FIG. 4A shows a punch 130 comprising a punch element 132. The punch element 132 has a, for example, V-shaped cross-section, wherein one leg of the V-shaped cross-section is provided by a first stop surface 134. The punch 130 furthermore comprises a second stop surface 136. In addition to the punch 130, the device 120 comprises a die 140, which provides a bearing surface for placing on the double sheet metal element 100. Three, for example V-shaped, cavities 142, 144, 146, which are arranged parallel to one another, are introduced into the bearing surface of the die 140. Finally, the device 120 also comprises a clamping device 150 for fixing an end 105 of the double sheet metal element 100 on the bearing surface of the die 140, while the opposite end 106 of the double sheet metal element 100 is a free, non-fixed end. In the course of the provision, the double sheet metal element 100 is positioned in a processing position on the bearing surface, and is fixed using the clamping device 150. In the shown embodiment, the die 140 represents the counter bearing for clamping the double sheet metal element 100. In alternative embodiments, the clamping device can comprise an additional clamping element as the counter bearing, in addition to the clamping element 150. So as to connect the two sheet metal end sections encompassed by the double sheet metal element 100 by means of forming, either the punch 130 can be displaced relative to the die 140 and/or the die 140 can be displaced, together with the clamping device 150, relative to the punch 130.

Figure 4B:
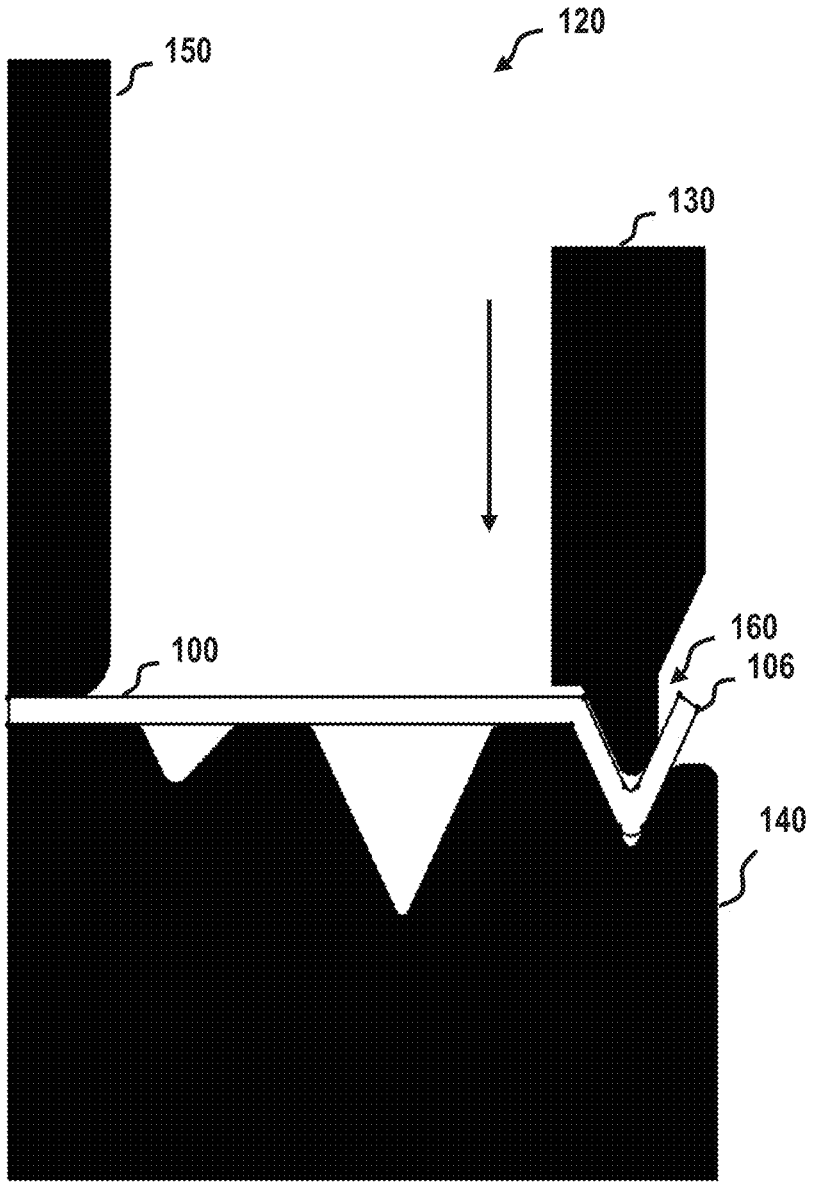
Figure 4C:
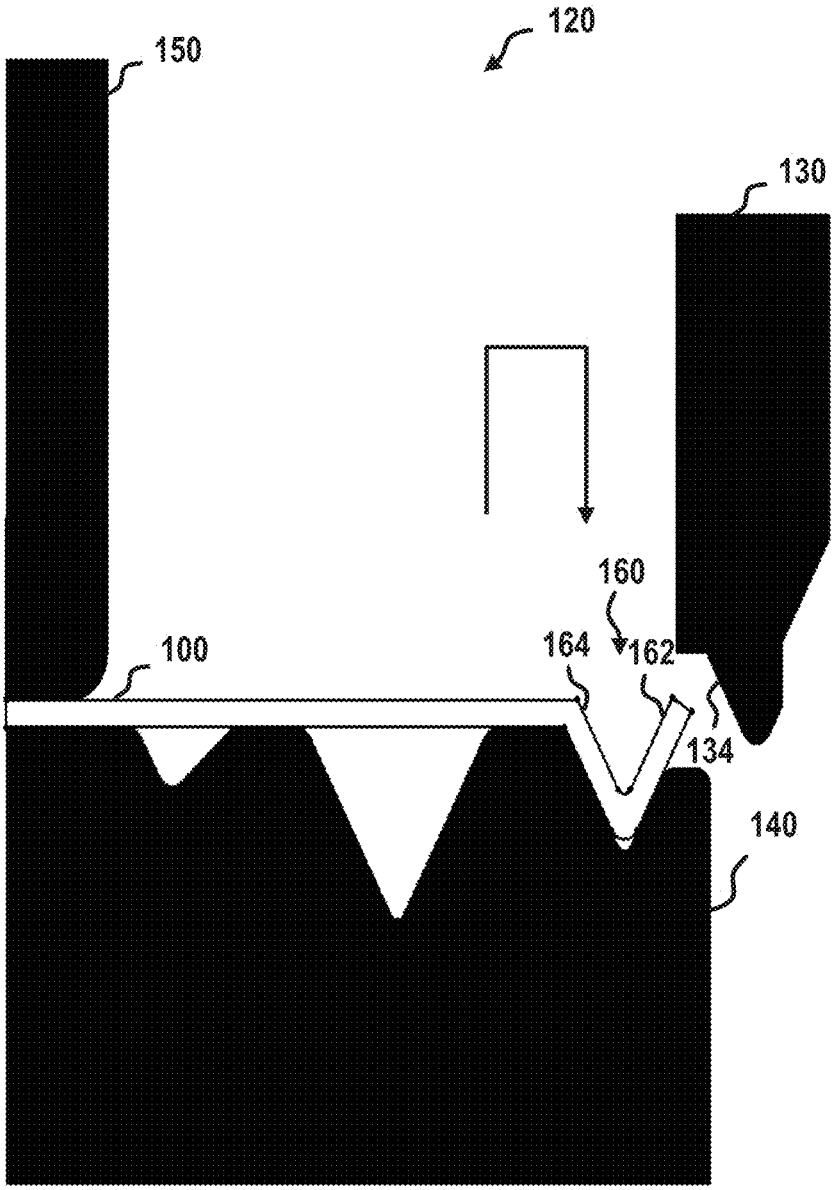
Figure 4D:
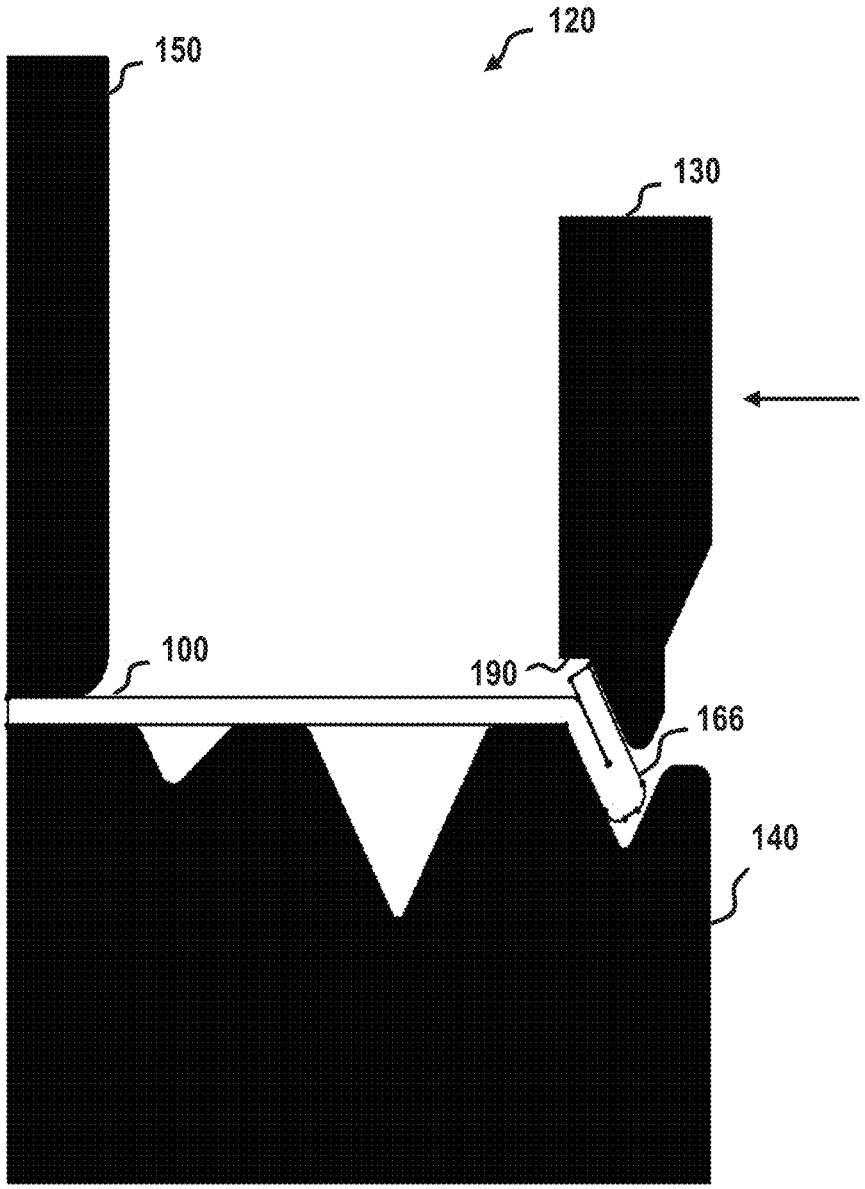

In FIG. 4B, the punch 130 was displaced vertically from above with the punch element 132 into the first V-shaped cavity 142, whereby a first, for example V-shaped, depression 160 is introduced into the double sheet metal element 100. In the process, an edge of the first V-shaped depression 160 is formed by the edge 106 of the double sheet metal element 100. In the shown embodiment, the double sheet metal element 100 was first fixed in the processing position, using the clamping device 150, before the first V-shaped depression 160 is introduced. According to embodiments, the punch 130 includes a third stop surface 190, which extends parallel to an extension plane 152 of the double sheet metal element 100, between the first stop surface 134 and the second stop surface 136. The punch 130 is displaced out of the first V-shaped cavity 142 and, as shown in FIG. 4C, is positioned next to the double sheet metal element 100. Thereafter, the punch 130 is displaced parallel to the bearing surface of the die 140 against the double sheet metal element 100, so that the punch 130, with the stop surface 134 of the punch element 132, presses the first V-shaped depression 160 together, as shown in FIG. 4D. In the process, two mutually opposing inside walls 162, 164 of the first V-shaped depression 160 are pressed against one another, and a first folded section 166 of the double sheet metal element 100 is created. The first folded section 166 is a section that is folded once. The third stop surface 190 prevents one or both of the sheet metal end sections, which at this stage are not yet connected to one another, from being pressed out of the cavity 142 when the two mutually opposing inside walls 162, 164 of the first V-shaped depression 160 are pressed against one another. In particular, it is possible for the third stop surface 190 to prevent the sheet metal end section, of the sheet metal end sections that are not yet connected to one another, which is located on top from being pressed out of the cavity 142, while the bottom sheet metal end section of the two sheet metal end sections that are not yet connected to one another remains in the cavity 142 and is pressed together by the punch 130.

Figure 4E:
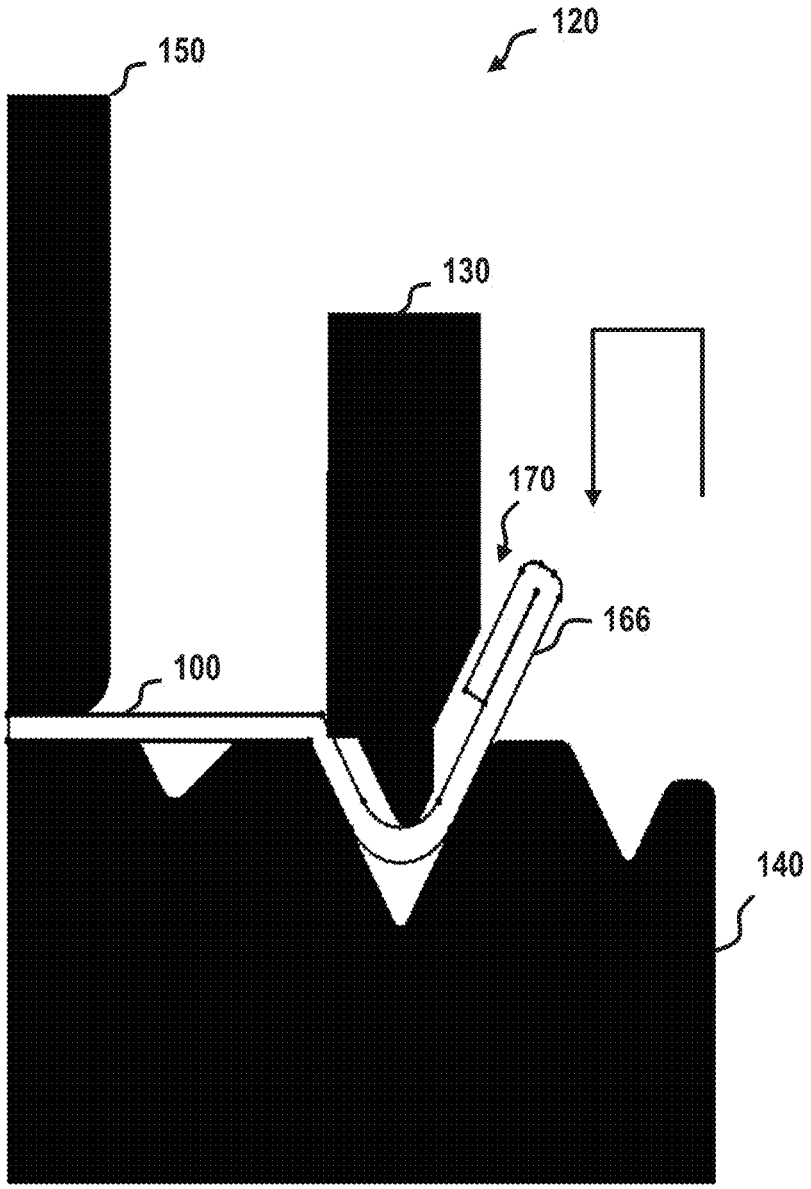
Figure 4F:
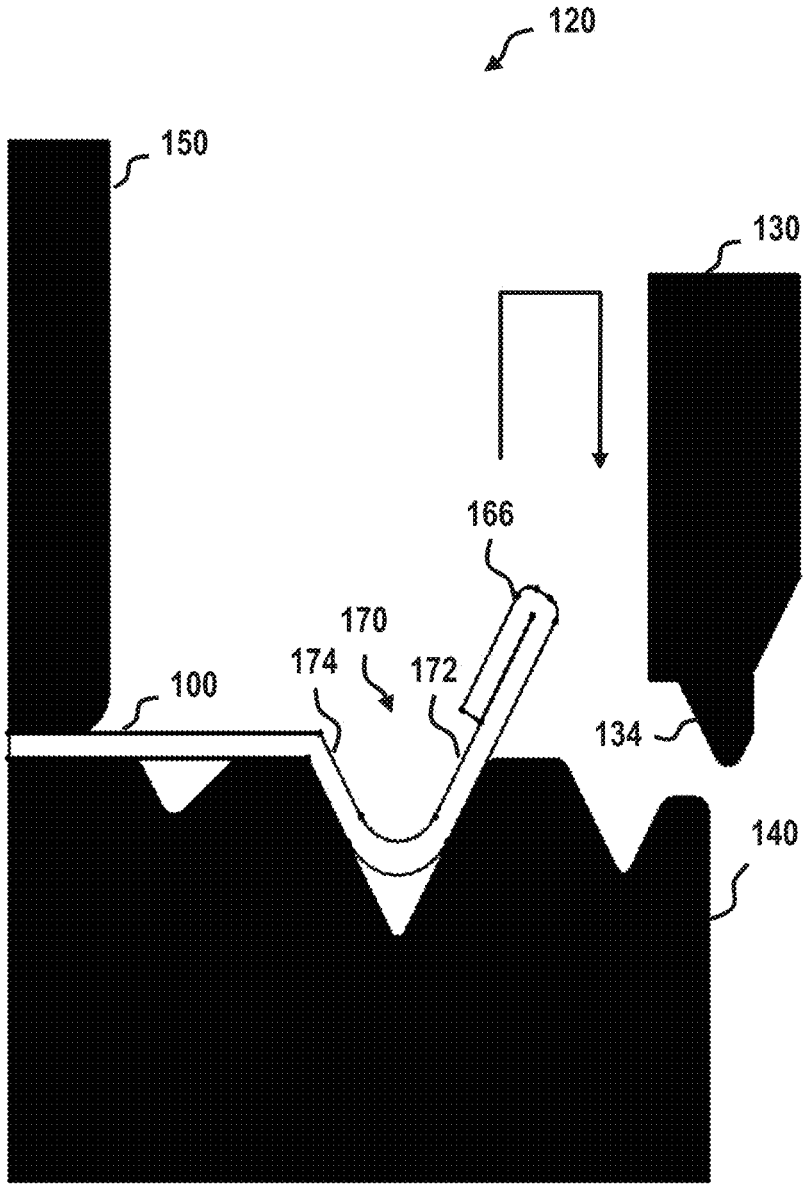
Figure 4G:
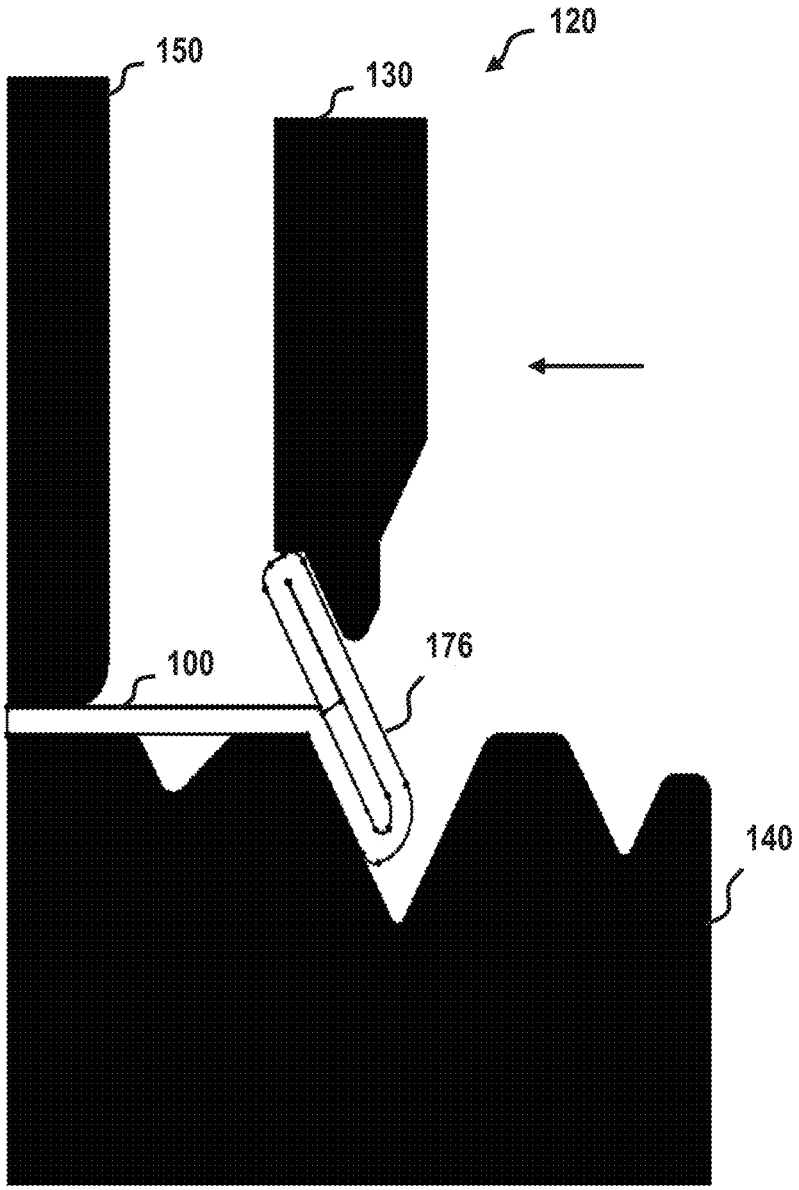
Figure 4H:
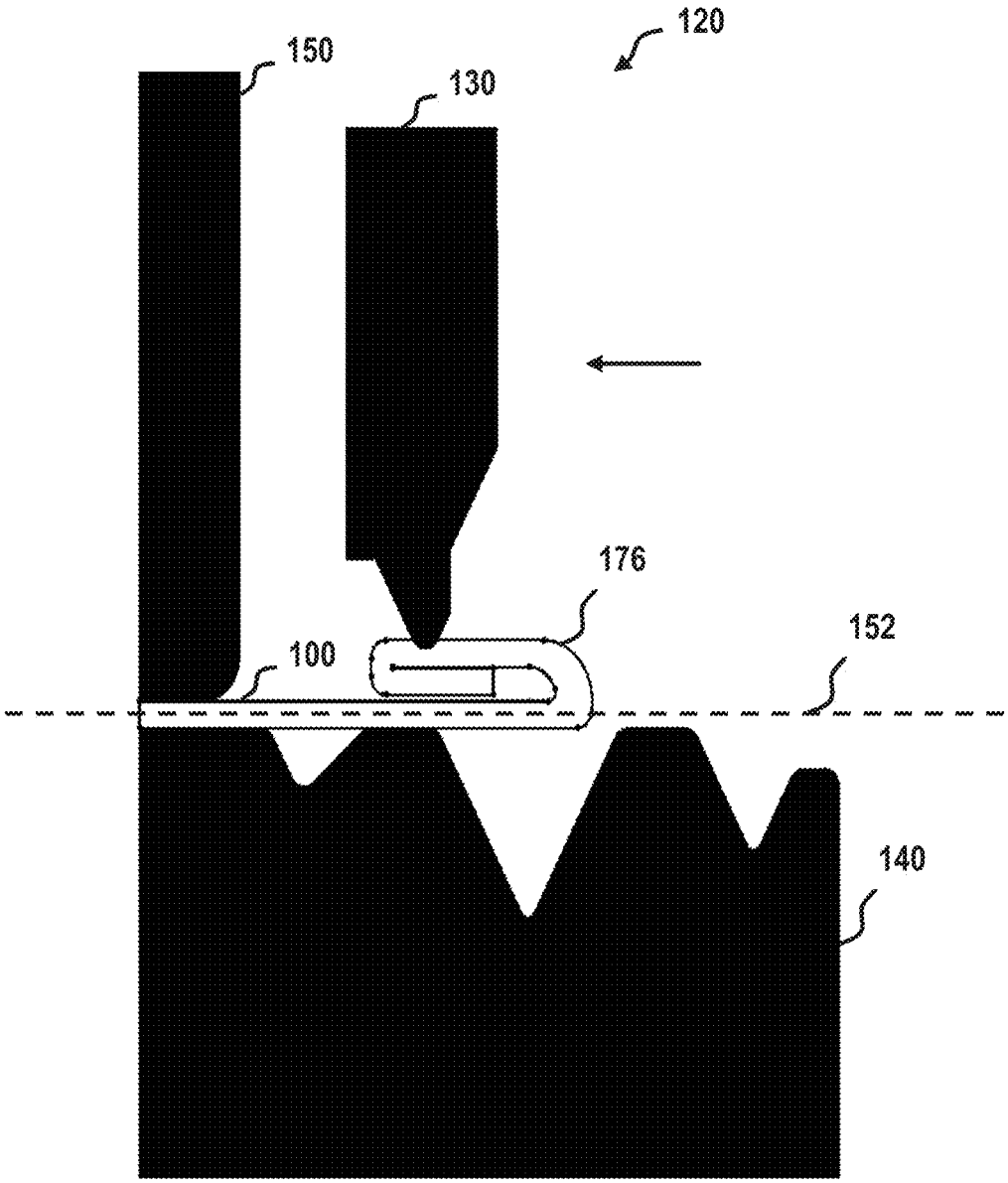

In FIG. 4E, the punch 130 was displaced vertically from above with the punch element 132 into the second V-shaped cavity 144, whereby a second, for example V-shaped, depression 170 is introduced into the double sheet metal element 100. In the process, an inside wall 172 of the second V-shaped depression 170 is provided by the first folded section 166 and comprises the edge 106 of the double sheet metal element 100. The punch 130 is displaced out of the second V-shaped cavity 144 and, as shown in FIG. 4F, is positioned next to the double sheet metal element 100. Thereafter, the punch 130 is displaced parallel to the bearing surface of the die 140 against the double sheet metal element 100, so that the punch 130, with the stop surface 134 of the punch element 132, presses the second V-shaped depression 170 together, as shown in FIG. 4G. In the process, two mutually opposing inside walls 172, 174 of the second V-shaped depression 170 are pressed against one another, and a connecting section in the form of a second folded section 176 of the double sheet metal element 100 is created, which comprises the first folded section 166. In other words, the second folded section 176, and thus the connecting section, is a section that is folded twice. In FIG. 4H, the second folded section 176 of the double sheet metal element 100 was aligned by the punch element 132 having exerted pressure on the second folded section 176. The alignment of the second folded section 176 comprises bending the second folded section 176 about a bending axis provided by an edge of the second V-shaped depression 170, so that the second folded section 176 extends parallel to the extension plane 152 of the double sheet metal element 100.

Figure 4I:
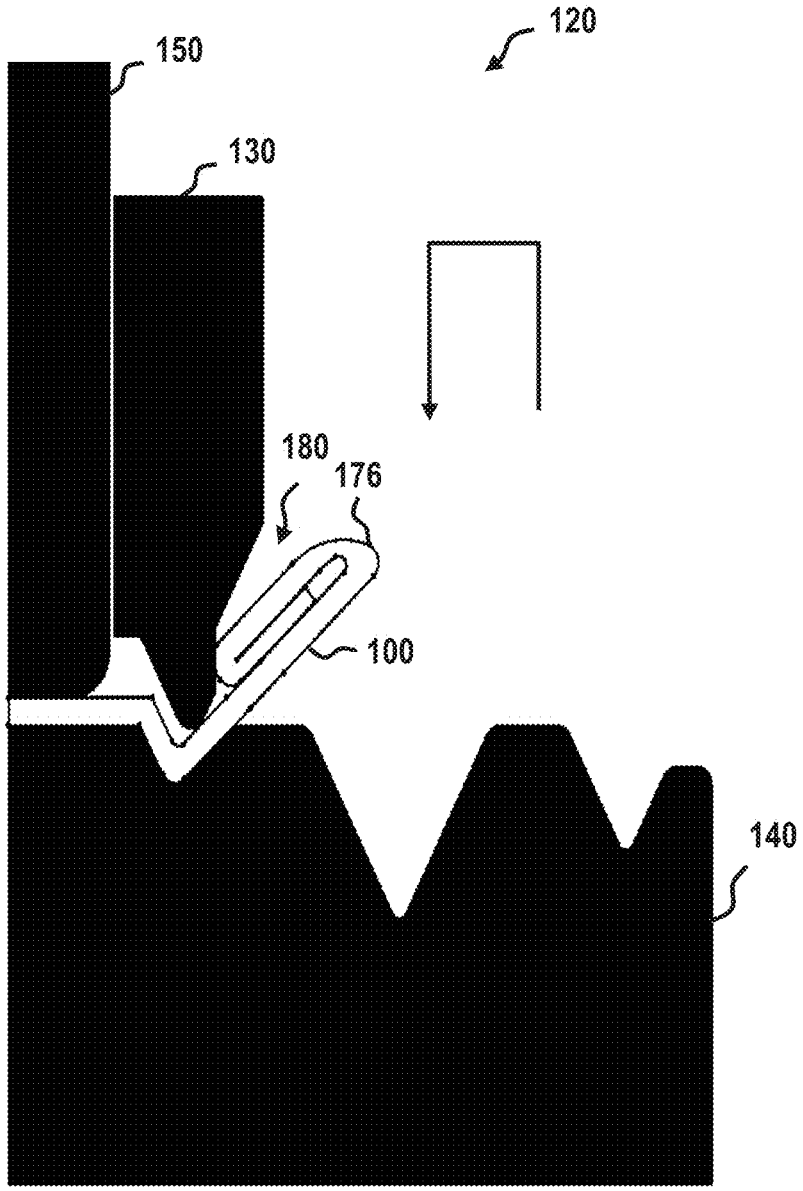
Figure 4J:
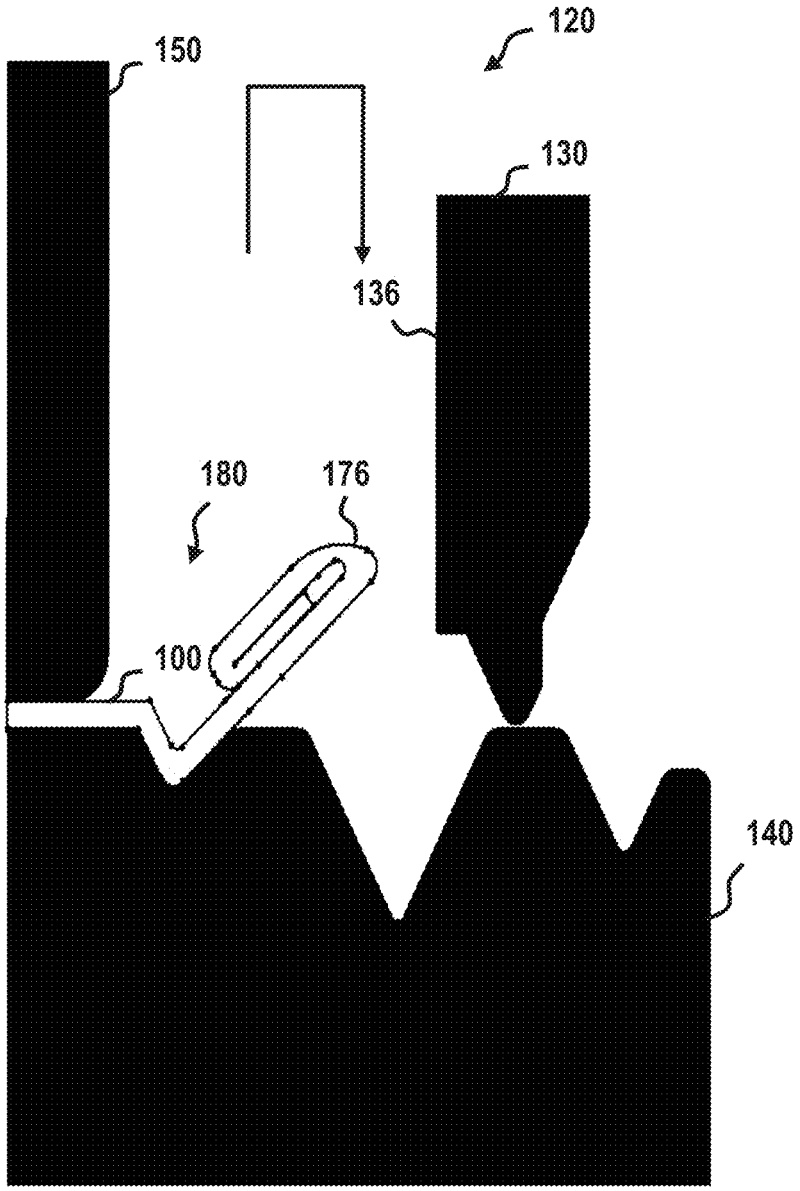
Figure 4K:
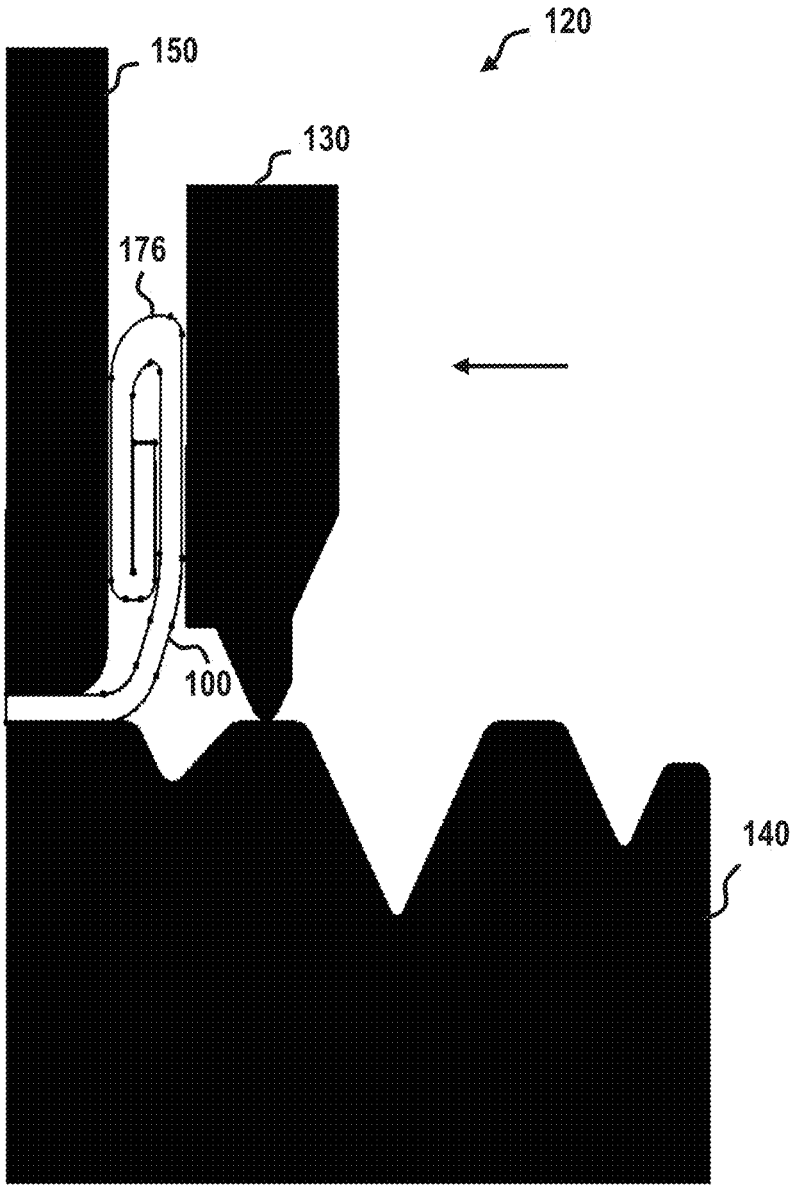

In FIG. 4I, the punch 130 was displaced vertically from above with the punch element 132 into the third V-shaped cavity 146, whereby a third, for example V-shaped, depression 180 is introduced into the double sheet metal element 100. In the process, an inside wall 182 of the third V-shaped depression 180 is provided by the second folded section 176 of the double sheet metal element 100. The punch 130 is displaced out of the third V-shaped cavity 146 and, as shown in FIG. 4J, is positioned next to the double sheet metal element 100. Thereafter, the punch 130 is displaced parallel to the bearing surface of the die 140 against the double sheet metal element 100, so that the second folded section 176 is perpendicularly oriented relative to the extension plane 152 of the double sheet metal element 100 in that the second stop surface 136 of the punch 130 presses against the second folded section 176 of the double sheet metal element 100. In the process, a portion of the double sheet metal element 100 comprising the connecting section including the second folded section 176 is bent along a bending axis provided by an edge of the third V-shaped depression 180, so that the second folded section 176, in the end position thereof shown in FIG. 4K, extends perpendicularly to the extension plane 152 of the double sheet metal element 100.

According to alternative embodiments, the connecting section may also exclusively consist of the first folded section 166, that is, the connecting section is a section that is folded once. In this case, the steps according to FIGS. 4G to 4J can be dispensed with. Following the step shown in FIG. 4F, the punch 130 is displaced parallel to the bearing surface of the die 140 against the double sheet metal element 100, so that the first folded section 166 is perpendicularly oriented relative to the extension plane 152 of the double sheet metal element 100 in that the second stop surface 136 of the punch 130 presses against the first folded section 166 of the double sheet metal element 100. In the process, a portion of the double sheet metal element 100 comprising the connecting section including the first folded section 166 is bent along a bending axis provided by an edge of the second V-shaped depression 170, so that the first folded section 166, in an end position analogous to the end position of the second folded section 176 shown in FIG. 4K, extends perpendicularly to the extension plane 152 of the double sheet metal element 100. The method according to FIG. 6 in this case comprises the steps 300 to 304 and 310, wherein the first folded section is perpendicularly oriented in step 310.

Figure 5A:
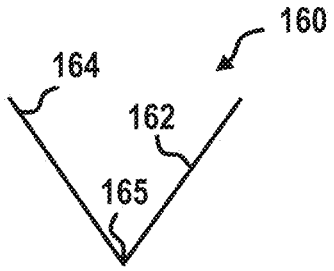
FIG. 5 show schematic diagrams of exemplary embodiments of V-shaped depressions.
Figure 5B:
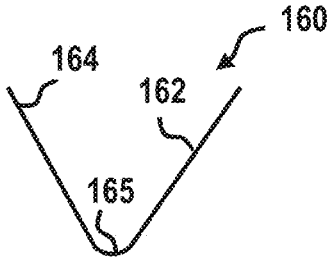
Figure 5C:
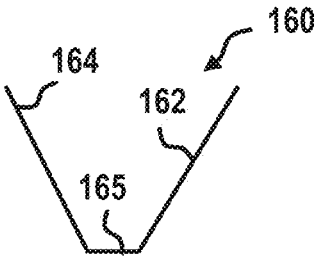
Figure 5D:
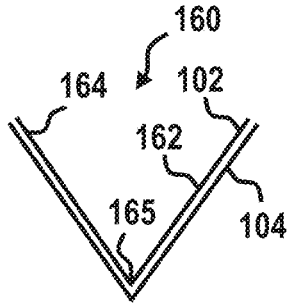

FIGS. 5A to 5C show exemplary V-shaped depressions 160, which each include two mutually opposing inside walls 162, 164 as well as a base 165. In the case of the V-shaped depression 160 shown in FIG. 5A, the base 165 is formed by a contact line at which the two mutually opposing inside walls 162, 164 meet one another. FIG. 5B shows a V-shaped depression 160 having a base 165 in the form of an arched surface, and FIG. 5C shows a V-shaped depression 160 having a base 165 in the form of a planar surface. According to embodiments, the planar surface forming the base 165 may also be inclined relative to the alignment of the planar surface shown in FIG. 5C.

FIGS. 5D to 5G show, by way of example, different relative contributions of the two sheet metal end sections 102, 104, which form the double sheet metal element 100, based on the V-shaped depression 160 of FIG. 5A. The arrangement shown in FIG. 5D results from the embodiment according to FIG. 1C in which the edge 106 of the double sheet metal element 100 is provided by both sheet metal end sections 102, 104 or by the edges thereof. In other words, the two sheet metal end sections 102, 104 in FIG. 1C extend equally far along the shared extension plane. In the process, the two mutually opposing inside walls 162, 164 of the depression 160 are both provided by the first sheet metal end section 102.

Figure 5E:
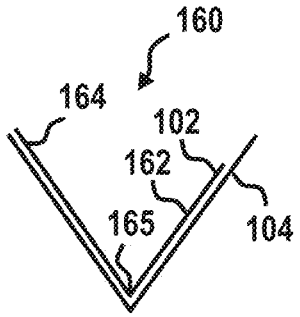
Figure 5F:
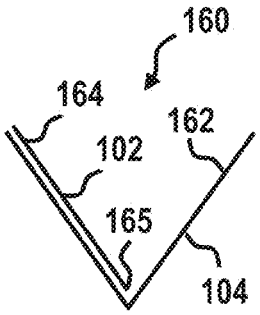
Figure 19A:
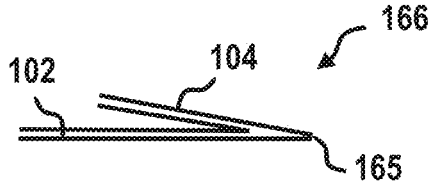
FIG. 19 show schematic diagrams of exemplary first folded sections.
Figure 19B:
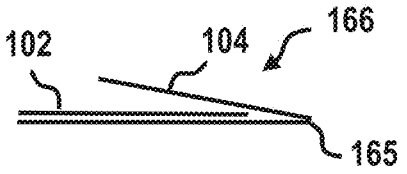

In the case of the arrangement shown in FIG. 5E, the first sheet metal end section 102 is shorter than the second sheet metal end section 104. The shown arrangement results from the embodiment according to FIG. 1A in which the edge 106 of the double sheet metal element 100 is provided by the second sheet metal end section 104 or by the edge thereof. In other words, the second sheet metal end section 104 in FIG. 1A extends further along the shared extension plane than the first sheet metal end section 102, and protrudes beyond the same. The first inside wall 162 of the two mutually opposing inside walls 162, 164 of the depression 160 is provided by the first sheet metal end section 102, while a first segment of the second inside wall 162 is provided by the first sheet metal end section 102, and a second segment of the second inside wall 162 is provided by the second sheet metal end section 104. More precisely, the second segment of the second inside wall 162 is formed by the portion of the second sheet metal end section 104 which protrudes beyond the first sheet metal end section 102. FIG. 5F shows an embodiment in which the second sheet metal end section 104 protrudes beyond the first sheet metal end section 102 so far that the sheet metal end section 102, during the introduction of the V-shaped depression 160, does not extend beyond the base 165 thereof. In this case, the first inside wall 162 of the two mutually opposing inside walls 162, 164 of the depression 160 is provided by the first sheet metal end section 102, while the second inside wall 162 is provided by the second sheet metal end section 104. When the V-shaped depression 160 is pressed together in the course of the completion of the first folded section, the edge of the first sheet metal end section 102 is enveloped by the second sheet metal end section 104 so as not to be exposed (refer to FIG. 19B).

Figure 5G:
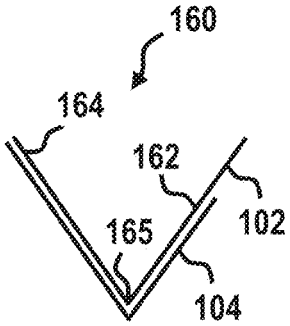

In the case of the arrangement shown in FIG. 5G, the first sheet metal end section 102 is longer than the second sheet metal end section 104. The shown arrangement results from the embodiment according to FIG. 1B in which the edge 106 of the double sheet metal element 100 is provided by the first sheet metal end section 102 or by the edge thereof. In other words, the first sheet metal end section 102 in FIG. 1B extends further along the shared extension plane than the second sheet metal end section 104, and protrudes beyond the same. In the process, the two mutually opposing inside walls 162, 164 of the depression 160 are both provided by the first sheet metal end section 102. However, during the introduction of the V-shaped depression 160, the second sheet metal end section 104 extends beyond the base 165, so that it can be ensured, when the V-shaped depression 160 is pressed together in the course of the completion of the first folded section, that the edge of the second sheet metal section 104 is folded over. After the first folded section has been oriented perpendicularly to the (original) extension plane of the two sheet metal end sections 102, 104, the edge of the second sheet metal end section 104 is not exposed. In the case of a connecting section that comprises a second folded section, that is, is folded twice, embodiments are possible in which the second sheet metal end section 104, during the introduction of the V-shaped depression 160, does not extend beyond the base 165 thereof. In this case, it is ensured in the course of a completion of the second folded section that the edge of the second sheet metal end section 104 is folded over, and is no longer exposed.

Based on the embodiments shown in FIGS. 5D to 5G, it is apparent that differently far extensions of the two sheet metal end sections 102, 104 are possible, in which the two sheet metal end sections 102, 104 each extend differently far along the resulting V-shaped depression 160 or contribute to the creation thereof to different degrees. All embodiments have in common that they ensure that the edges of both sheet metal end sections 102, 104 are folded over, or the edge of the first sheet metal end section 102 is enveloped by the folded-over second sheet metal end section 104, when the V-shaped depression 160 is pressed together in the course of a completion of the first folded section. After the first, or possibly second, folded section has been oriented perpendicularly to the (original) extension plane of the two sheet metal end sections 102, 104, neither of the two edges of the sheet metal end sections 102, 104 is exposed any longer.

Figure 6:
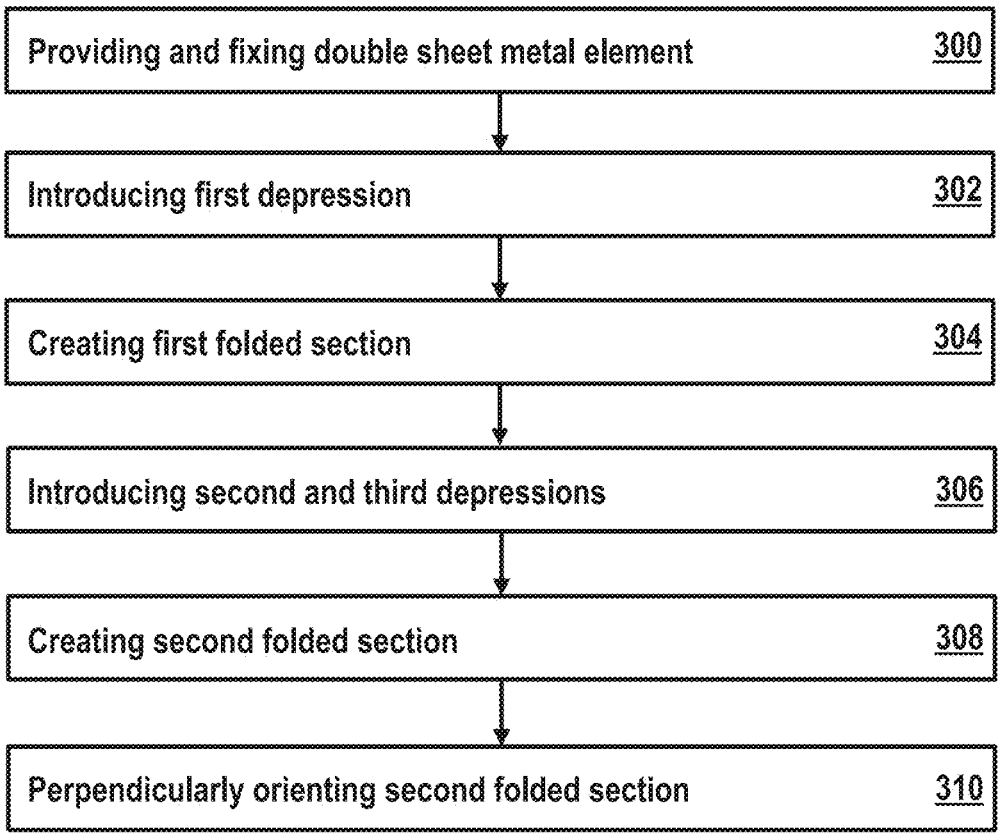
FIG. 6 shows a schematic flow chart of an exemplary embodiment of a second method.

FIG. 6 shows an exemplary second method for connecting two sheet metal end sections arranged on top of one another by means of forming. In block 300, a double sheet metal element is provided, which is arranged and fixed in a processing position. In block 302, a first, for example V-shaped, depression is introduced along a connecting line into a first surface of the double sheet metal element, along which the two sheet metal end sections of the double sheet metal element are to be connected to one another. In block 304, a first folded section of the double sheet metal element is created along the connecting line. In the process, two mutually opposing inside walls of the first V-shaped depression are pressed against one another. In block 306, a second, for example V-shaped, depression is introduced into the first surface of the double sheet metal element into which the first V-shaped depression was already introduced in block 302. Moreover, a third, for example V-shaped, depression extending along the connecting line is introduced into a second surface of the double sheet metal element which faces away from the first surface. For example, the first surface is provided by a top side of the double sheet metal element, while the second surface is provided by a bottom side of the double sheet metal element, with which the double sheet metal element rests on a bearing surface.

In block 308, a second folded section of the double sheet metal element is created along the connecting line, which includes the first folded section. In the process, two mutually opposing inside walls of the second V-shaped depression are pressed against one another. In block 310, the second folded section is perpendicularly oriented relative to the extension plane of the double sheet metal element. According to embodiments, the perpendicular orientation comprises bending over a portion of the double sheet metal element which includes the second folded section along a bending axis that extends parallel to the connecting line, so that the second folded section extends perpendicularly to the extension plane. According to embodiments, the bending axis, about which the portion of the double sheet metal element that comprises the second folded section is bent, extends along a base of the third V-shaped depression.

FIGS. 7A to 7K show an exemplary device 120 for carrying out the second method from FIG. 6. In the process, the involved moving device elements of the device 120 are displaced exclusively perpendicularly to the extension plane of the double sheet metal element 100. The device 120 comprises a punch 130 comprising two punch elements 132, 133. Each of the two punch elements 132, 133 has a, for example, V-shaped cross-section, wherein each leg of the V-shaped cross-section is provided by a first stop surface 134, 135. According to embodiments, the second punch element 133 is arranged lower in the vertical direction, that is, perpendicularly to the extension plane 152 of the double sheet metal element 100. This has the effect that the second punch element 133 engaging with the double sheet metal element 100 at the same time avoids the first punch element 132 from engaging with the double sheet metal element 100.

In addition to the punch 130, the device 120 comprises a die 140, which includes two sub-dies 141, 143 providing a bearing surface for placing on the double sheet metal element 100. A, for example V-shaped, cavity 142, 144 is introduced into each of the sub-dies 141, 143, wherein the two V-shaped cavities 142, 144 extend parallel to one another. In the process, the sub-die 141 with the V-shaped cavity 142 is arranged beneath the first punch element 132, and the sub-die 143 with the V-shaped cavity 144 is arranged beneath the second punch element 133. The sub-die 141 is moreover displaceable relative to the sub-die 143 in the vertical direction, that is, perpendicularly to the extension plane 152 of the double sheet metal element 100. The sub-die 141 furthermore includes a second stop surface 136.

Finally, the device 120 also comprises a clamping device for fixing an end 105 of the double sheet metal element 100 by way of a first clamping element 150 and a second clamping element 151 on a portion of the bearing surface of the sub-dies which is provided by the second clamping element 151, while the opposite end 106 of the double sheet metal element 100 is a free, non-fixed end. So as to connect the two sheet metal end sections encompassed by the double sheet metal element 100 by means of forming, the punch 130 as well as the sub-die 141 are displaced, while the positions of the sub-die 143 as well as of the clamping device 150, 151 are held constant. In the course of the provision, the double sheet metal element 100 is positioned in a processing position on the bearing surface and is fixed, using the clamping device including the two clamping elements 150, 151.

Figure 7A:
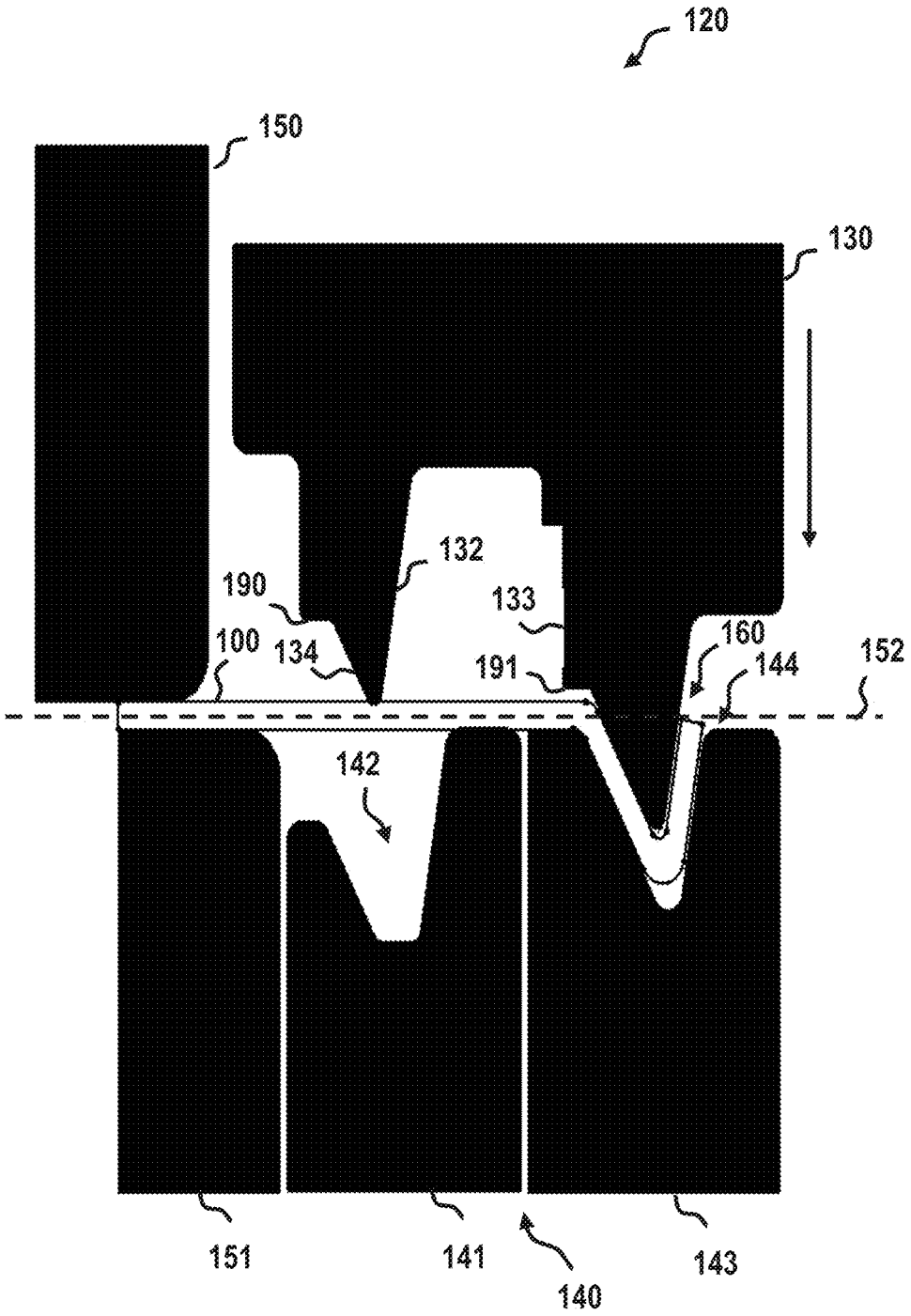
FIG. 7 show schematic diagrams of an exemplary embodiment of a device for carrying out the second method from FIG. 6.

In FIG. 7A, the punch 130 was displaced vertically from above with the punch element 133 into the V-shaped cavity 144 of the sub-die 143, whereby a first, for example V-shaped, depression 160 is introduced into the double sheet metal element 100. In the process, an edge of the first V-shaped depression 160 is formed by the edge 106 of the double sheet metal element 100. As a result of the differing positioning of the two punch elements 132, 133 at differing heights in the vertical direction, the first punch element 132 does not engage with the double sheet metal element 100. In the shown embodiment, the double sheet metal element 100 was first fixed in the processing position, using the clamping device 150 comprising the two clamping elements 150, 151, before the first V-shaped depression 160 is introduced. According to embodiments, the second punch element 133, in addition to a first stop surface 135, includes a further stop surface 191, which extends parallel to an extension plane 152 of the double sheet metal element 100. Likewise, according to embodiments, the first punch element 132 includes a third stop surface 190, which is arranged between a first stop surface 134 and the second stop surface 136 and extends parallel to the extension plane 152 of the double sheet metal element 100.

Figure 7B:
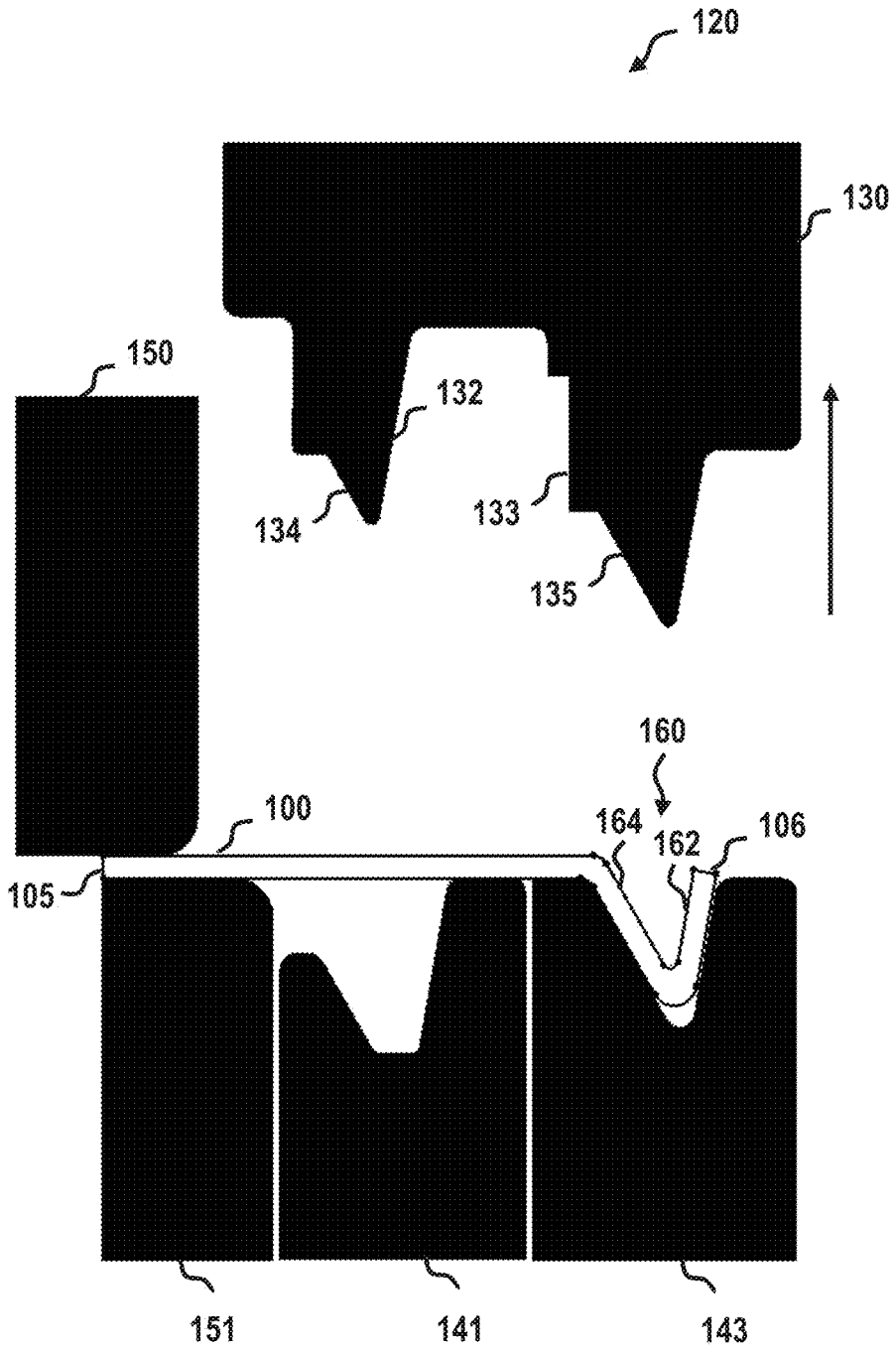
Figure 7C:
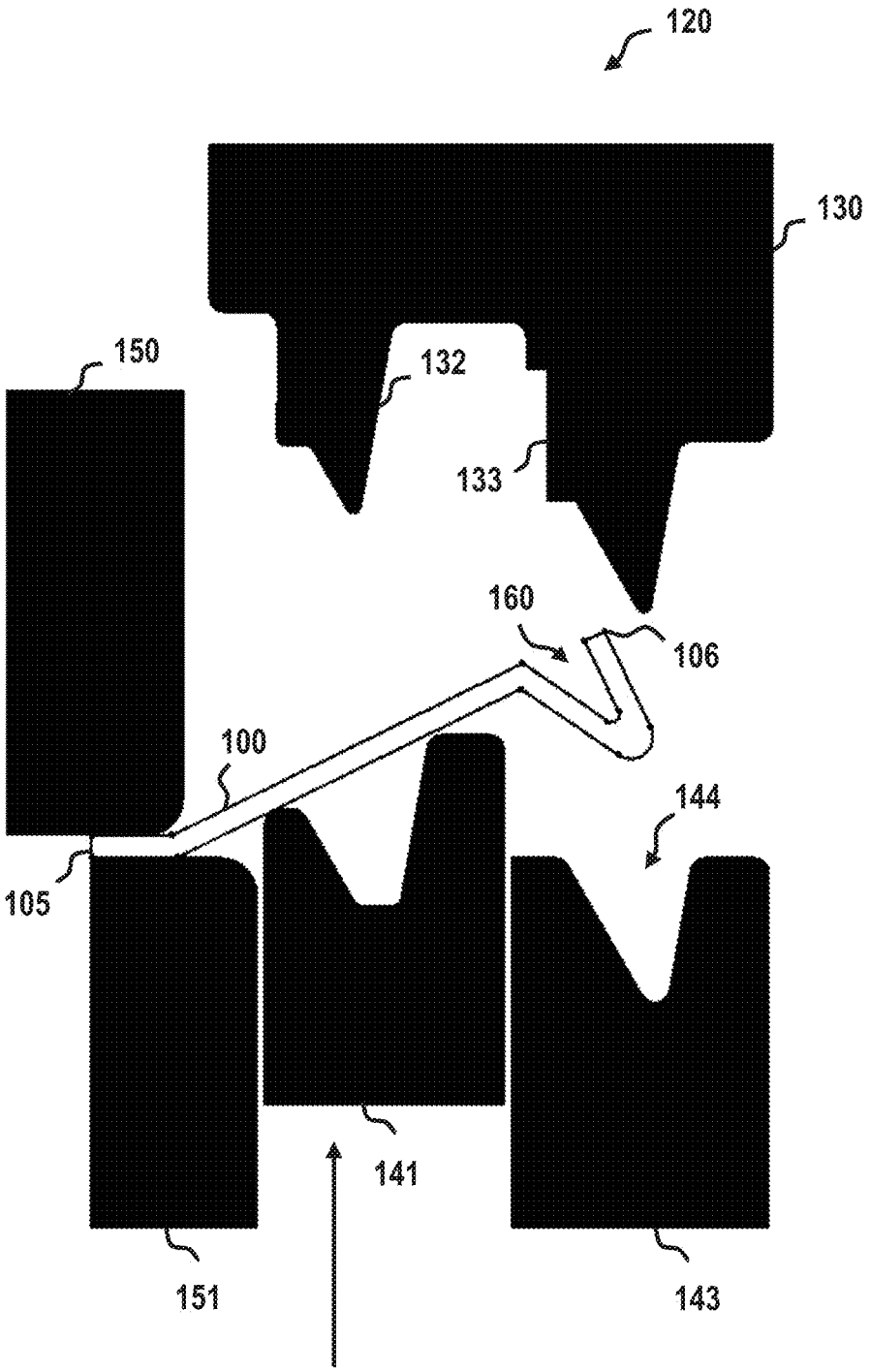
Figure 7D:
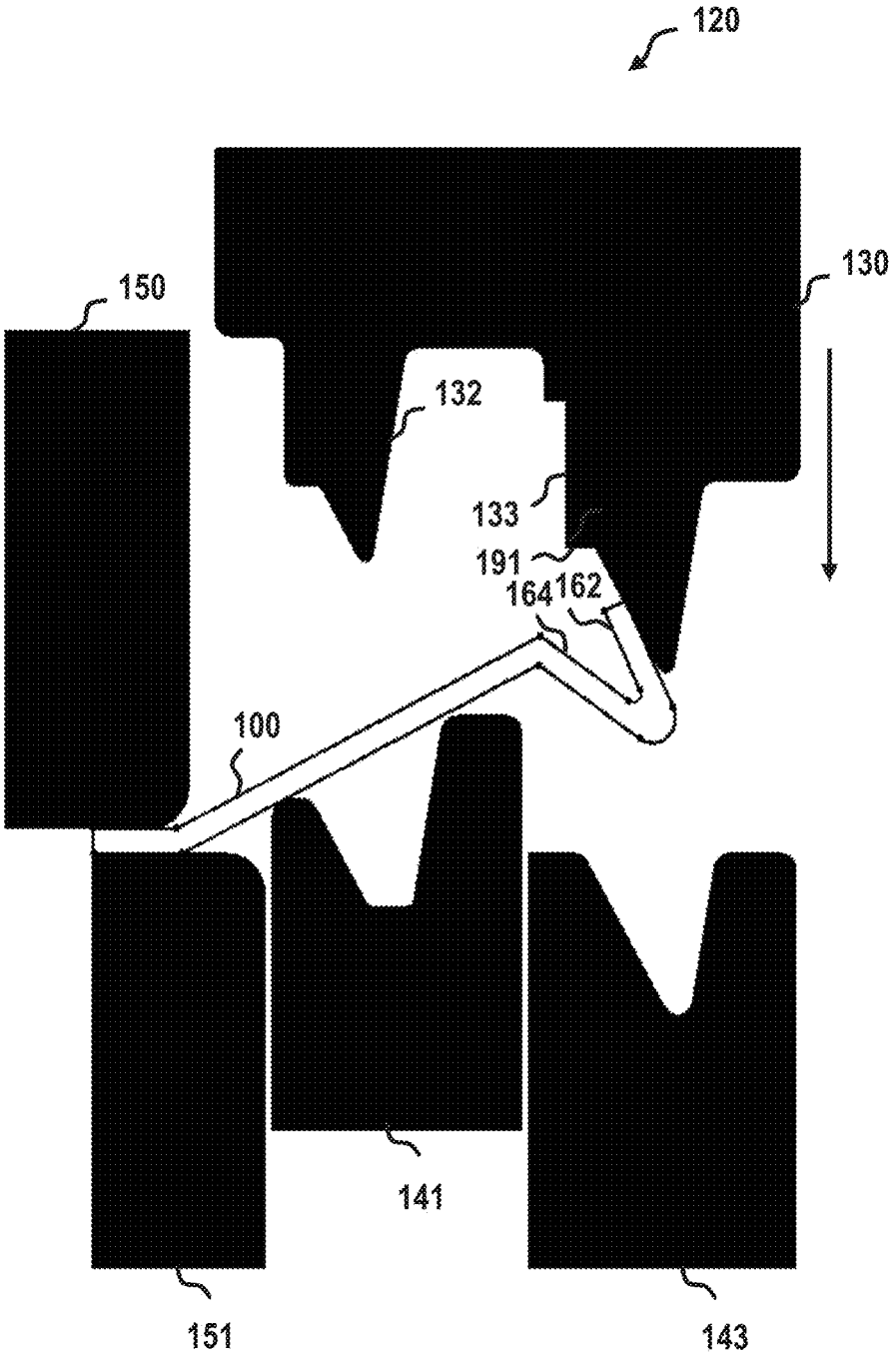
Figure 7E:
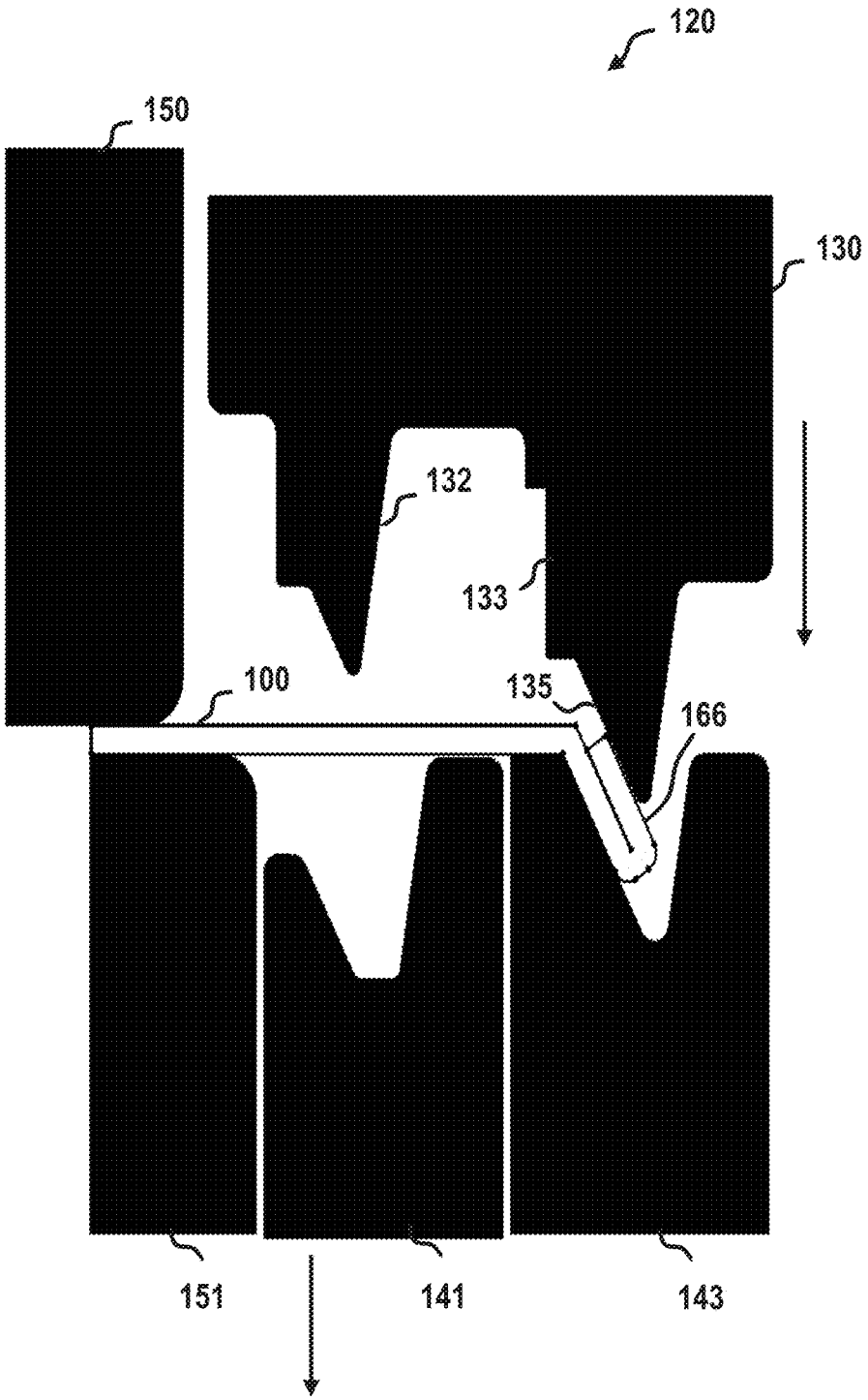

The punch 130 is displaced out of the first V-shaped cavity 144 upwardly, as shown in FIG. 7B, into the starting position thereof above the sub-dies 141, 143. Thereafter, the sub-die 141 is displaced in the vertical direction upwardly toward the punch 130. In this way, as is shown in FIG. 7C, the free end comprising the edge 106 of the double sheet metal element 100 and the first V-shaped depression 160 is pivoted upwardly by a first angle about the end 105 that is fixed in a stationary manner by the clamping device 150, toward the punch 130. As a result, the first V-shaped depression 160 is positioned in a tilted manner beneath the first stop surface 135 of the second punch element 133. The punch 130 is displaced downwardly, so that the first stop surface 135 of the second punch element 133, as shown in FIG. 7D, makes contact with an outside wall of the first V-shaped depression 160. From this point on, the sub-die 141 and the punch 130 are synchronously displaced downwardly until the sub-die 141, as shown in FIG. 7E, has reached the starting position thereof at the same height as the sub-die 143 and the clamping element 151. The punch 130 is displaced with the second punch element 133 further downwardly into the V-shaped cavity 144 of the sub-die 143, so that the second punch element 133, with the stop surface 135, presses the first V-shaped depression 160 together. In the process, two mutually opposing inside walls 162, 164 of the first V-shaped depression 160 are pressed against one another, and a first folded section 166 of the double sheet metal element 100 is created. The first folded section 166 is a section that is folded once. The further stop surface 191 prevents one or both of the sheet metal end sections of the double sheet metal element 100, which at this stage are not yet connected to one another, from being pressed away from the cavity 144 or out of the cavity 144, when the V-shaped depression 160 is pressed down by the first stop surface 135 of the second punch element 133 making contact with the outer side and/or when, subsequently, the two mutually opposing inside walls 162, 164 of the first V-shaped depression 160 are pressed against one another in the cavity 144. In particular, it is possible for the further stop surface 191 to prevent the sheet metal end section, of the sheet metal end sections that are not yet connected to one another, which is located on top from being pressed away from the cavity 144 or out of the cavity 144, while the bottom sheet metal end section of the two sheet metal end sections that are not yet connected to one another is pressed into the cavity 144 and is pressed together by the second punch element 133.

Figure 7F:
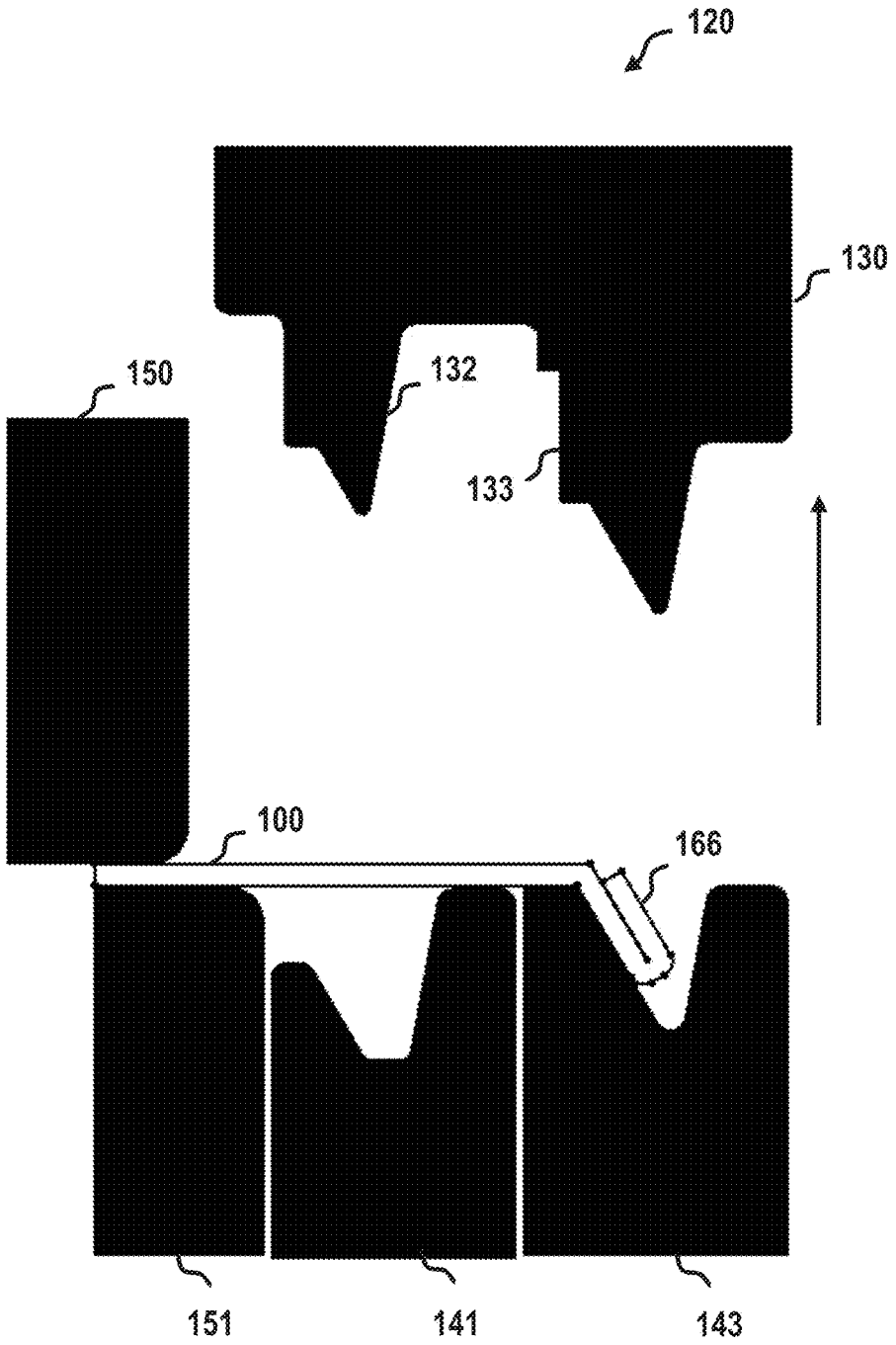
Figure 7G:
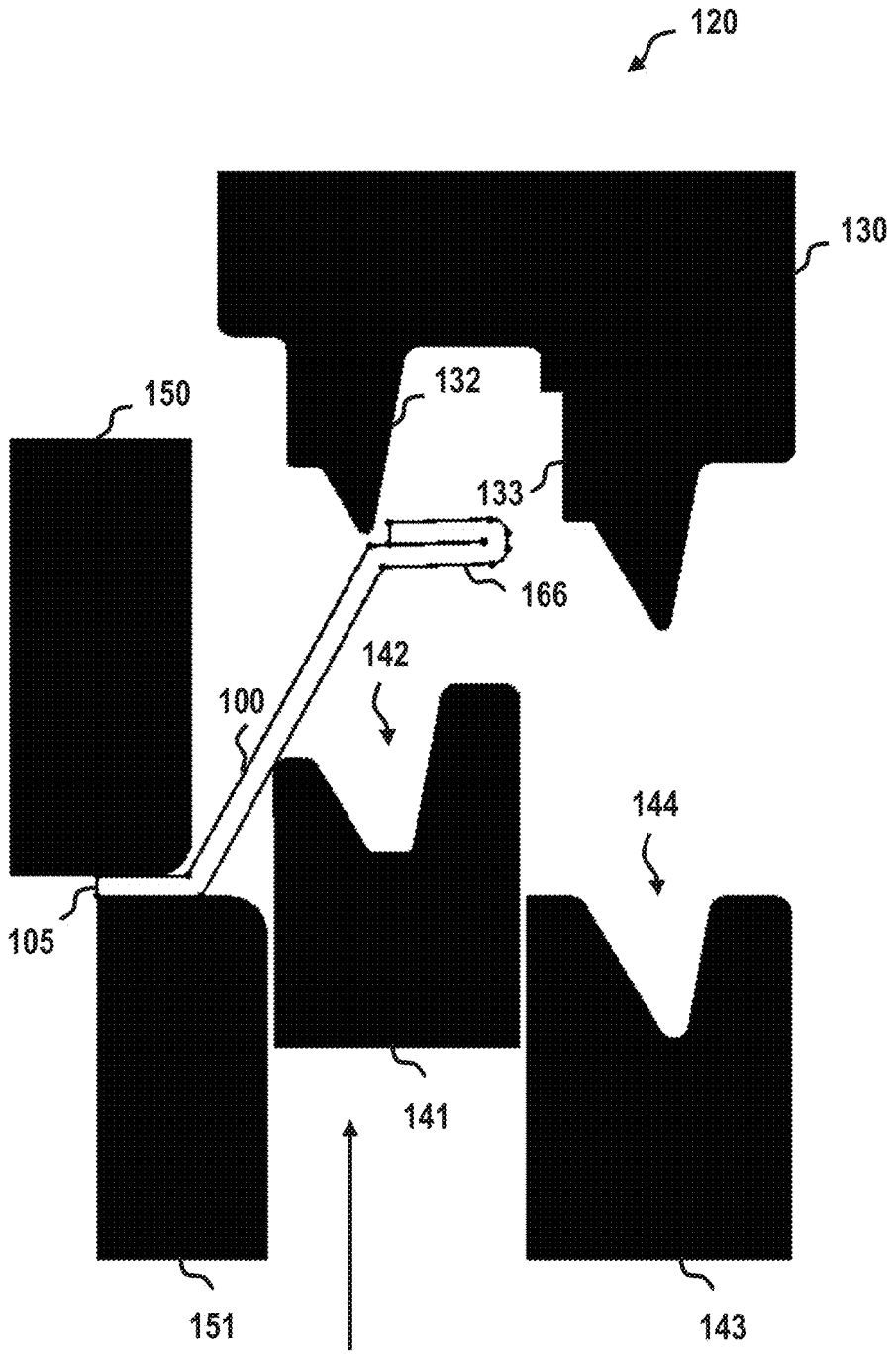
Figure 7H:
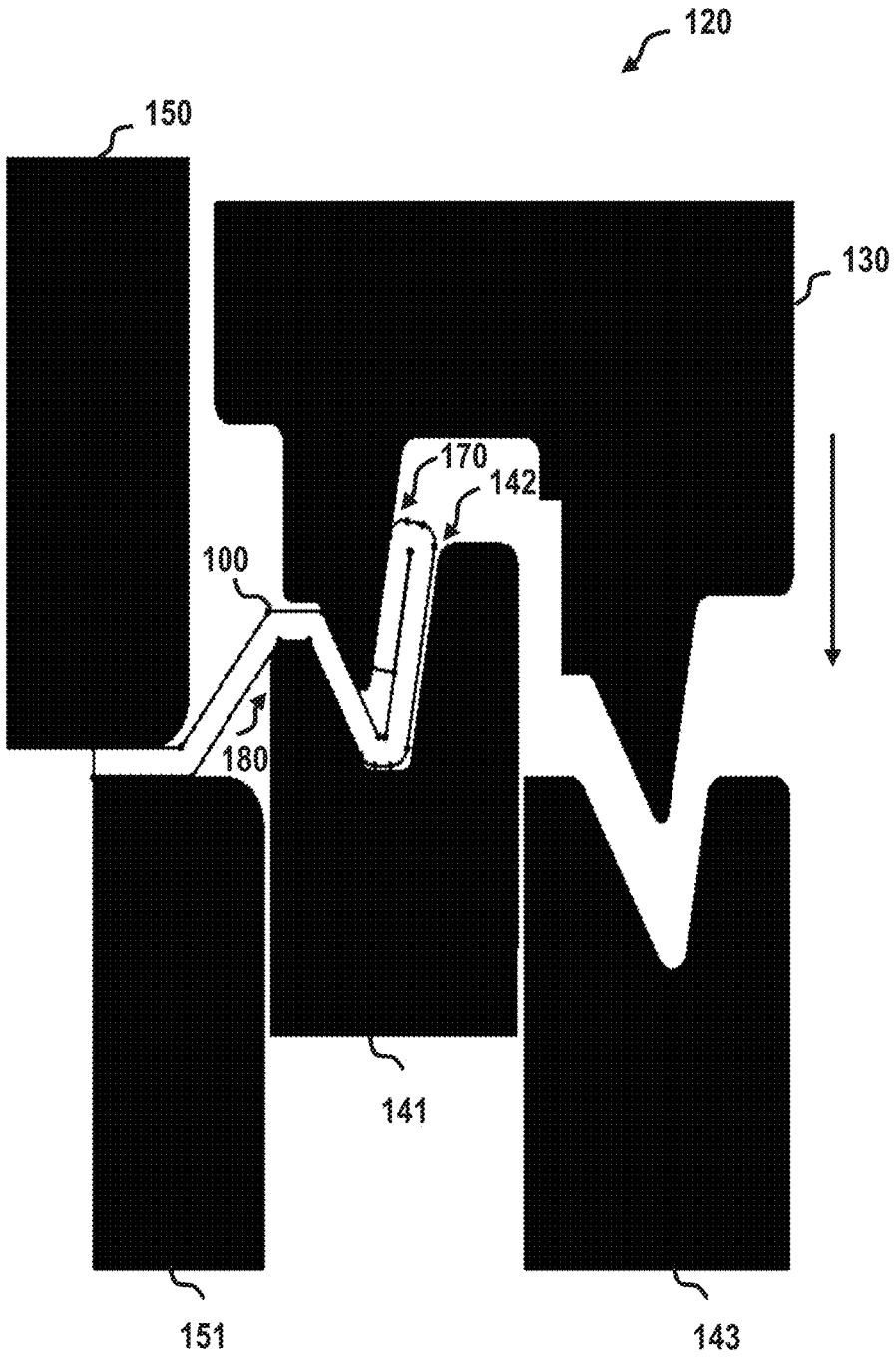

The punch 130 is displaced upwardly out of the V-shaped cavity 142, as shown in FIG. 7F, into the starting position thereof above the sub-dies 141, 143. Thereafter, the sub-die 141 is displaced in the vertical direction upwardly toward the punch 130. In this way, as is shown in FIG. 7G, the free end comprising the edge 106 of the double sheet metal element 100 and the first folded section 166 is pivoted upwardly by a second angle about the end 105 that is fixed in a stationary manner by the clamping device 150, toward the punch 130. This causes the first folded section 166 of the double sheet metal element 100 to be arranged between the first and second punch elements 132, 133. In the process, no portion of the double sheet metal element 100 is present any longer beneath the second punch element 133. In FIG. 7H, the punch 130 was displaced perpendicularly downwardly with the first punch element 132 into the V-shaped cavity 142 of the sub-die 141, whereby a second, for example V-shaped, depression 170 is introduced into the double sheet metal element 100. Since the sub-die 141 is located in an elevated position relative to the sub-die 143 and the clamping element 151, a third, for example V-shaped, depression 180 is synchronously introduced into the double sheet metal element 100, parallel to the second V-shaped depression 170. The first two V-shaped depressions 160, 170 are introduced into a first surface of the double sheet metal element 100 which faces the punch 130, while the third V-shaped depression 180 is introduced into a second surface of the double sheet metal element 100 which faces away from the first surface. This second surface of the double sheet metal element 100 faces the sub-dies 141, 143.

Figure 7I:
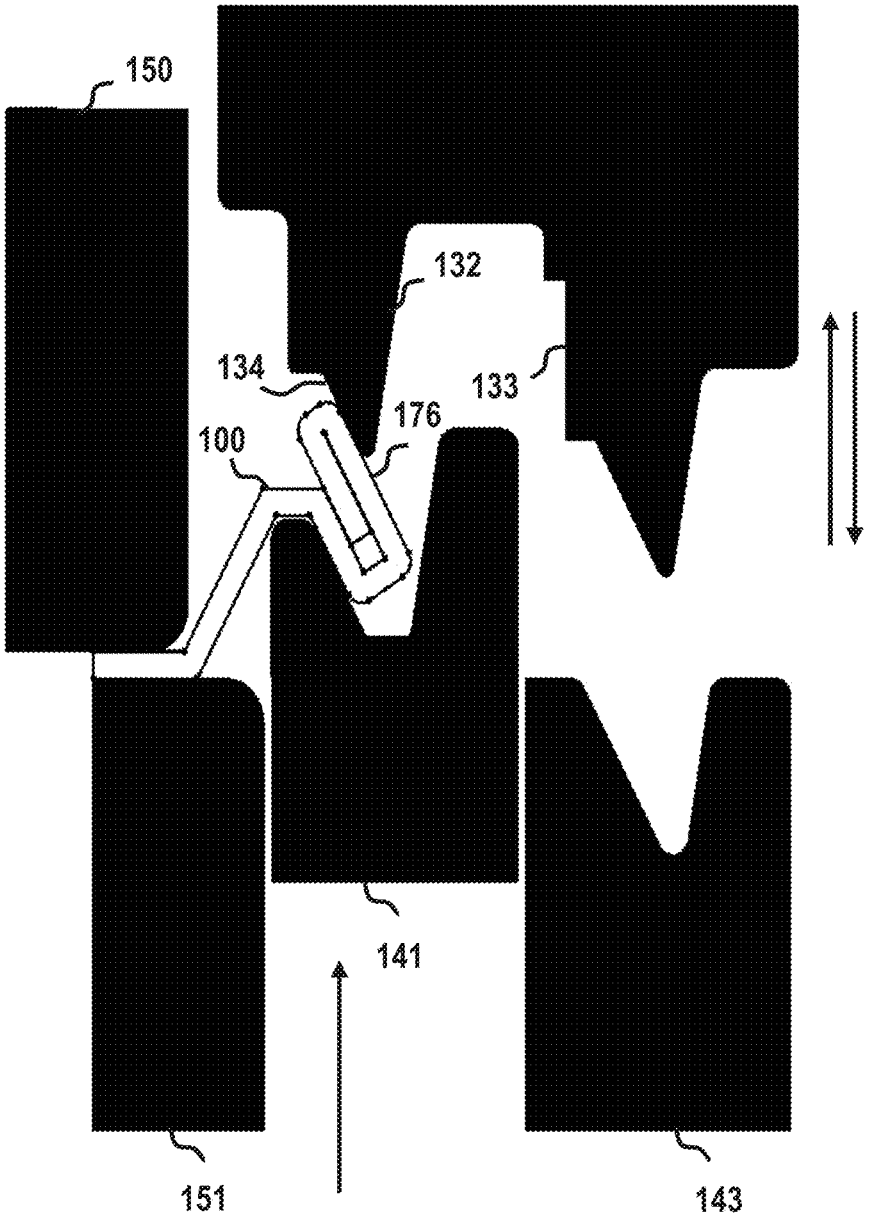

Thereafter, the punch 130 is displaced upwardly into the starting position thereof, and the sub-die 141 is displaced slightly further upwardly. In this way, the free end of the double sheet metal element 100, including the second V-shaped depression 170, is raised and tilted about the fixed end 105 of the double sheet metal element 100. The punch 130 is displaced downwardly with the first punch element 132 into the V-shaped cavity 142 of the sub-die 141, so that the second stop surface 136 of the first punch element 132, as shown in FIG. 7I, makes contact with an outside wall of the second V-shaped depression 170 and presses the second V-shaped depression 170 together. In the process, two mutually opposing inside walls of the second V-shaped depression 170 are pressed against one another, and a connecting section in the form of a second folded section 176 of the double sheet metal element 100 is created. In other words, the second folded section 176, and thus the connecting section, is a section that is folded twice, which encompasses the first folded section 166.

Figure 7J:
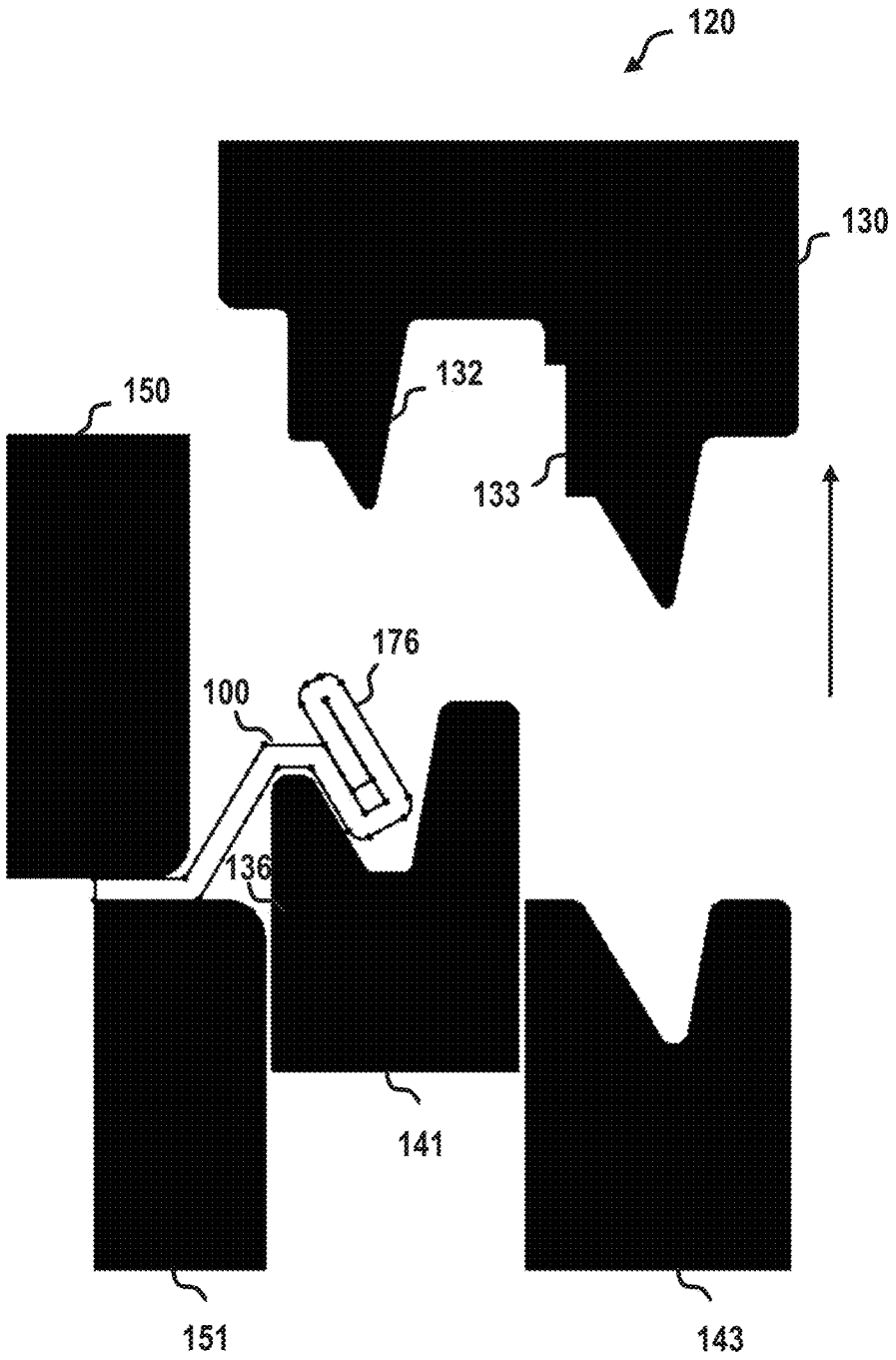
Figure 7K:
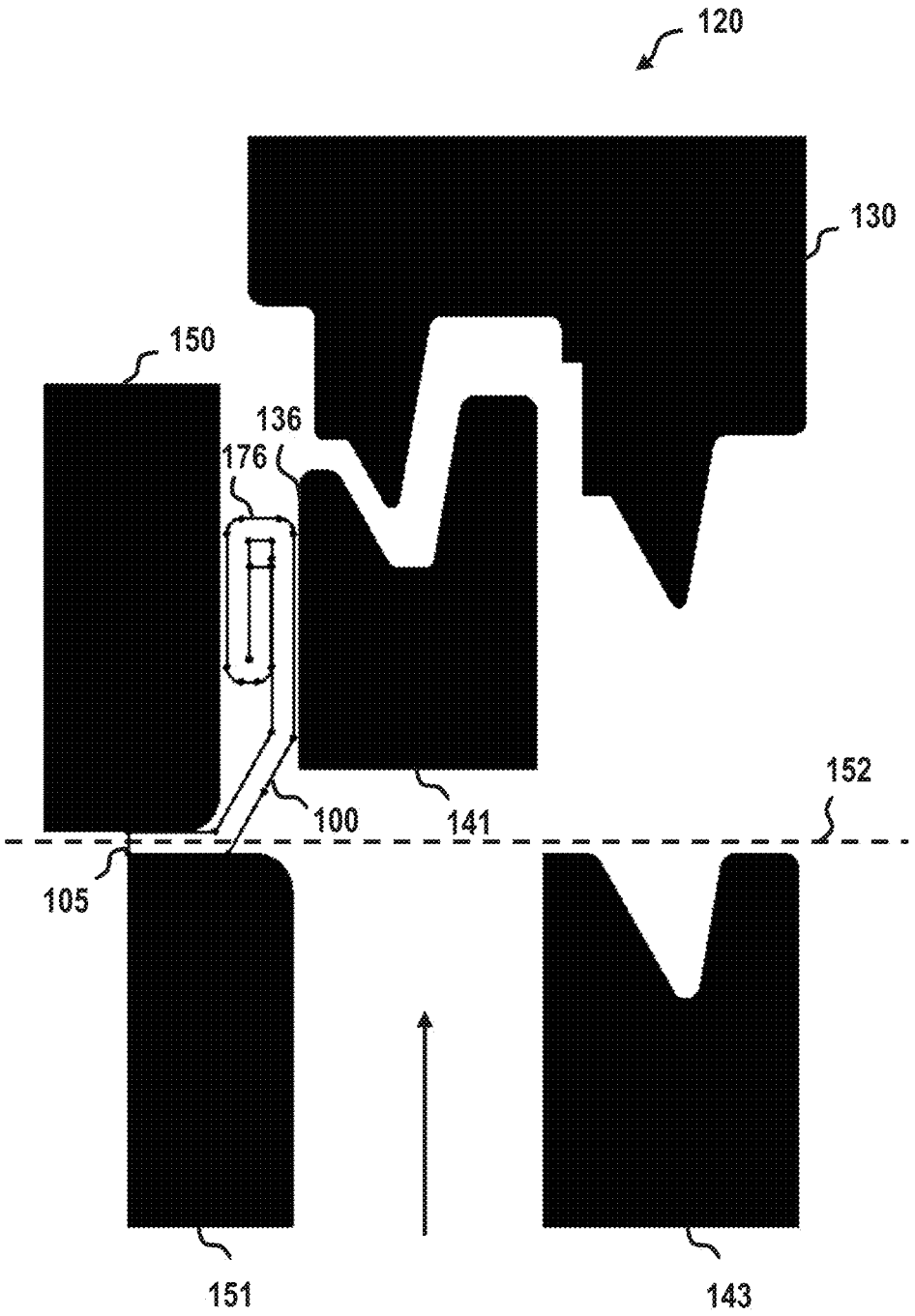

Thereafter, the punch 130 is displaced upwardly into the starting position thereof, as shown in FIG. 7J. The sub-die 141 is displaced further upwardly, whereby the connecting section comprising the second folded section 176 is perpendicularly oriented relative to the extension plane 152 of the double sheet metal element 100. In the process, the second stop surface 136 of the sub-die 141 presses against the second folded section 176 of the double sheet metal element 100, which is bent about a bending axis provided by an edge of the third V-shaped depression 180. As a result, a portion of the double sheet metal element 100 comprising the connecting section is then bent upwardly, so that, in the end position shown in FIG. 7K, the connecting section comprising the second folded section 176 extends perpendicularly to the extension plane 152 of the double sheet metal element 100.

Figure 8:
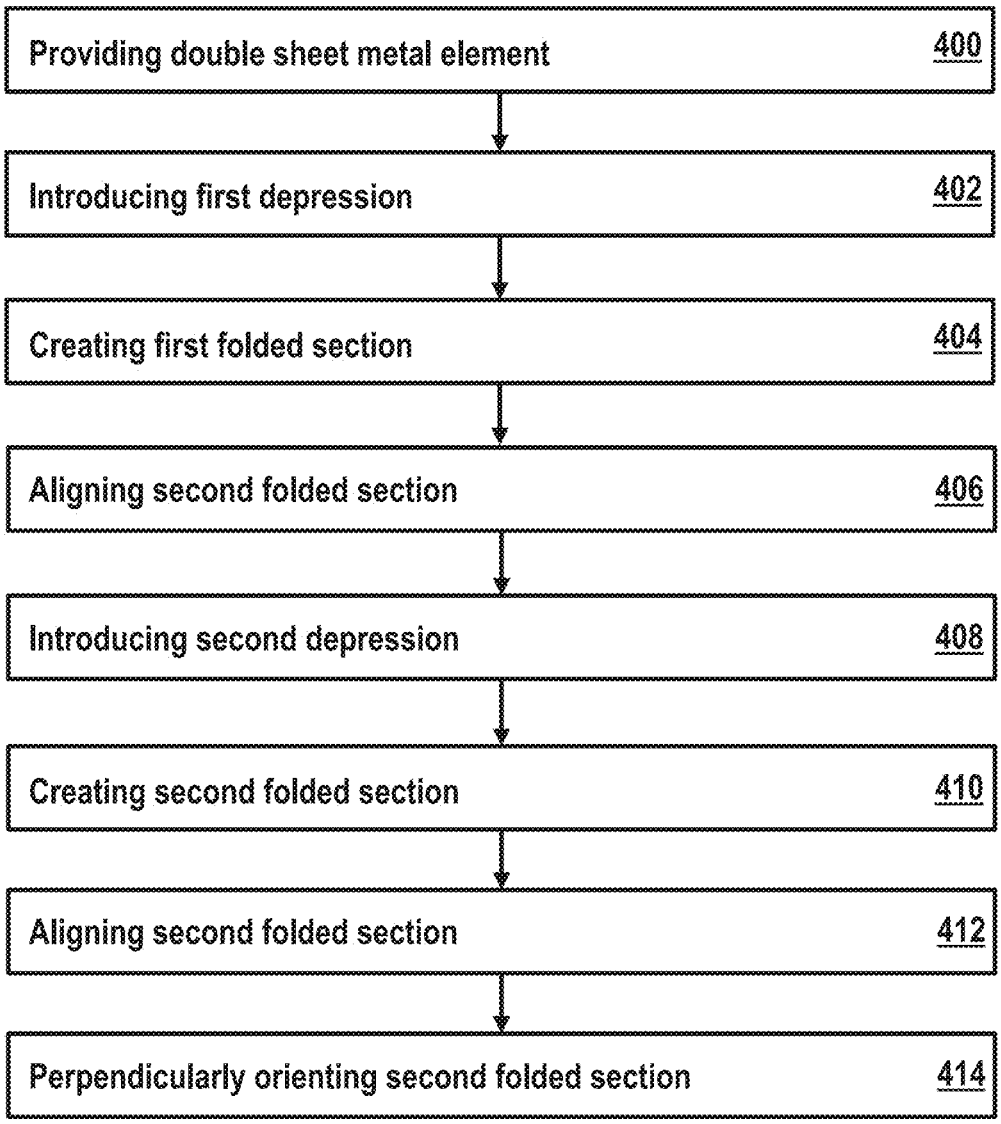
FIG. 8 shows a schematic flow chart of an exemplary embodiment of a third method.

FIG. 8 shows, by way of example, a third method for connecting two sheet metal end sections arranged on top of one another by means of forming. In block 400, a double sheet metal element is provided. In block 402, a first, for example V-shaped, depression is introduced along a connecting line into the double sheet metal element, along which the two sheet metal end sections of the double sheet metal element are to be connected to one another. In block 404, a first folded section of the double sheet metal element is created along the connecting line. In the process, two mutually opposing inside walls of the first V-shaped depression are pressed against one another. In block 406, the first folded section of the double sheet metal element is aligned. In the process, the first folded section is bent about a bending axis provided by an edge of the first V-shaped depression, so that the first folded section extends parallel to the extension plane of the double sheet metal element. In block 408, a second, for example V-shaped, depression is introduced into the double sheet metal element. In block 410, a second folded section of the double sheet metal element is created along the connecting line, which includes the first folded section. In the process, two mutually opposing inside walls of the second V-shaped depression are pressed against one another. In block 412, the connecting section comprising the second folded section of the double sheet metal element is aligned. In the process, the second folded section is bent about a bending axis provided by an edge of the second V-shaped depression, so that the second folded section extends parallel to the extension plane of the double sheet metal element. In block 414, the connecting section comprising the second folded section is perpendicularly oriented relative to the extension plane of the double sheet metal element. According to embodiments, the perpendicular orientation comprises bending over a portion of the double sheet metal element comprising the connecting section along a bending axis extending parallel to the connecting line, so that the connecting section comprising the second folded section extends perpendicularly to the extension plane.

Figure 9A:
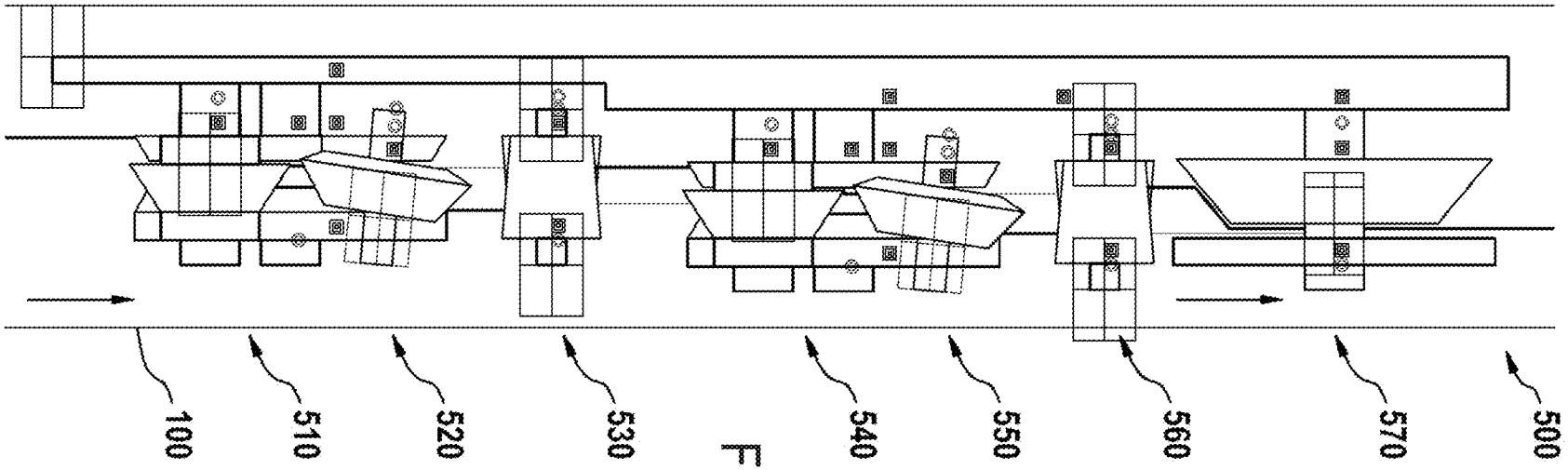
FIG. 9 show schematic diagrams of an exemplary embodiment of a device for carrying out the third method from FIG. 8.
Figure 9B:
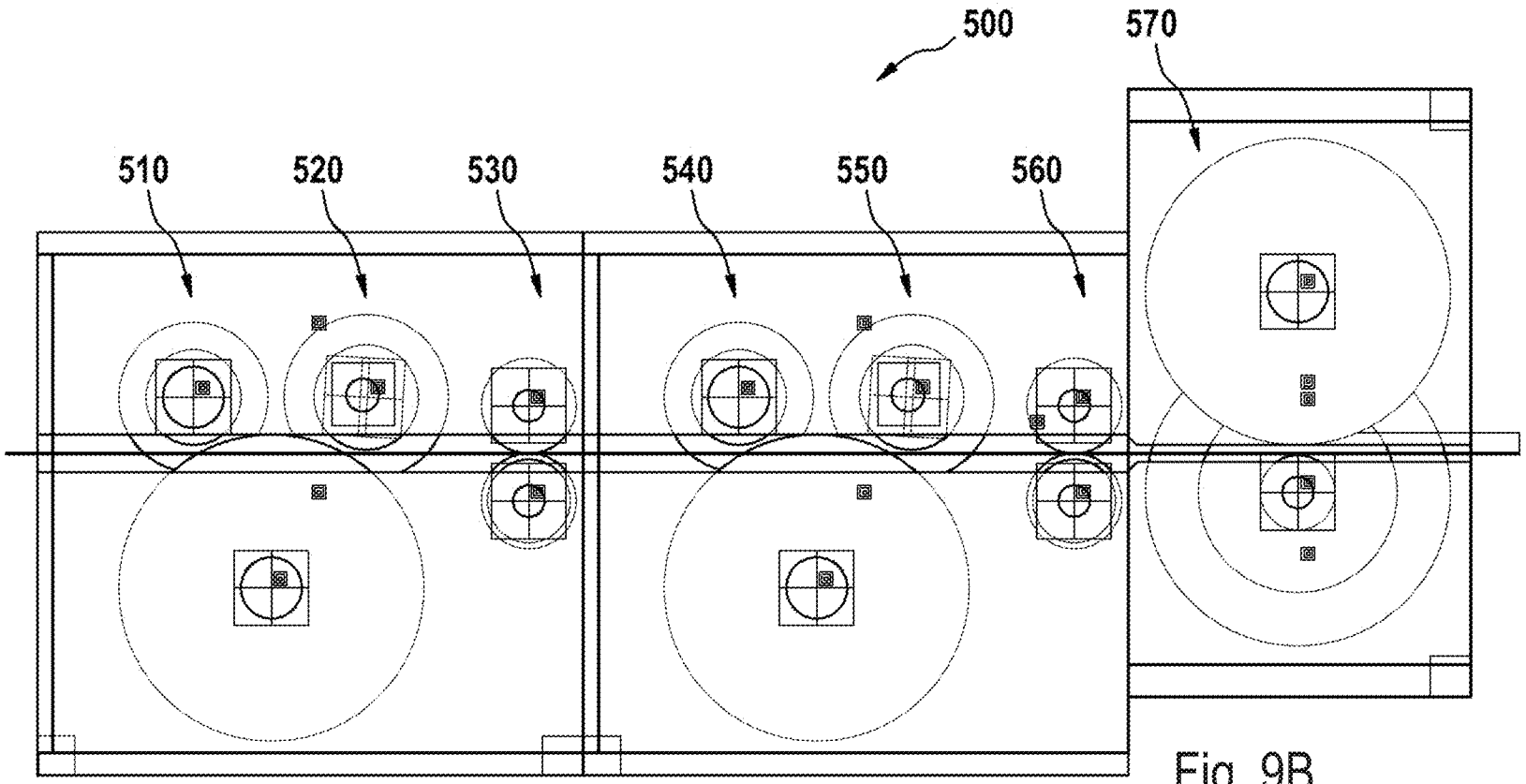

FIGS. 9A and 9B show an exemplary device 500 for carrying out the third method from FIG. 8. FIG. 9A shows a top view from above onto the device 500. FIG. 9B shows a side view of the device 500. FIGS. 10A to 10G show exemplary elements of the device 500 from FIGS. 9A and 9B. The device 500 comprises seven roller pairs 510, 520, 530, 540, 550, 560, 570, which are arranged in row behind one another. In the process, the roller pair 510 geometrically essentially corresponds to the roller pair 540, the roller pair 520 corresponds to the roller pair 550, and the roller pair 530 corresponds to roller pair 560. The double sheet metal element 100 is guided along the device 500, consecutively passing through the individual roller pairs 510, 520, 530, 540, 550, 560, 570. The first roller pair 510, which is shown in greater detail in FIG. 10A, introduces a first, for example V-shaped, depression into the double sheet metal element 100. For this purpose, a first roller 512 of the roller pair 510 includes a circumferential, for example V-shaped, cavity in the circumferential or running surface thereof. A second roller 514 of the roller pair 510 includes a circumferential, for example V-shaped, elevation on the circumferential or running surface thereof. A first folded section of the double sheet metal element 100 is created by the second roller pair 520, which is shown in greater detail in FIG. 10B, wherein two mutually opposing inside walls of the first V-shaped depression are pressed against one another. The first roller 512 shares the second roller pair 520 with the first roller pair 510. A second roller 524 of the roller pair 520 includes a circumferential V-shaped elevation on the circumferential or running surface thereof, wherein the orientation of the second roller 524 is tilted about an axis of rotation situated perpendicularly on the extension direction of the double sheet metal element 100. The first folded section of the double sheet metal element 100 is aligned by the third roller pair 530, which is shown in greater detail in FIG. 10C, so that the first folded section extends parallel to the extension plane of the double sheet metal element 100. For this purpose, the two rollers 532, 534 of the third roller pair 530 include planar circumferential or running surfaces that are parallel in the axial direction.

Figure 10C:
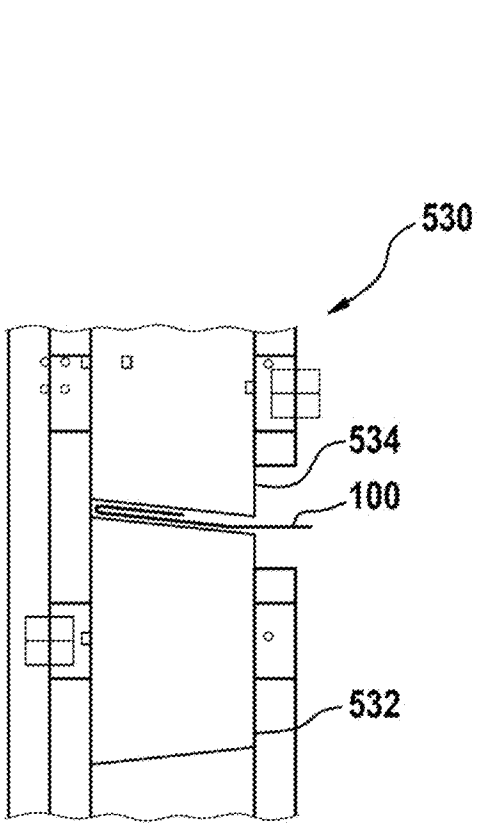
FIG. 10 show schematic diagrams of exemplary embodiments of elements of the device from FIG. 9.
Figure 10B:
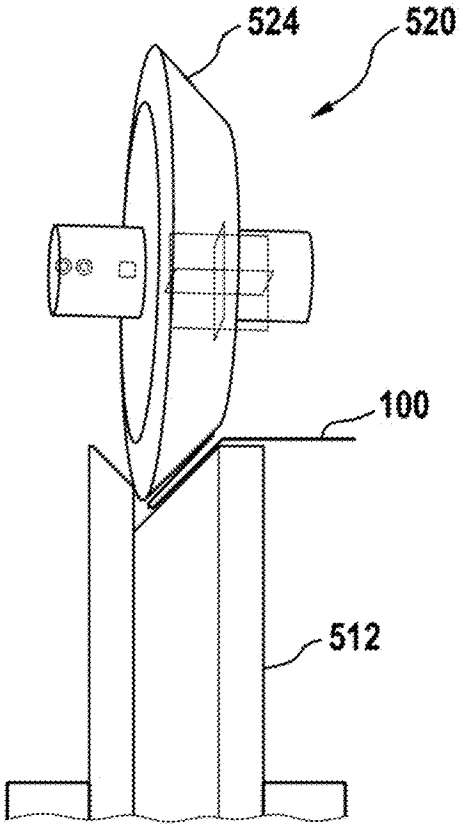
Figure 10A:
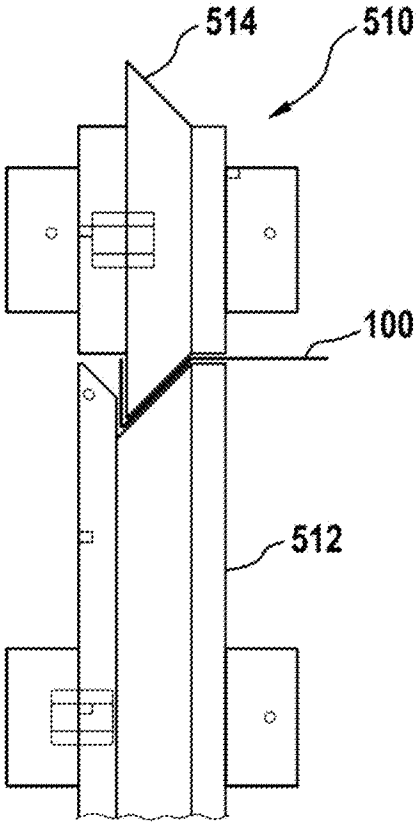
Figure 10F:
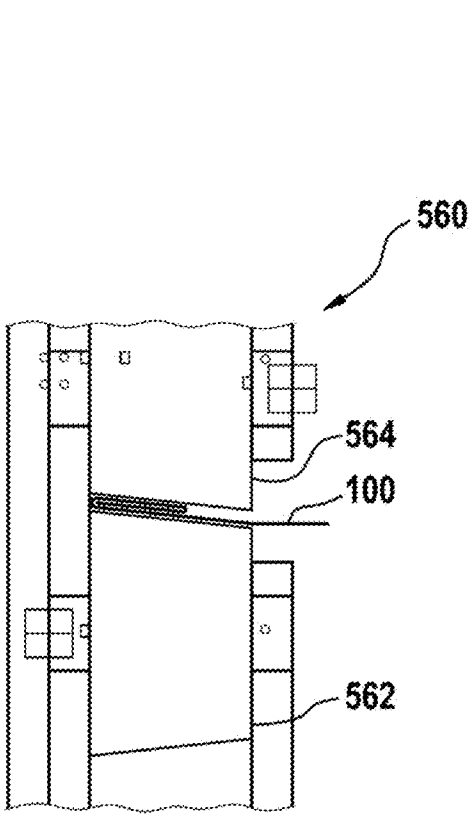
Figure 10E:
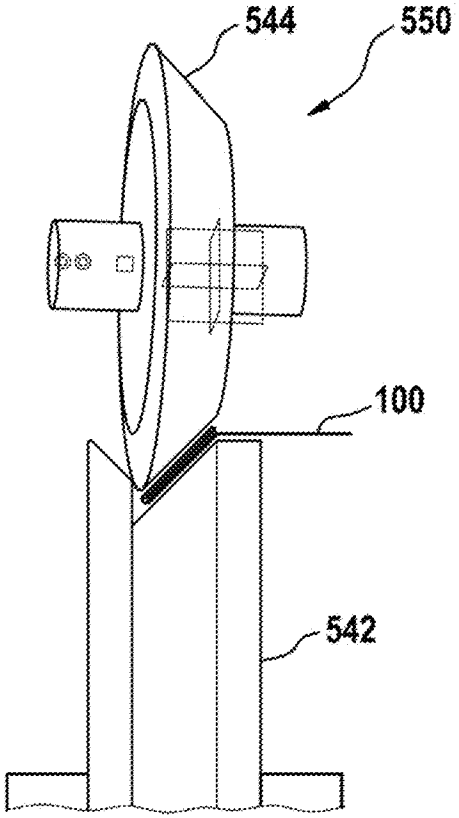
Figure 10D:
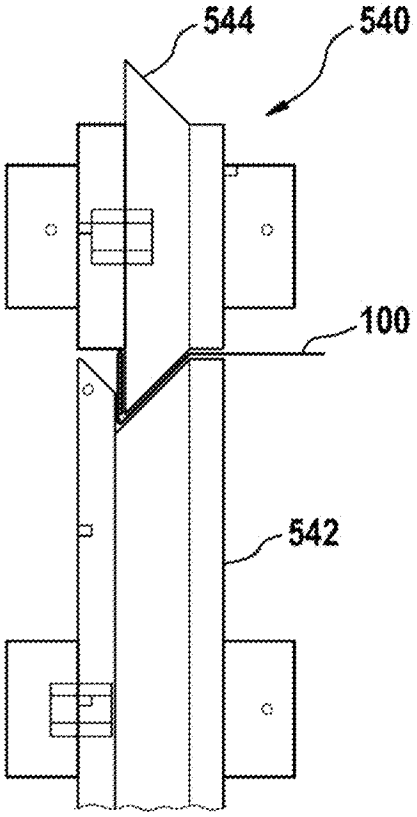

The fourth roller pair 540 shown in greater detail in FIG. 10D has the same geometry as the first roller pair 510 and is used to introduce a second, for example V-shaped, depression into the double sheet metal element 100. The fifth roller pair 550 shown in greater detail in FIG. 10E has the same geometry as the second roller pair 520 and is used to create a second folded section of the double sheet metal element 100 or connecting section. The sixth roller pair 560 shown in greater detail in FIG. 10F has the same geometry as the third roller pair 530 and is used to align the second folded section with respect to the extension plane of the double sheet metal element 100.

Figure 10G:
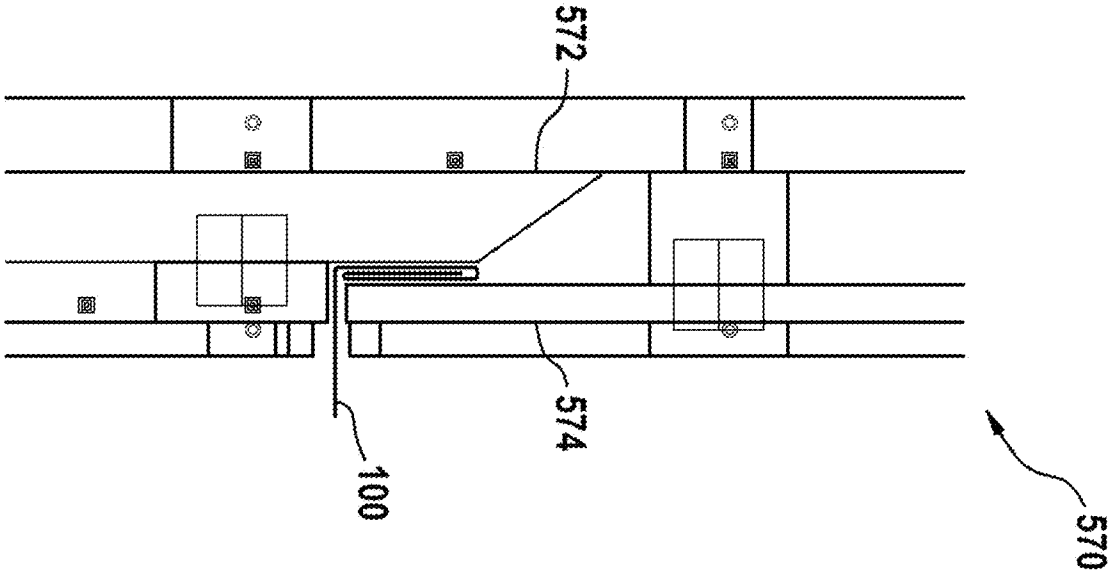

The seventh roller pair 570, which is shown in greater detail in FIG. 10G, comprises two rollers 572, 574, which each provide a stop surface between which the connecting section comprising the second folded section is guided out of the alignment thereof, which is parallel to the extension plane of the double sheet metal element 100, into a perpendicularly oriented alignment. As a result, the connecting section comprising the second folded section extends perpendicularly to the extension plane of the double sheet metal element 100, after having passed through the seventh roller pair 570.

Figure 11A:
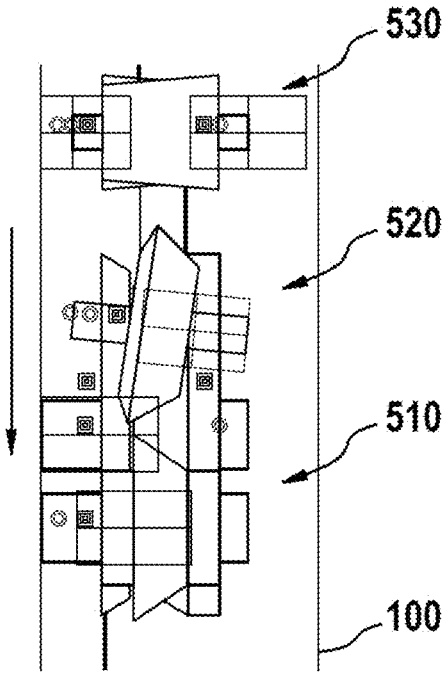
FIG. 11 show schematic diagrams of exemplary embodiments of elements of an alternative device.
Figure 11B:
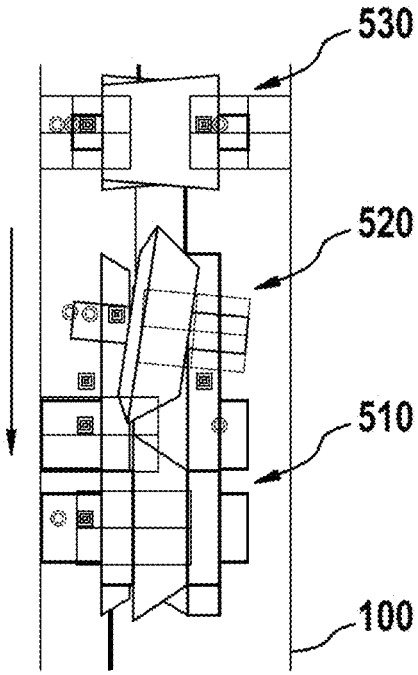
Figure 11C:
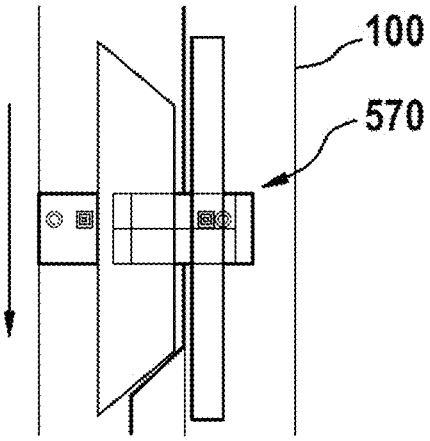

FIGS. 11A to 11C show an alternative selection and arrangement of exemplary elements of the device 500 from FIGS. 9A and 9B. The selection according to FIGS. 11A to 11C comprises four, instead of the seven, roller pairs of the device 500. In contrast to the device 500, the roller pairs of FIGS. 11A to 11C are not arranged in a stationary manner in a row. Rather, the roller pairs 510, 520, 530, 570 are displaced individually or in groups, once or multiple times, along an edge of the double sheet metal element 100 so as to establish the connection between the sheet metal end sections of the double sheet metal element. For example, the roller pairs 510, 520, 530 are arranged in a group. Instead of the additional roller pairs 540, 550, 560 of the device 500, rather, the roller pairs 510, 520, 530 are used twice, as is shown in FIGS. 11A and 11B. For this purpose, for example, the group comprising the roller pairs 510, 520, 530 is displaced twice along the edge of the double sheet metal element 100. For example, the group is displaced from a starting position into an end position along the edge of the double sheet metal element 100, whereby a first folded section is created along the edge of the double sheet metal element 100. Thereafter, the group is returned to the starting position and displaced from a starting position into an end position along the first folded section, whereby a second folded section is created. The perpendicular orientation of the resulting connecting section comprising the second folded section is carried out using the roller pair 570, which is subsequently displaced from the starting position into the end position along the second folded section.

According to alternative embodiments, the connecting section only comprises the first folded section. In other words, the group comprising the roller pairs 510, 520, 530 is only displaced once along the edge of the double sheet metal element 100, as is shown in FIG. 11A, and thereafter the perpendicular orientation according to FIG. 11C is carried out using the roller pair 570. The method according to FIG. 8 in this case comprises the steps 400 to 406 and 414, wherein the first folded section is perpendicularly oriented in step 414.

Figure 12A:
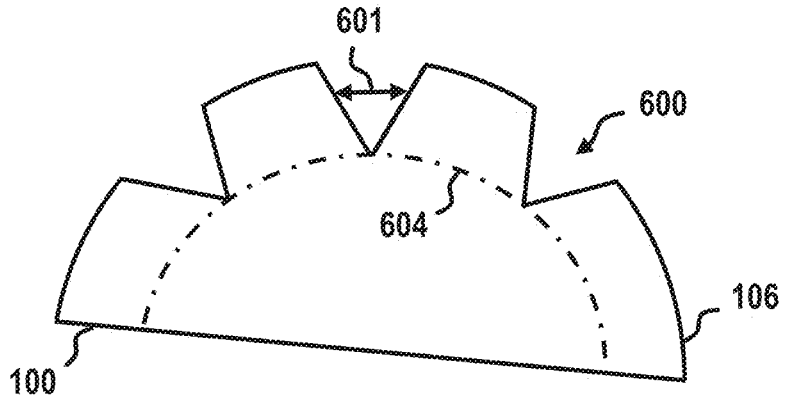
FIG. 12 show schematic diagrams of exemplary embodiments of double sheet metal elements including recesses.
Figure 12B:
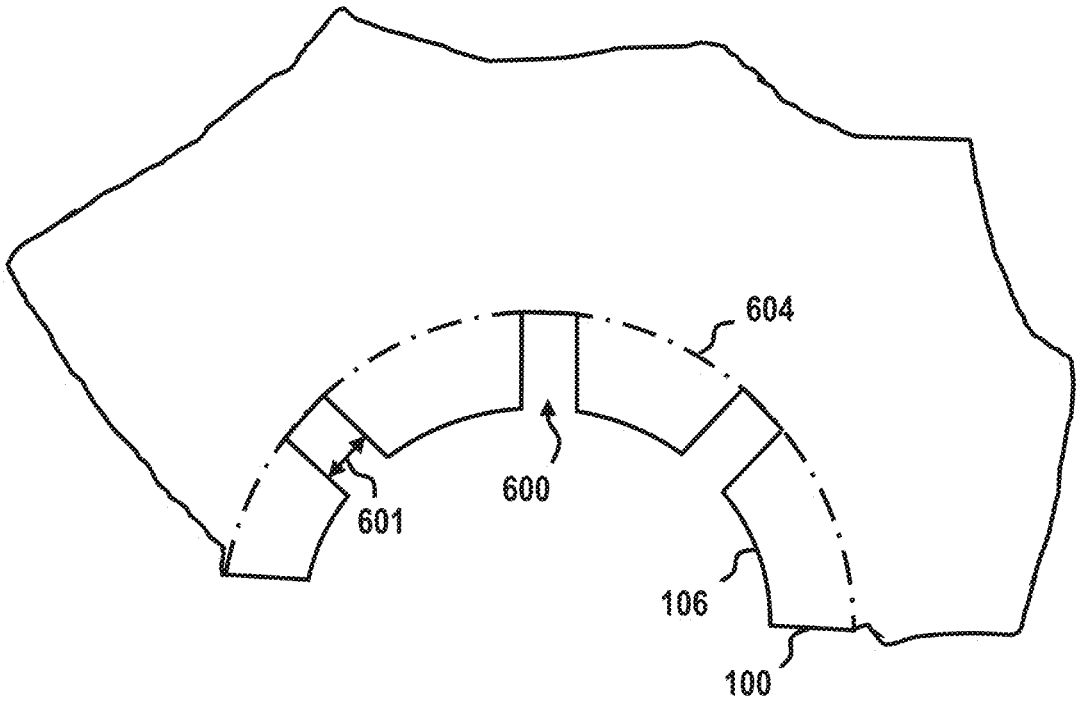

FIGS. 12A and 12B show schematic diagrams of two exemplary embodiments of double sheet metal elements 100 including recesses 600. FIG. 12A shows a double sheet metal element 100 having a convexly curved bending axis 604, along which the connecting section is to be perpendicularly oriented after folding. For example, the edge 106 of the double sheet metal element 100 extends parallel to the convexly curved bending axis 604. Recesses 600 extend between the bending axis 604 and the edge 106, for example at regular intervals along the bending axis 604. The recesses 600 have a width 601, which increases with increasing distance from the bending axis 604. According to embodiments, the width 601 is selected so as to compensate for the difference between the arc length of the bending axis 604 and the arc length of the section of the double sheet metal element 100 that is to be folded and perpendicularly oriented, which increases with increasing distance from the bending axis 604. When the folded sections are created and the connecting section is subsequently perpendicularly oriented, so as to extend perpendicularly to the extension plane of the double sheet metal element, according to embodiments the recesses are closed as a result of the perpendicular orientation, and the perpendicularly oriented connecting section 602 has a constant arc length over the distance from the bending axis 604, which is identical to the arc length of the bending axis 604 or only has a negligible deviation. According to embodiments, each of the recesses 600 has a V shape.

FIG. 12B shows a double sheet metal element 100 having a concavely curved bending axis 604, along which the connecting section is to be perpendicularly oriented after folding. In this case, the arc length decreases with increasing distance from the bending axis 604. When the connecting section is perpendicularly oriented, it must be adapted to the larger arc length of the bending axis 604. Such an adaptation can be implemented by recesses 600, which diverge further as a result of the perpendicular orientation of the connecting section and thereby compensate for the difference in the arc lengths. According to embodiments, the width 601 of the recesses 600 is selected to be constant, but increases with increasing distance from the bending axis 604 due to the perpendicular orientation of the connecting section. According to embodiments, the recesses 600 are linear notches.

Figure 13A:
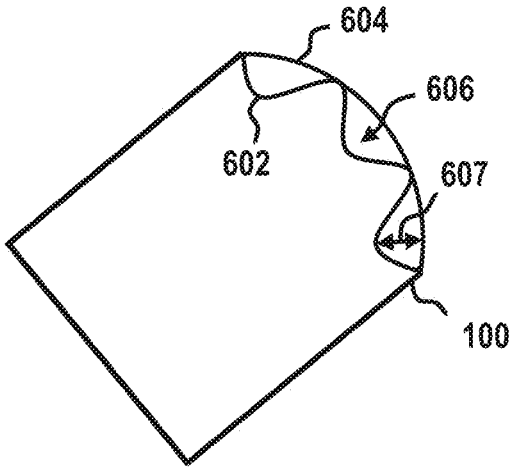
FIG. 13 show schematic diagrams of exemplary embodiments of double sheet metal elements having a corrugated structure.
Figure 13B:
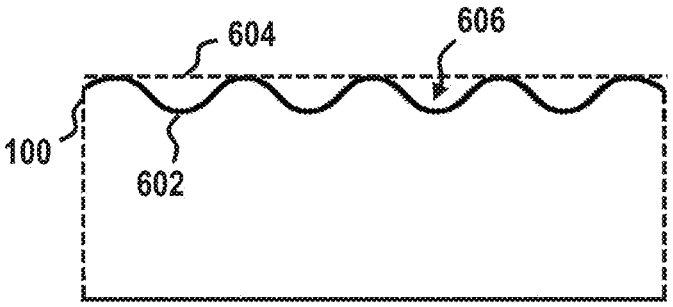

FIGS. 13A and 13B show exemplary embodiments of two double sheet metal elements 100 having a corrugated structure 606. Embodiments can have the advantage that an alternative method for compensating for different arc lengths in the case of a convexly curved bending axis 604, as is shown in FIG. 13A, is provided. FIG. 13A shows a top view perpendicularly from above onto a double sheet metal element 100. The connecting section 602 is perpendicularly oriented so as to extend substantially perpendicularly with respect to the extension plane of the double sheet metal element 100. The perpendicularly oriented connecting section 602 has a corrugated structure 606 including a plurality of additional depressions, the depth of which increases with increasing distance from the bending axis 604, that is, perpendicularly to the extension plane of the double sheet metal element 100. As a result of the corrugated structure 606, material of the connecting section 602, which has become superfluous due to the shortening of the arc length of the connecting section caused by the perpendicular orientation, can be distributed in the direction parallel to the extension plane of the double sheet metal element 100. In addition, embodiments can have the advantage that the stability of the connecting section, and thus of the connection, can be increased by the corrugated structure 606.

FIG. 13B shows a top view perpendicularly from above onto a double sheet metal element 100 having a straight bending axis 604. In this case, the corrugated structure 606 is solely used to additionally stabilize the connecting section 602, and thus the connection itself. According to embodiments, the straight bending axis 604 is maintained, and the corrugated structure 606 is only introduced into the connecting section 602 by way of material expansion. According to alternative embodiments, the corrugated structure 606 also includes the bending axis 604. For example, the connecting section 602 is perpendicularly oriented, and thereafter the corrugated structure 606 is introduced.

Figure 14A:
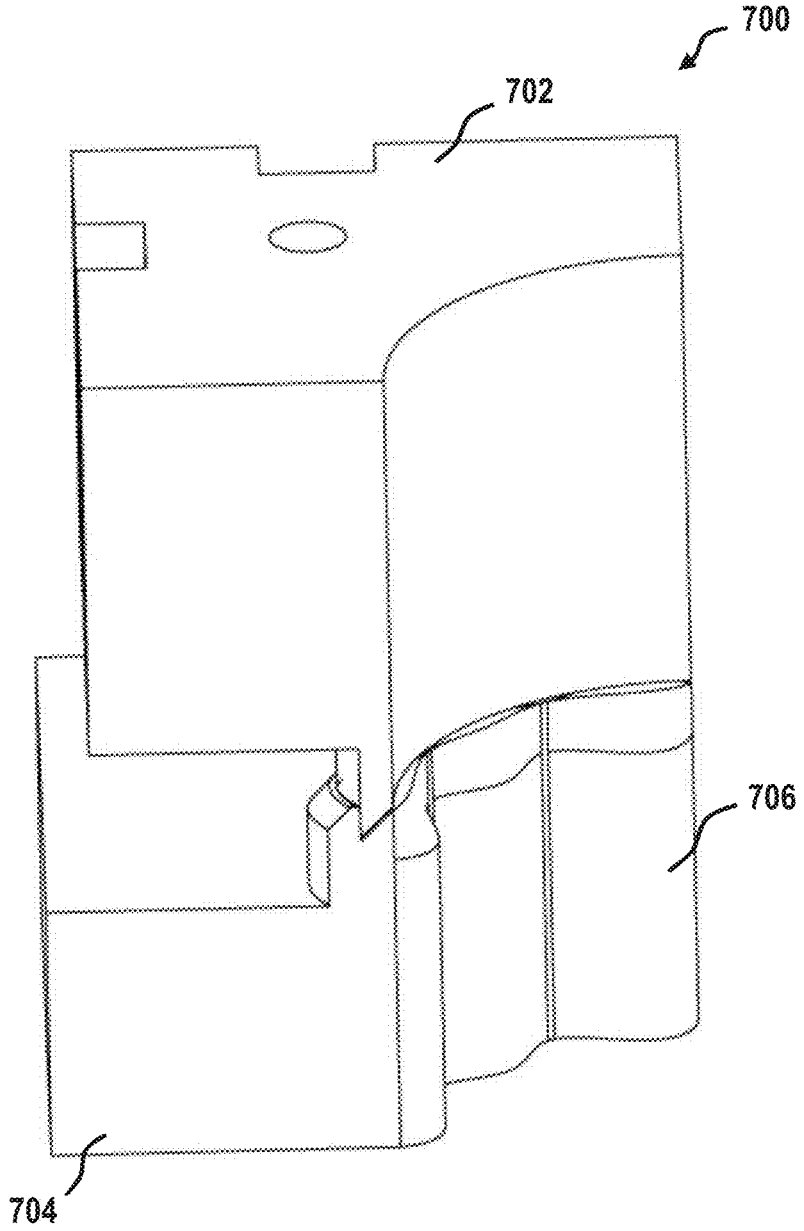
FIG. 14 show schematic diagrams of exemplary embodiments of an embossing tool.
Figure 14B:
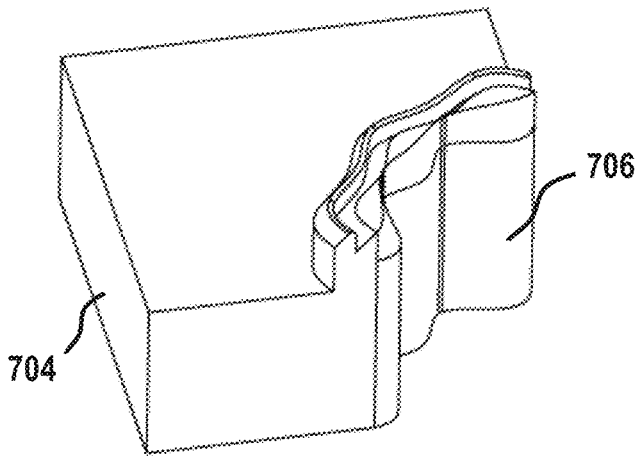
Figure 14C:
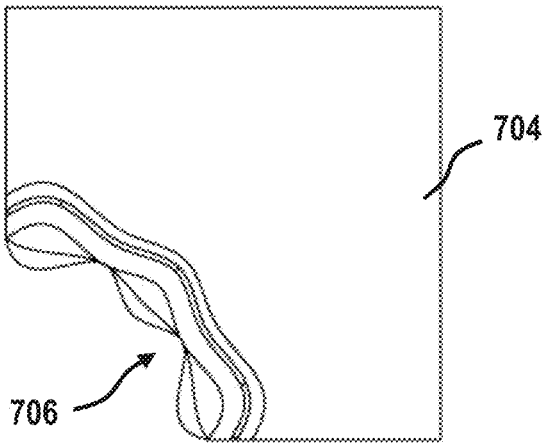

FIGS. 14A to 14C show schematic diagrams of exemplary embodiments of an embossing tool 700. FIG. 14A shows a perspective view of an exemplary embossing tool 700. The embossing tool 700 comprises an upper and a lower part 702, 704. The shown embossing tool 700 is configured to introduce a corrugated structure 606 into a convexly curved connecting section, as is shown in FIG. 13A, for example. The lower part 704 of the embossing tool 700 includes a concave curved embossing surface 706, which is designed to complement the convexly curved connecting section having the corrugated structure 606 and serves as a negative mold for embossing the corrugated structure 606. FIGS. 14B and 14C show further perspective views of the lower part 704 of the embossing tool 700.

Figure 15:
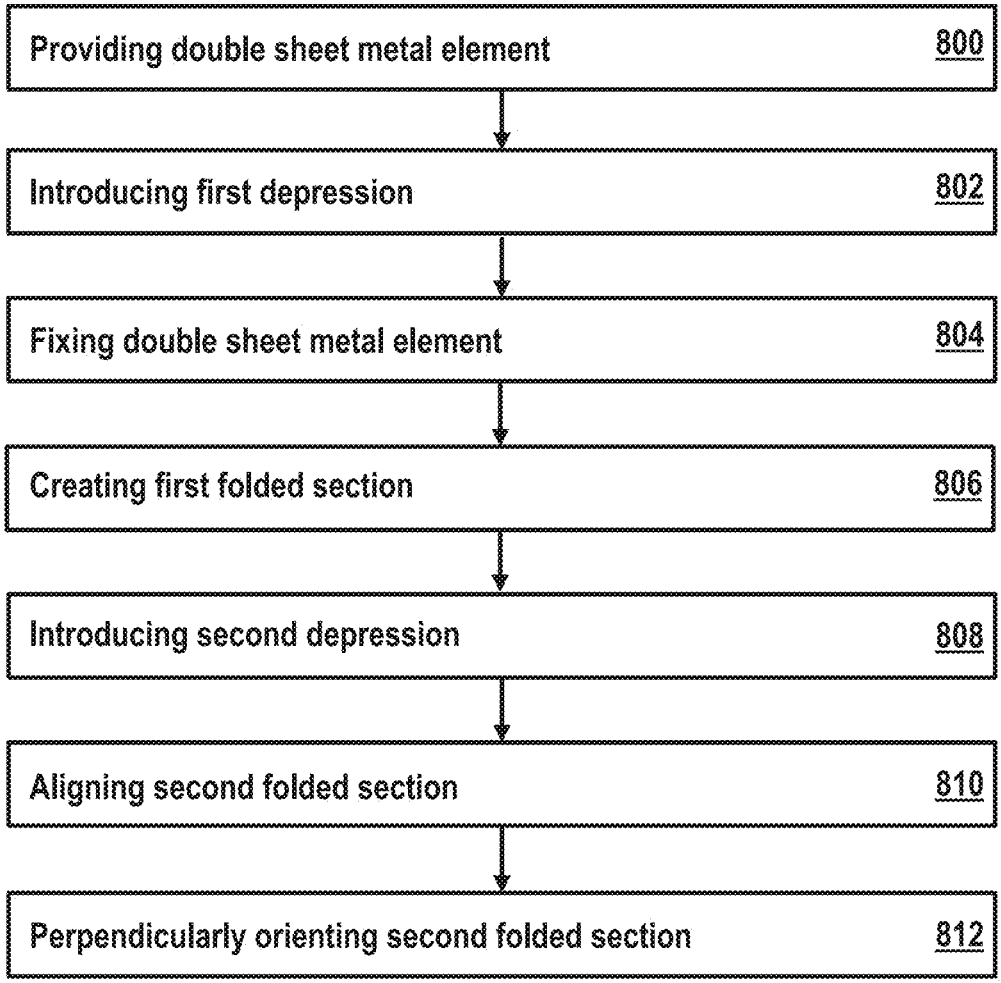
FIG. 15 shows a schematic flow chart of an exemplary embodiment of a fourth method.

FIG. 15 shows a schematic flow chart of an exemplary embodiment of a fourth method for connecting two sheet metal end sections that are arranged on top of one another by means of forming. In block 800, a double sheet metal element is provided. The double sheet metal element comprises two sheet metal end sections arranged on top of one another and extends in an extension plane. The two sheet metal end sections are to be connected to one another along a connecting line located in the extension plane. In block 802, a first depression, for example V-shaped depression, is introduced into the double sheet metal element, which extends along the connecting line. By introducing the first depression, the double sheet metal element is brought into a processing position. While a device for introducing the first depression, for example a punch, is engaged with the double sheet metal element and holds it temporarily in the processing position, the double sheet metal element is fixed, in block 804, in the processing position for further processing, using a clamping device.

In block 806, a first folded section of the double sheet metal element is created along the connecting line. In the process, two mutually opposing inside walls of the first depression are pressed against one another. The resulting first folded section is a section that is folded once. In block 808, a second depression, for example a V-shaped depression, is introduced into the double sheet metal element. In block 810, a second folded section of the double sheet metal element is created along the connecting line, which includes the first folded section. In the process, two mutually opposing inside walls of the second depression are pressed against one another. The resulting second folded section is a section that is folded twice. In block 812, the connecting section thus created comprising the second folded section is perpendicularly oriented relative to the extension plane of the double sheet metal element. According to embodiments, the perpendicular orientation comprises bending over a portion of the double sheet metal element comprising the connecting section including the second folded section along a bending axis that extends parallel to the connecting line, so that the connecting section extends perpendicularly to the extension plane.

According to alternative embodiments, the connecting section can be implemented by the first folded section, without a second folded section being created according to blocks 808, 810. In a procedure corresponding to block 812, the connecting section thus created comprising the first folded section is perpendicularly oriented relative to the extension plane of the double sheet metal element. According to embodiments, the perpendicular orientation comprises bending over a portion of the double sheet metal element comprising the connecting section including the first folded section along a bending axis that extends parallel to the connecting line, so that the connecting section extends perpendicularly to the extension plane.

FIGS. 16A to 16I show schematic diagrams of an exemplary embodiment of a device 120 for carrying out the fourth method from FIG. 15. In the process, the involved moving device elements of the device 120 are displaced exclusively perpendicularly to the extension plane of the double sheet metal element 100. The device 120 comprises a punch 130 comprising a punch element 132. The punch element 132 has a, for example, V-shaped cross-section, wherein one leg of the V-shaped cross-section is provided by a first stop surface 134. In addition to the punch 130, the device 120 comprises a die 140, providing a bearing surface for placing on the double sheet metal element 100. Two, for example V-shaped, cavities 142, 144 are introduced into the die 140, wherein the two V-shaped cavities 142, 144 extend parallel to one another. Both the punch and the die 140 are displaceable in the vertical direction, that is, perpendicularly to the extension plane 152 of the double sheet metal element 100.

Finally, the device 120 also comprises a clamping device for fixing an end 105 of the double sheet metal element 100 by way of a first and a second clamping element 150, 151, wherein the second clamping element 151 provides a portion of the bearing surface for the double sheet metal element 100. An opposite end 106 of the double sheet metal element 100, in contrast, is a free, non-fixed end.

Figure 16A:
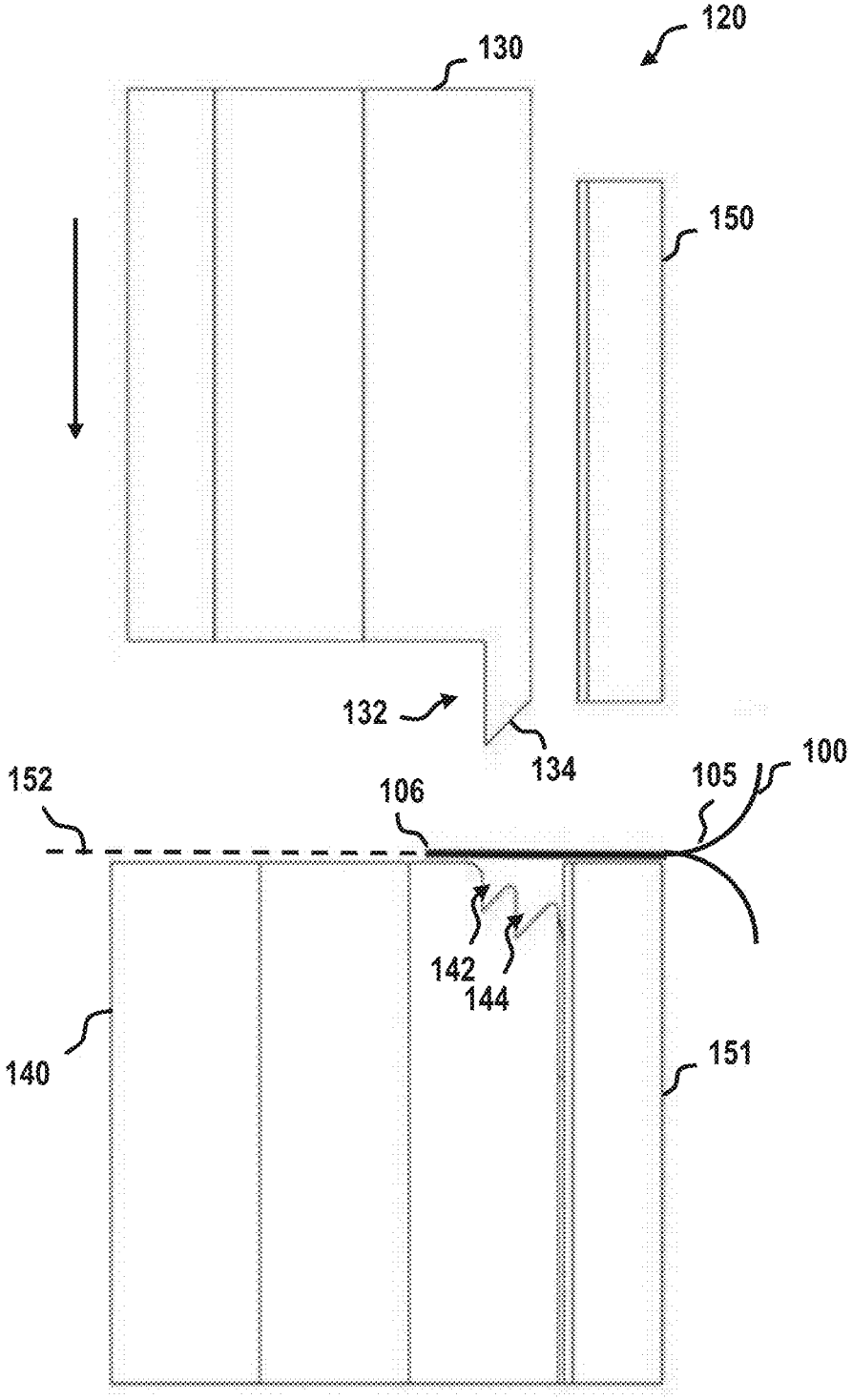
FIG. 16 show schematic diagrams of an exemplary embodiment of a device for carrying out the fourth method from FIG. 15.
Figures 16B, 16C, 16D, 16E:
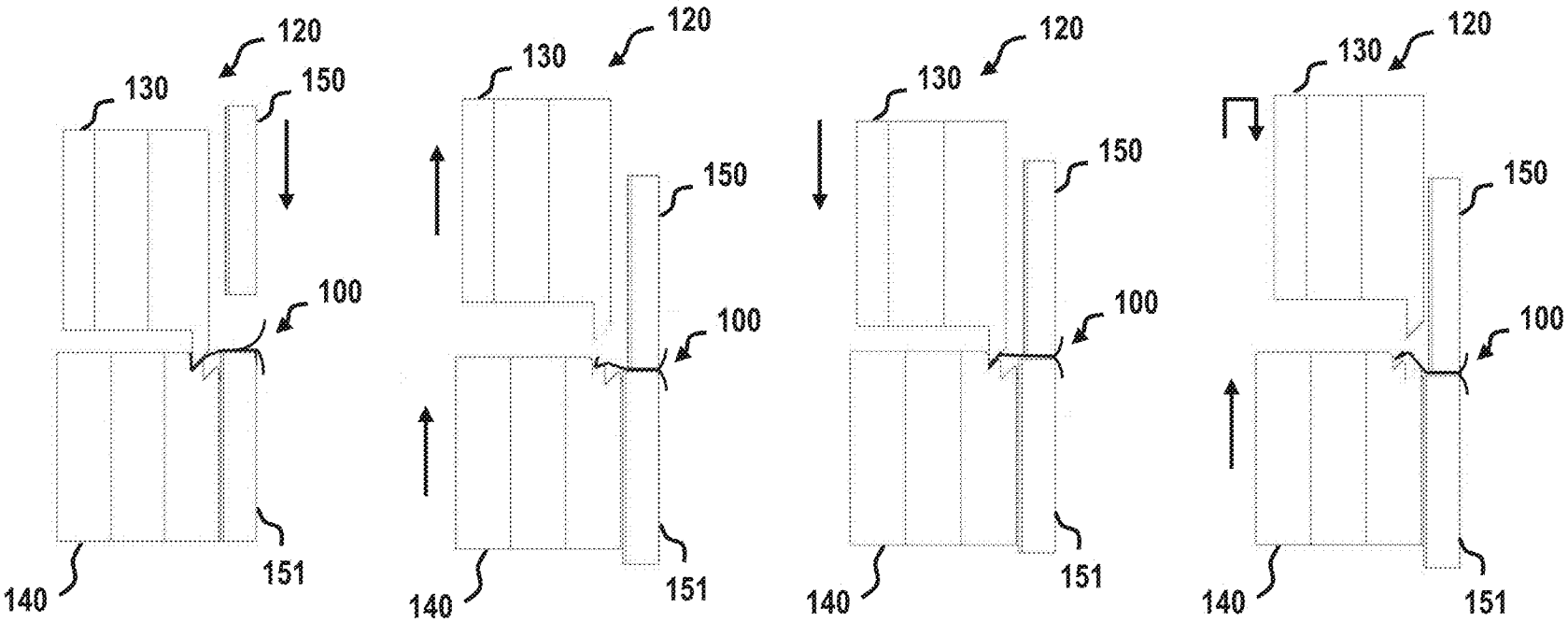

FIG. 16A shows the double sheet metal element 100, which in a starting position is arranged on a bearing surface provided by the die 140 and the second clamping element 151. In this starting position, the double sheet metal element 100 is not fixed on the bearing surface. So as to introduce a first, for example V-shaped, depression into the double sheet metal element 100, the punch element 132 of the punch 130 is displaced perpendicularly from above into the first cavity 142 of the die 140. In the process, the punch element 132, as shown in FIG. 16B, engages with the double sheet metal element 100 and pulls the end 105 to be fixed between the two clamping elements 150, 151. In the process, the double sheet metal element 100 is automatically arranged in a processing position for further processing. So as to fix the double sheet metal element 100 in this processing position, the first clamping element 150 is likewise displaced downwardly, so that the end 105 of the double sheet metal element 100 to be fixed is clamped between the two clamping elements 150, 151, while the punch element 132 engaged with the double sheet metal element 100 holds the double sheet metal element 100 in position. In this way, it can be effectively prevented that the double sheet metal element 100, in the course of the clamping process, is at least partially pressed out of the region between the two clamping element 150, 151 again by horizontal force components directed parallel to the extension lane 152. When the double sheet metal element 100 is fixed in the processing position by the two clamping elements 150, 151, the punch 130 is displaced upwardly again.

In FIG. 16C, the die 140 is displaced in the vertical direction upwardly toward the punch 130. In this way, the free end comprising the edge 106 of the double sheet metal element 100 and the first V-shaped depression is pivoted upwardly by a first angle about the end 105 that is fixed in a stationary manner by the clamping device 150, toward the punch 130. As a result, the first V-shaped depression 160 is positioned in a tilted manner beneath the first stop surface 134 of the punch element 132. As is shown in FIG. 16D, the punch 130 is displaced downwardly, so that the stop surface 134 of the punch element 132 makes contact with an outside wall of the first V-shaped depression and presses the first V-shaped depression 160 together. In the process, two mutually opposing inside walls of the first V-shaped depression are pressed against one another, and a first folded section of the double sheet metal element 100 is created.

Figure 16I:
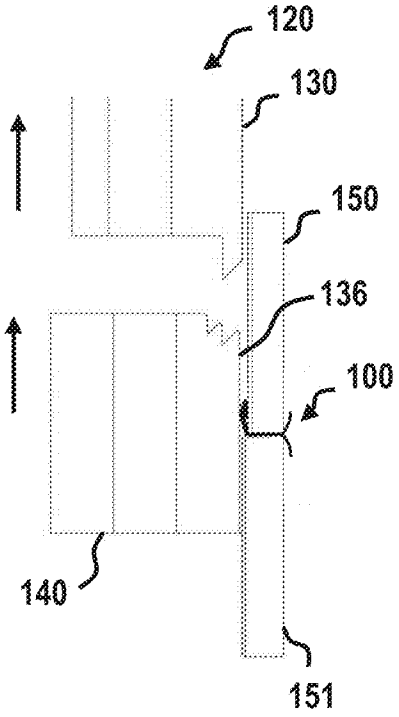
Figure 16H:
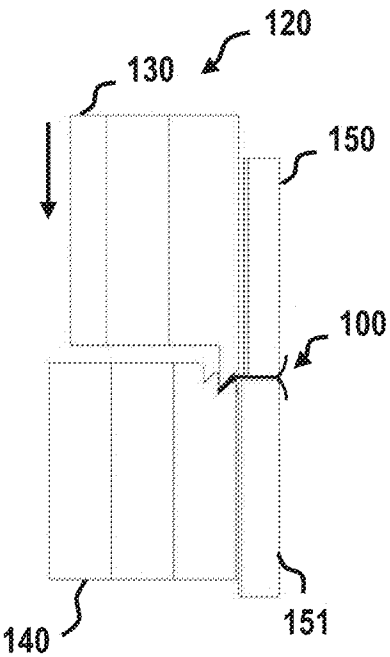

As is shown in FIG. 16E, the punch 130 is displaced upwardly in the vertical direction, and additionally in the horizontal direction toward the first clamping element 150, so that the punch element 132 is positioned above the second cavity 144. Moreover, the die 140 is displaced in the vertical direction upwardly toward the punch 130. In this way, the free end comprising the edge 106 of the double sheet metal element 100 and the first folded section is pivoted upwardly by a second angle about the end 105 that is fixed in a stationary manner by the clamping device 150, toward the punch 130. As a result, the first folded section is pivoted out of the cavity 142. As is shown in FIG. 16F, the punch element 132 is then displaced downwardly in the vertical direction into the cavity 144, whereby a second, for example V-shaped, depression is introduced into the double sheet metal element 100. Thereafter, the punch 130 is displaced upwardly again the vertical direction.

Figure 16G:
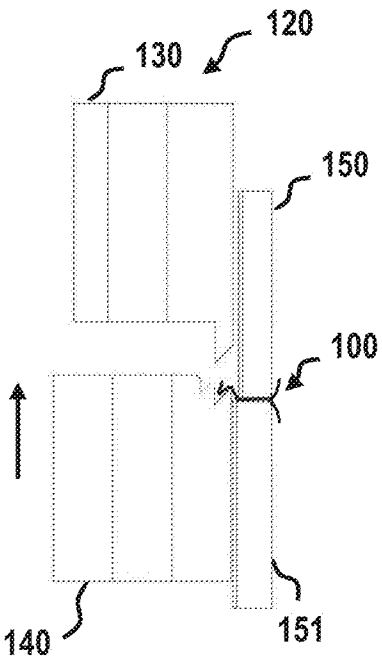
Figure 16F:
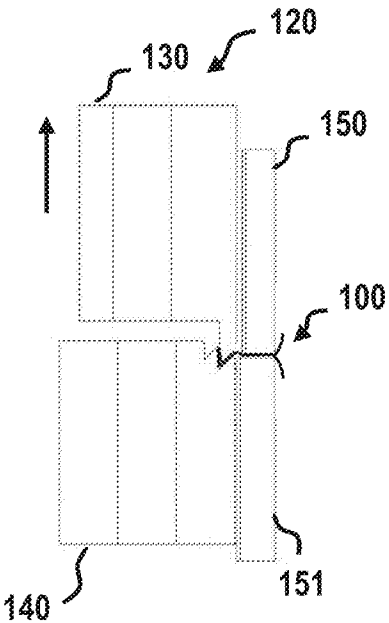

In FIG. 16G, the die 140 is displaced in the vertical direction upwardly toward the punch 130. In this way, the second V-shaped depression is pivoted upwardly by a third angle about the end 105 that is fixed in a stationary manner by the clamping device 150, toward the punch 130. As a result, the second V-shaped depression is positioned in a tilted manner beneath the first stop surface 134 of the punch element 132. As is shown in FIG. 16H, the punch 130 is displaced downwardly, so that the stop surface 134 of the punch element 132 makes contact with an outside wall of the second V-shaped depression and presses the second V-shaped depression together. In the process, two mutually opposing inside walls of the second V-shaped depression are pressed against one another, and a connecting section of the double sheet metal element 100 comprising a second folded section is created. In FIG. 16I finally, first the punch 130 and then the die 140 are displaced upwardly in the vertical direction, wherein the connecting section is perpendicularly oriented by a lateral stop surface 136 of the die 140. In the perpendicularly oriented position, the connecting section extends perpendicularly to the extension plane 152 of the double sheet metal section.

According to an alternative embodiment, the starting situation shown in FIG. 16A is followed by a method that comprises the steps shown in FIGS. 16F to 16I. In this case, the folded section generated in FIGS. 16F to 16H is a first folded section, that is, a section that is folded once and forms the connecting section. As is shown in FIG. 16I, the connecting section is then oriented perpendicularly with respect to the extension plane 152. In this example, the first cavity 142 in the die 140 can be dispensed with. The method according to FIG. 15 in this case comprises the steps 800 to 806 and 812, wherein the first folded section is perpendicularly oriented in step 812.

Figure 17A:
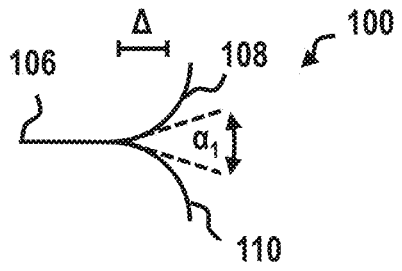
FIG. 17 show schematic diagrams of an exemplary embodiment of sheet metal end sections.
Figure 17B:
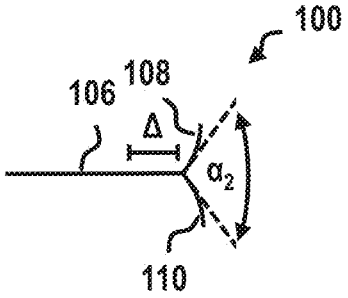

FIGS. 17A and 17B show schematic diagrams of an exemplary embodiment of sheet metal end sections. FIG. 17A in detail shows the situation prior to the two sheets 108 and 110 being clamped together by the clamping device 150, 151 of FIGS. 16A to 16I. The two sheets 108 and 110 include an angle $\alpha_1$, which is small as a result of the small curvature. The angle $\alpha_1$ increases with increasing distance from the edge 106 of the double sheet metal element 100. According to embodiments, the small angle $\alpha_1$ is necessary to avoid damage during the creation of the geometry of the two sheets 108, 100. When the double sheet metal element is pulled between the clamping elements 150, 151 by the section Δ as a result of the introduction of the first depression, the opening between the two sheets 108, 110 is closed in the course of the clamping process in the region of the section Δ. The angle $\alpha_2$ shown in FIG. 17B and adjoining the closed region is greater than the closed angle $\alpha_1$. Due to the relative small angle $\alpha_1$, the distance between the two sheets 108, 110 is relatively small in the region of the section Δ, so that it generally cannot be used to receive additional structures that are introduced into the hollow space enclosed between the sheets 108, 110. The usable hollow space between the sheets 108, 110 is not reduced by closing this region. However, the double sheet metal element 100 can be folded in such a way that the distance between the resulting connecting section and the usable hollow space is solely defined by the width of the clamping surfaces of the clamping device and encompasses the closed section Δ, instead of the section Δ remaining in addition to the width of the clamping surfaces.

Figure 18:
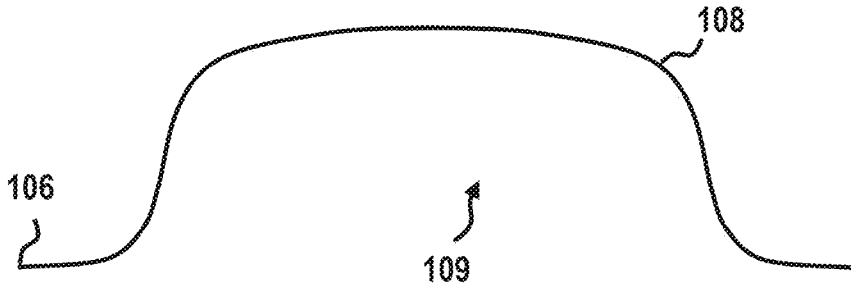
FIG. 18 shows a schematic diagram of an exemplary embodiment of a metal sheet.

FIG. 18 shows a cross-section of an exemplary embodiment of a sheet 108 designed as a half shell element. For example, this half shell element is formed from a planar sheet by way of deep drawing, using a positive mold. This half shell element has an open hollow space 109, which, together with a second half shell element, can create a closed hollow space for receiving additional structures. So as to avoid damage to the sheet 108 in the course of the deep drawing process, the sheet, proceeding from the edge 106, initially has only a small curvature. During the creation of a closed hollow space, the resulting hollow space, refer to FIG. 17A, however, is generally so narrow in the region of the small curvature that it cannot be used to receive additional structures. In other words, this is lost space. If, however, this space is closed as shown above proceeding from FIG. 17A, so that only a section having a large curvature as shown in FIG. 17B remains, the expansion of mutually connected half shell elements parallel to the extension plane can be effectively reduced, without reducing the space usable for receiving additional structures. This can in particular be of advantage when the mutually connected half shell elements are to be arranged or used when space constraints exist.

Figure 19C:
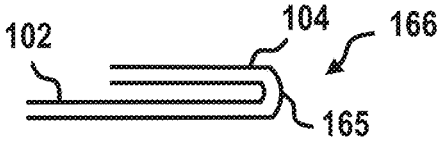
Figure 19D:
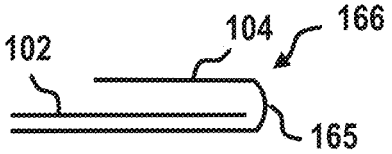
Figure 19E:
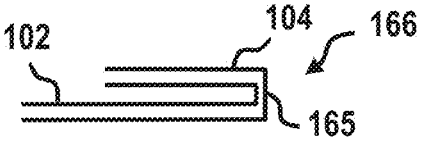
Figure 19F:
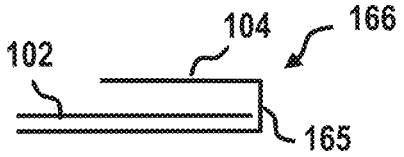

For the different embodiments of the V depression 160 of FIGS. 5A to 5C, FIGS. 19A to 19F each show exemplary embodiments of the first folded section 166 resulting from those embodiments. The embodiments shown in FIGS. 19A, 19C, and 19E differ compared to the embodiments shown in FIGS. 19B, 19D, and 19E in that the two sheet metal end sections 102, 104 in the first case have the same length, and in the second case have differing lengths. The embodiment of FIG. 19A results from the V-shaped depression 160 of FIG. 5D being pressed together in the course of the completion of the first folded section 166. The embodiment of FIG. 19B results from the V-shaped depression 160 of FIG. 5F being pressed together in the course of the completion of the first folded section 166. In this case, the first sheet metal end section 102 is shorter compared to the second sheet metal end section 104 by so much that, even though the first sheet metal end section 102 is not folded over with the second sheet metal end section 104, the edge of the first sheet metal end section 102 is enveloped by the folded-over sheet metal end section 104. FIGS. 19C and 19D, and FIGS. 19E and 19F, each show two situations analogous to FIGS. 19A and 19B, which only differ in the shape of the base 165 of the V-shaped depression 160 from which they result. In the case of FIGS. 19C and 19D, the base 165 is formed by an arched surface, and in the case of FIGS. 19E and 19F, it is formed by a planar surface. The relationships between the relative extension of the two sheet metal end sections 102, 104 and the contribution thereof to the creation of the depression 160 described here apply analogously to arbitrary configurations of the depression 160.

LIST OF REFERENCE NUMERALS 100 double sheet metal element
102 sheet metal end section
104 sheet metal end section
105 fixed end
106 edge/free end
108 sheet
109 hollow space
110 sheet
120 device
130 punch
132 punch element
133 punch element
134 stop surface
135 stop surface
136 stop surface
140 die
141 sub-die
142 cavity
143 sub-die
144 cavity
146 cavity
150 clamping device
151 clamping device
152 extension plane
160 depression
162 inside wall
164 inside wall
165 base
166 folded section
170 depression
172 inside wall
174 inside wall
176 folded section
180 depression
190 stop surface
191 stop surface
500 device
510 roller pair
512 roller
514 roller
520 roller pair
524 roller
530 roller pair
532 roller
534 roller
540 roller pair
542 roller
544 roller
550 roller pair
554 roller
560 roller pair
562 roller
564 roller
570 roller pair
572 roller
574 roller
600 recess
601 width
602 connecting section
604 bending axis
606 corrugated structure
607 depth
700 embossing tool
702 top part
704 bottom part
706 embossing surface

The invention claimed is:

1. A method for connecting two sheet metal end sections that are arranged on top of one another by means of forming, the method comprising:

providing a double sheet metal element, which comprises the two sheet metal end sections arranged on top of one another and extending in an extension plane;

creating a connecting section along a connecting line between the two sheet metal end sections, the connecting line in the extension plane, the creating a connecting section including, introducing a first depression, which extends along the connecting line, into the double sheet metal element, and creating a first folded section of the double sheet metal element along the connecting line, wherein two mutually opposing inside walls of the first depression are pressed against one another; and perpendicularly orienting the connecting section relative to the extension plane of the double sheet metal element by bending over a portion of the double sheet metal element including the connecting section along a first bending axis, the first bending axis extending parallel to the connecting line, so that the connecting section extends perpendicularly to the extension plane.

2. The method according to claim 1, wherein an edge of the first depression is formed by an edge of the double sheet metal element.

3. The method according to claim 1, wherein prior to the perpendicularly orienting the connecting section, the method further comprises:

aligning the connecting section, the aligning of the connecting section including, bending the connecting section about a second bending axis extending parallel to the connecting line so that the connecting section extends parallel to the extension plane of the double sheet metal element.

4. The method according to claim 1, wherein the creating a connecting section further comprises:

introducing a second depression, which extends along the connecting line, into the double sheet metal element; and creating a second folded section of the double sheet metal element along the connecting line, wherein two mutually opposing inside walls of the second depression are pressed against one another, and the second folded section comprises the first folded section.

5. The method according to claim 4, wherein a first of the two mutually opposing inside walls of the second depression is at least partially provided by the first folded section.

6. The method according to claim 5, wherein the first of the two mutually opposing inside walls of the second depression comprises an edge of the double sheet metal element.

7. The method according to claim 4, wherein the first and second depressions are both introduced into a first surface of the double sheet metal element.

8. The method according to claim 7, wherein the creating a connecting section further comprises:

introducing a third depression extending along the connecting line into a second surface of the double sheet metal element which faces away from the first surface, the first bending axis extending along a base of the third depression.

9. The method according to claim 7, wherein the creating a connecting section further comprises:

introducing a fourth depression extending along the connecting line into the first surface of the double sheet metal element, an edge of the fourth depression providing the first bending axis.

10. The method according to claim 9, wherein the first depression, the second depression, the fourth depression, or any combination thereof are V-shaped depressions.

11. The method according to claim 10, further comprising:

positioning and fixing the double sheet metal element in a processing position, the positioning and fixing the double sheet metal element in the processing position being carried out by the introducing a first depression by a device engaging with the double sheet metal element, the fixing the double sheet metal element in the processing position being carried out using a clamping device, and the double sheet metal element during clamping of the double sheet metal element by the clamping device being held in the processing position by the device having engaged with the double sheet metal element.

12. The method according to claim 4, wherein, prior to the introducing a second depression, the creating a connecting section further comprises:

aligning the first folded section, the aligning the first folded section including bending the first folded section about a third bending axis provided by an edge of the first depression, so that the first folded section extends parallel to the extension plane of the double sheet metal element.

13. The method according to claim 1, wherein the method further comprises:

introducing a corrugated structure having a plurality of additional depressions into the connecting section, the plurality of additional depressions, in a perpendicularly oriented state of the connecting section, extending perpendicular to the extension plane.

14. The method according to claim 13, wherein the plurality of additional depressions each have a depth that increases with increasing distance from the extension plane.

15. The method according to claim 1, further comprising:

introducing a plurality of recesses into the double sheet metal element along the first bending axis, each of the recesses extending from the first bending axis to an edge of the double sheet metal element.

16. The method according to claim 15, wherein each of the recesses has a width that increases with increasing distance from the first bending axis.

17. A device, comprising:

means for connecting two sheet metal end sections that are arranged on top of one another by means of forming, wherein a double sheet metal element comprises the two sheet metal end sections arranged on top of one another and extending in an extension plane, and the two sheet metal end sections are to be connected to one another along a connecting line located in the extension plane, the means of the device for creating a connecting section along the connecting line include means for:

introducing a first depression, which extends along the connecting line, into the double sheet metal element; and creating a first folded section of the double sheet metal element along the connecting line, wherein two mutually opposing inside walls of the first depression are pressed against one another; and the means of the device further including:

means for perpendicularly orienting the connecting section relative to the extension plane of the double sheet metal element by bending over a portion of the double sheet metal element comprising the connecting section along a first bending axis that extends parallel to the connecting line, so that the connecting section extends perpendicularly to the extension plane.

18. The device according to claim 17, wherein the means of the device comprise:

a plurality of roller pairs configured to connect the two metal sheet end sections.

19. The device according to claim 18, wherein each pair of the plurality of roller pairs are arranged in rows, the double sheet metal element being displaced along the rows and consecutively passing through each pair of roller pairs along the connecting line.

20. The device according to claim 18, wherein the device is configured to displace the plurality of the roller pairs in a path-controlled manner along an edge of the double sheet metal element.

21. The device according to claim 20, wherein a same roller pair is configured to connect the two metal sheet end sections.

22. The device according to claim 17, wherein the means of the device for connecting two sheet metal end sections comprise:

a punch; and a die, the punch comprising one or more punch elements extending in a longitudinal direction;

the die comprising a bearing surface for placing on the double sheet metal element, including a plurality of cavities, which extend parallel to one another along the longitudinal direction of the punch elements and are each configured to introduce at least one depressions into the double sheet metal element; and the punch being configured to be displaced vertically in a first direction into one of the cavities by way of one of the punch elements for introducing the depressions.

23. The device according to claim 22, wherein the punch is further configured to be displaced in a second direction parallel to the bearing surface, and perpendicularly to the first direction, by way of one of the punch elements against the double sheet metal element, for creating one of the folded sections or for perpendicularly orienting the connecting section.

24. The device according to claim 22, wherein the punch is further configured to be vertically displaced in the first direction into one of the cavities by way of one of the punch elements, for creating one of the folded sections.

25. The device according to claim 22, wherein the die is configured to be displaced in a direction that is opposite the first direction for introducing one of the depressions, for creating one of the folded sections or for perpendicularly orienting the connecting section.

26. The device according to claim 22, wherein the die comprises a plurality of sub-dies, the sub-dies together providing the bearing surface for placing on the double sheet metal element, each of the sub-dies including at least one of the cavities; and at least one of the sub-dies being configured to be displaced in the direction that is opposite the first direction for introducing one of the depressions, for creating one of the folded sections or for perpendicularly orienting the connecting section.

27. The device according to claim 22, wherein one or more of the cavities are V-shaped cavities.

28. The device according to claim 22, wherein the device further comprises:

a clamping device for fixing the double sheet metal element in a processing position.

29. The device according to 17, further comprising:

an embossing element having a corrugated surface, which is configured to introduce a corrugated structure having a plurality of additional depressions into the connecting section, the additional depressions, in the perpendicularly oriented state of the connecting section, extending perpendicular to the extension plane.

30. The device according to claim 17, wherein the device further comprises:

cutting device, which is configured to introduce recesses into the double sheet metal element along the first bending axis, each of the recesses extending from the first bending axis to an edge of the double sheet metal element.

* * * * *